US012082611B2

(12) United States Patent
Austin et al.

(10) Patent No.: US 12,082,611 B2
(45) Date of Patent: Sep. 10, 2024

(54) AEROSOL DELIVERY DEVICE

(71) Applicant: Imperial Tobacco Limited, Bristol (GB)

(72) Inventors: Andrew Austin, Liverpool (GB); Tamas Sajtos, Liverpool (GB); Alan Cook, Liverpool (GB); Pete Lomas, Liverpool (GB); Andrew Tyler, Liverpool (GB); Chris Lord, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 464 days.

(21) Appl. No.: 17/533,736

(22) Filed: Nov. 23, 2021

(65) Prior Publication Data

US 2022/0079233 A1 Mar. 17, 2022

Related U.S. Application Data

(63) Continuation of application No. PCT/EP2020/064318, filed on May 22, 2020, and a (Continued)

(30) Foreign Application Priority Data

May 24, 2019 (EP) ..... 19176368
May 24, 2019 (EP) ..... 19176370
(Continued)

(51) Int. Cl.
*A24F 40/42* (2020.01)
*A24F 40/485* (2020.01)
*A24F 40/60* (2020.01)

(52) U.S. Cl.
CPC ..... *A24F 40/42* (2020.01); *A24F 40/485* (2020.01); *A24F 40/60* (2020.01)

(58) Field of Classification Search
CPC ..... A24F 40/42; A24F 40/485; A24F 40/40; A24F 40/05; A24F 40/10; A24F 40/20; A24F 40/30
See application file for complete search history.

(56) References Cited

U.S. PATENT DOCUMENTS 2,868,586 A 1/1959 Croce
6,024,097 A 2/2000 Von Wielligh
(Continued)

FOREIGN PATENT DOCUMENTS

CA 2926232 A1 4/2016
CA 3042149 8/2018
(Continued)

OTHER PUBLICATIONS

European Patent Office acting as the International Search Authority; International Search Report and Written Opinion regarding PCT/EP2020/064318; Jul. 23, 2020, 10 pages.
(Continued)

*Primary Examiner* — Harshad C Patel
(74) *Attorney, Agent, or Firm* — DUNLAP CODDING, P.C.

(57) ABSTRACT

An aerosol delivery device comprises: a storage for storing an aerosol precursor; an aerosol generator comprising an aerosol generator portion configured to receive the aerosol precursor from the storage; an air flow passage configured to direct air past the aerosol generator portion to pick up the aerosol precursor from the aerosol generator portion to form an aerosol; and a barrier arrangement for inhibiting evaporation of aerosol precursor when the barrier arrangement is closed, the barrier arrangement being openable to permit generation of aerosol.

20 Claims, 50 Drawing Sheets

Related U.S. Application Data continuation of application No. PCT/EP2020/064320, filed on May 22, 2020, and a continuation of application No. PCT/EP2020/064322, filed on May 22, 2020, and a continuation of application No. PCT/EP2020/064323, filed on May 22, 2020, and a continuation of application No. PCT/EP2020/064321, filed on May 22, 2020.

(30) Foreign Application Priority Data

| | | |
|---|---|---|
| May 24, 2019 | (EP) | 19176380 |
| May 24, 2019 | (EP) | 19176386 |
| May 24, 2019 | (EP) | 19176388 |
| May 24, 2019 | (EP) | 19176391 |
| May 24, 2019 | (EP) | 19176392 |
| May 24, 2019 | (EP) | 19176394 |
| May 24, 2019 | (EP) | 19176398 |
| May 24, 2019 | (EP) | 19176400 |
| May 24, 2019 | (EP) | 19176406 |
| May 24, 2019 | (EP) | 19176408 |
| May 24, 2019 | (EP) | 19176412 |
| May 24, 2019 | (EP) | 19176416 |
| May 24, 2019 | (EP) | 19176420 |
| May 24, 2019 | (EP) | 19176422 |
| May 24, 2019 | (EP) | 19176430 |
| May 24, 2019 | (EP) | 19176433 |

(56) References Cited

U.S. PATENT DOCUMENTS

| | | | | |
|---|---|---|---|---|
| 6,213,358 | B1 | 4/2001 | Libit et al. | |
| 9,439,455 | B2 * | 9/2016 | Alarcon | A24F 40/51 |
| 9,491,970 | B2 | 11/2016 | Shinozaki et al. | |
| 9,901,120 | B2 * | 2/2018 | Liu | A24F 40/40 |
| 10,383,370 | B2 * | 8/2019 | Wendt Thevenaz | A24F 40/46 |
| 2005/0211790 | A1 | 9/2005 | Kvietok et al. | |
| 2008/0241255 | A1 | 10/2008 | Rose et al. | |
| 2011/0253134 | A1 | 10/2011 | Chen et al. | |
| 2014/0183273 | A1 | 7/2014 | Hafer et al. | |
| 2014/0366898 | A1 | 12/2014 | Monsees et al. | |
| 2015/0027454 | A1 | 1/2015 | Li et al. | |
| 2015/0027470 | A1 | 1/2015 | Kane et al. | |
| 2015/0053220 | A1 | 2/2015 | Levy et al. | |
| 2015/0237917 | A1 | 8/2015 | Lord | |
| 2015/0282529 | A1 | 10/2015 | Li et al. | |
| 2016/0309784 | A1 | 10/2016 | Silvestrini et al. | |
| 2017/0001854 | A1 | 1/2017 | Li et al. | |
| 2017/0013880 | A1 | 1/2017 | O'Brien et al. | |
| 2017/0013885 | A1 | 1/2017 | Qiu | |
| 2017/0055574 | A1 * | 3/2017 | Kaufman | A24B 15/12 |
| 2017/0071249 | A1 | 3/2017 | Ampolini et al. | |
| 2017/0071258 | A1 | 3/2017 | Li et al. | |
| 2017/0157341 | A1 | 6/2017 | Pandya et al. | |
| 2017/0196268 | A1 | 7/2017 | Reevell | |
| 2017/0231274 | A1 | 8/2017 | Davis et al. | |
| 2017/0233114 | A1 | 8/2017 | Christensen et al. | |
| 2017/0251723 | A1 | 9/2017 | Kobal et al. | |
| 2017/0258140 | A1 * | 9/2017 | Rostami | A24F 40/485 |
| 2017/0280775 | A1 | 10/2017 | Manca et al. | |
| 2017/0280778 | A1 | 10/2017 | Force | |
| 2017/0281883 | A1 * | 10/2017 | Li | A61M 11/042 |
| 2017/0319799 | A1 | 11/2017 | Yamada et al. | |
| 2017/0340003 | A1 | 11/2017 | Batista et al. | |
| 2018/0027876 | A1 | 2/2018 | Watson et al. | |
| 2018/0027882 | A1 | 2/2018 | Hepworth et al. | |
| 2018/0007965 | A1 | 6/2018 | Karles | |
| 2018/0169355 | A1 | 6/2018 | Reevell | |
| 2018/0177958 | A1 | 6/2018 | Wilder et al. | |
| 2018/0220707 | A1 | 8/2018 | Biel et al. | |
| 2018/0220712 | A1 | 8/2018 | Hopps | |
| 2018/0249762 | A1 | 9/2018 | Daryani et al. | |
| 2018/0279672 | A1 | 10/2018 | Davis et al. | |
| 2018/0279681 | A1 * | 10/2018 | Rojo-Calderon | A24D 1/20 |
| 2018/0289067 | A1 | 10/2018 | Courbat et al. | |
| 2018/0295882 | A1 | 10/2018 | Ricketts et al. | |
| 2019/0031407 | A1 | 1/2019 | Biel et al. | |
| 2021/0204606 | A1 * | 7/2021 | Austin | A24F 40/46 |
| 2022/0071289 | A1 * | 3/2022 | Lord | A24F 40/46 |
| 2022/0142257 | A1 * | 5/2022 | Austin | A24F 40/30 |
| 2023/0021316 | A1 * | 1/2023 | Austin | A24F 40/44 |
| 2023/0116576 | A1 * | 4/2023 | Austin | A24F 40/30 131/330 |
| 2023/0172265 | A1 * | 6/2023 | Austin | A24F 40/10 131/329 |

FOREIGN PATENT DOCUMENTS

| | | | |
|---|---|---|---|
| CN | 204 191 581 | U | 3/2015 |
| CN | 205 648 929 | U | 10/2016 |
| CN | 205 648 930 | U | 10/2016 |
| CN | 107 373 758 | A | 11/2017 |
| DE | 10 2017 123172 | A1 | 4/2019 |
| EP | 2077132 | | 8/2009 |
| EP | 2 460 424 | A1 | 6/2012 |
| EP | 2 551 214 | A1 | 1/2013 |
| EP | 2 965 641 | A1 | 1/2016 |
| EP | 3011850 | | 4/2016 |
| EP | 3 124 430 | A1 | 2/2017 |
| EP | 3 138 427 | A1 | 3/2017 |
| EP | 3155907 | | 4/2017 |
| EP | 3298914 | | 3/2018 |
| EP | 3 158 881 | B1 | 5/2018 |
| EP | 2 961 288 | B1 | 10/2018 |
| EP | 2 961 285 | B1 | 1/2019 |
| EP | 2 989 912 | B1 | 5/2019 |
| FR | 522270 | A | 7/1921 |
| GB | 2 524 856 | A | 10/2015 |
| GB | 2566766 | | 3/2019 |
| GB | 52566774 | | 3/2019 |
| WO | WO 97/42993 | A2 | 11/1997 |
| WO | WO 2006/061803 | A1 | 6/2006 |
| WO | WO 2011/126569 | A1 | 10/2011 |
| WO | WO 2013/083634 | A1 | 6/2013 |
| WO | WO2013/093469 | | 6/2013 |
| WO | WO 2014/115324 | A1 | 7/2014 |
| WO | WO 2014/132044 | A2 | 9/2014 |
| WO | WO 2014/168783 | A1 | 10/2014 |
| WO | WO 2015/123831 | A1 | 8/2015 |
| WO | WO 2015/166344 | A1 | 11/2015 |
| WO | WO 2015/197502 | A1 | 12/2015 |
| WO | WO 2016/079152 | A1 | 5/2016 |
| WO | WO 2016/103202 | A1 | 6/2016 |
| WO | WO2016/118005 | | 7/2016 |
| WO | WO 2016/118645 | A1 | 7/2016 |
| WO | WO 2016/124717 | A1 | 8/2016 |
| WO | WO 2016/144733 | A1 | 9/2016 |
| WO | WO 2016/156214 | A1 | 10/2016 |
| WO | WO2017/068101 | | 4/2017 |
| WO | WO2017/167511 | | 10/2017 |
| WO | WO 2018/046532 | A1 | 3/2018 |
| WO | WO 2018/050612 | A1 | 3/2018 |
| WO | WO 2018/050613 | A1 | 3/2018 |
| WO | WO2018/086828 | | 5/2018 |
| WO | WO 2018/099664 | A1 | 6/2018 |
| WO | WO 2018/114261 | A1 | 6/2018 |
| WO | WO 2018/130391 | A1 | 7/2018 |
| WO | WO 2018/141466 | A1 | 8/2018 |
| WO | WO 2018/206940 | A1 | 11/2018 |

OTHER PUBLICATIONS

European Patent Office acting as the International Search Authority; International Search Report and Written Opinion regarding PCT/EP2020/064320; Aug. 7, 2020; 9 pages.

European Patent Office acting as the International Search Authority; International Search Report and Written Opinion regarding PCT/EP2020/064321; Aug. 25, 2020; 10 pages.

(56) References Cited

OTHER PUBLICATIONS

European Patent Office acting as the International Search Authority; International Search Report and Written Opinion regarding PCT/EP2020/064322; Aug. 18, 2020; 11 pages.
European Patent Office acting as the International Search Authority; International Search Report and Written Opinion regarding PCT/EP2020/064323; Aug. 11, 2020; 8 pages.
European Search Report (19176368.9-1122), dated Nov. 13, 2019, 10 pgs.
European Search Report (19176370.5-1122), dated Dec. 4, 2019, 7 pgs.
European Search Report (19176380.4-1006), dated Nov. 11, 2019, 6 pgs.
European Search Report (19176386.1-1122), dated Dec. 10, 2019, 7 pgs.
European Search Report (19176388.7-1006), dated Dec. 5, 2019, 9 pgs.
European Search Report (19176391.1-1201), dated Dec. 12, 2019, 9 pgs.
European Search Report (19176392.9-1006), dated Dec. 12, 2019, 10 pgs.
European Search Report (19176394.5-1010), dated Nov. 21, 2019, 218 pgs.
European Search Report (19176398.6-1122), dated Dec. 3, 2019, 7 pgs.
European Search Report (19176400.0-1006), dated Dec. 9, 2019, 7 pgs.
European Search Report (19176406.7-1006), dated Dec. 9, 2019, 8 pgs.
European Search Report (19176408.3-1006), dated Nov. 28, 2019, 8 pgs.
European Search Report (19176412.5-1122), dated Dec. 4, 2019, 7 pgs.
European Search Report (19176416.6-1006), dated Dec. 5, 2019, 8 pgs.
European Search Report (19176420.8-1006), dated Dec. 5, 2019, 8 pgs.
European Search Report (19176422.4-1122), dated Nov. 25, 2019, 11 pgs.
European Search Report (19176430.7-1122), dated Mar. 16, 2020, 10 pgs.
European Search Report (19176433.1-1006), dated Nov. 26, 2019, 7 pgs.

* cited by examiner

AEROSOL DELIVERY DEVICE

CROSS REFERENCE TO RELATED APPLICATIONS/INCORPORATION BY REFERENCE STATEMENT

This application is a non-provisional application claiming benefit to the international application no. PCT/EP2020/064320 filed on May 22, 2020, which claims priority to EP 19176370.5 filed on May 24, 2019, EP 19176406.7 filed on May 24, 2019, EP 19176400.0 filed on May 24, 2019, EP 19176386.1 filed on May 24, 2019, EP 19176420.8 filed on May 24, 2019, EP 19176408.3 filed on May 24, 2019, EP 19176398.6 filed on May 24, 2019, and EP 19176391.1 filed on May 24, 2019. This application also claims benefit to the international application no. PCT/EP2020/064318 filed on May 22, 2020, which claims priority to EP 19176388.7 filed on May 24, 2019, EP 19176368.9 filed on May 24, 2019, and EP 19176412.5 filed on May 24, 2019. This application also claims benefit to the international application no. PCT/EP2020/064323 filed on May 22, 2020, which claims priority to EP 19176380.4 filed on May 24, 2019 and EP 19176433.1 filed on May 24, 2019. This application also claims benefit to the international application no. PCT/EP2020/064322 filed on May 22, 2020, which claims priority to EP 19176392.9 filed on May 24, 2019 and EP 19176394.5 filed on May 24, 2019. This application also claims benefit to the international application no. PCT/EP2020/064321 filed on May 22, 2020, which claims priority to EP 19176422.4 filed on May 24, 2019, EP 19176430.7 filed on May 24, 2019, and EP 19176416.6 filed on May 24, 2019. The entire contents of each of the above-referenced applications are hereby incorporated herein by reference in their entirety.

FIELD OF THE DISCLOSURE

In one aspect, the present disclosure relates to an aerosol delivery device and particularly, although not exclusively, to an aerosol delivery device having a barrier arrangement e.g., to inhibit evaporation of aerosol precursor. The present disclosure also relates to an aerosol delivery device comprising a frangible seal.

In another aspect, the present disclosure also relates to an aerosol delivery device and particularly, although not exclusively, an aerosol delivery device comprising a switching device configured to provide relative movement between an aerosol generator and an airflow passage. The present disclosure also relates to an aerosol delivery device and particularly, although not exclusively, an aerosol delivery device operable in a normal mode and a boost mode. The disclosure also relates to an aerosol delivery device and particularly, although not exclusively, to an aerosol delivery device comprising a supporting portion connecting a transfer element to a switch such that movement of the switch causes movement of the transfer element.

In another aspect, the present disclosure also relates to an aerosol delivery device and particularly, although not exclusively, to an aerosol delivery device comprising separate aerosol and vapor airflow streams.

In another aspect, the present disclosure also relates to an aerosol delivery device and particularly, although not exclusively, to an aerosol delivery device including a deformable reservoir containing aerosol precursor and/or to an aerosol delivery device including a mechanically actuable pump.

In another aspect, the present disclosure also relates to a refill device for an aerosol delivery device, and particularly to a refill device for an aerosol delivery device having a porous liquid transfer element of aerosol precursor.

BACKGROUND

A smoking-substitute device is an electronic device that permits the user to simulate the act of smoking by producing an aerosol mist or vapor that is drawn into the lungs through the mouth and then exhaled. The inhaled aerosol mist or vapor typically bears nicotine and/or other flavorings without the odor and health risks associated with traditional smoking and tobacco products. In use, the user experiences a similar satisfaction and physical sensation to those experienced from a traditional smoking or tobacco product, and exhales an aerosol mist or vapor of similar appearance to the smoke exhaled when using such traditional smoking or tobacco products. One approach for a smoking substitute device is the so-called "vaping" approach, in which a vaporizable liquid, typically referred to (and referred to herein) as "e-liquid", is heated by a heating device to produce an aerosol vapor which is inhaled by a user. The e-liquid typically includes a base liquid as well as nicotine and/or flavorings. The resulting vapor therefore also typically contains nicotine and/or flavorings. The base liquid may include propylene glycol and/or vegetable glycerin.

A typical vaping smoking substitute device includes a mouthpiece, a power source (typically a battery), a tank for containing e-liquid, as well as a heating device. In use, electrical energy is supplied from the power source to the heating device, which heats the e-liquid to produce an aerosol (or "vapor") which is inhaled by a user through the mouthpiece.

Vaping smoking substitute devices can be configured in a variety of ways. For example, there are "closed system" vaping smoking substitute devices, which typically have a sealed tank and heating element. The tank is pre-filled with e liquid and is not intended to be refilled by an end user. One subset of closed system vaping smoking substitute devices include a main body which includes the power source, wherein the main body is configured to be physically and electrically coupled to a consumable including the tank and the heating element. The consumable may also be referred to as a cartomizer. In this way, when the tank of a consumable has been emptied, that consumable is disposed of. The main body can be reused by connecting it to a new, replacement, consumable. Another subset of closed system vaping smoking substitute devices are completely disposable, and intended for one-use only.

There are also "open system" vaping smoking substitute devices which typically have a tank that is configured to be refilled by a user. In this way the device can be used multiple times.

An example vaping smoking substitute device is the Myblu™ e-cigarette. The Myblu™ e cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick. The wick is partially immersed in the e-liquid, and conveys e-liquid from the tank to the heating filament. The device is activated when a microprocessor on board the main body detects a user inhaling through the mouthpiece. When the device is activated, electrical energy is supplied from the power source to the heating device, which heats e-liquid from the tank to produce a vapor which is inhaled by a user through the mouthpiece.

For a smoking substitute device, it is desirable to deliver nicotine into the user's lungs, where it can be absorbed into the bloodstream. As explained above, in the so-called "vaping" approach, "e-liquid" is heated by a heating device to produce an aerosol vapor which is inhaled by a user. Many e-cigarettes also deliver flavor to the user, to enhance the experience. Flavor compounds are contained in the e-liquid that is heated. Heating of the flavor compounds may be undesirable as the flavor compounds are inhaled into the user's lungs. Toxicology restrictions are placed on the amount of flavor that can be contained in the e-liquid. This can result in some e-liquid flavors delivering a weak and underwhelming taste sensation to consumers in the pursuit of safety.

In aerosol delivery devices with passive aerosol generation, it is desirable to prevent evaporation of aerosol precursor when the device is not being used.

In aerosol delivery devices, it is desirable to prolong the storage time of such devices without impacting on the quantity or quality of the product.

In aerosol delivery devices, it is also desirable to avoid large liquid droplets reaching a user's mouth. The present disclosure has been devised in light of the above considerations.

In aerosol delivery devices, it is also desirable to prolong the storage time of such devices without impacting on the quantity or quality of the product.

In aerosol delivery devices, it is also desirable to ensure that (e.g., flavor) aerosol can be provided consistently over the lifetime of the consumable, and that the risk of leakage is minimized.

The present disclosure has been devised in light of the above considerations.

SUMMARY

First Mode: An Aerosol Delivery Device in which a Barrier Arrangement Inhibits Evaporation of Aerosol Precursor Generally, a first mode of this application relates to an aerosol delivery device in which a barrier arrangement inhibits evaporation of aerosol precursor when the barrier arrangement in closed, and the barrier arrangement is openable to permit generation of aerosol.

In a first aspect of the first mode, there is provided aerosol delivery device comprising: a storage for storing an aerosol precursor; an aerosol generator comprising an aerosol generator portion configured to receive the aerosol precursor from the storage; an air flow passage configured to direct air past the aerosol generator portion to pick up the aerosol precursor from the aerosol generator portion to form an aerosol; and a barrier arrangement for inhibiting evaporation of aerosol precursor when the barrier arrangement is closed, the barrier arrangement being openable to permit generation of aerosol. Such an aerosol delivery device is less prone to leakage during transit. Further, evaporation of the aerosol precursor can be prevented when the device is not in use.

Optionally, the barrier arrangement may be configured to open in response to a user inhaling on the aerosol delivery device.

Advantageously, the barrier arrangement may be selectively openable by a user.

Conveniently, the barrier arrangement may further comprise a mouthpiece and a body, wherein the barrier arrangement is configured to open in response to sliding of the mouthpiece relative to the body.

Optionally, the barrier arrangement may comprise a barrier element between the aerosol generator portion and a mouthpiece aperture of the aerosol delivery device to inhibit evaporation of aerosol precursor.

Advantageously, the barrier element may comprise a non-return valve.

Conveniently, the barrier element may comprise a movable shield.

Optionally, the barrier arrangement may be configured to inhibit flow of aerosol precursor between the storage and the aerosol generator portion to inhibit evaporation of aerosol precursor.

Advantageously, the aerosol delivery device may further comprise a transfer element, wherein the transfer element is movable with respect to the barrier arrangement to open the barrier arrangement so that the transfer element can transfer aerosol precursor from the storage to the aerosol generator portion.

Conveniently, the aerosol delivery device may further comprise a member, the member comprising the transfer element and the aerosol generator portion, wherein the member is movable from a first position to a second position to open the barrier arrangement.

Optionally, the aerosol delivery device may further comprise a supporting portion for maintaining a position of the member with respect to the mouthpiece during sliding of the mouthpiece.

Advantageously, the aerosol delivery device may further comprise: a pressure relief opening in the storage; and a blocking arrangement for inhibiting flow through the pressure relief opening, wherein the blocking arrangement is openable to permit air to flow through the pressure relief opening and into the storage as the storage empties of aerosol precursor.

In a second aspect of the first mode, there is provided an aerosol delivery device comprising: a storage for storing an aerosol precursor; a transfer element; and a barrier arrangement for inhibiting flow of aerosol precursor from the storage to the transfer element when the barrier arrangement is in a closed position, wherein the barrier arrangement is selectively actuatable between the closed position and an open position, and when the barrier arrangement is in the open position the transfer element can transfer aerosol precursor from the storage.

Such an aerosol delivery device can be used to selectively provide aerosol to the user.

The barrier arrangement may be referred to as a charging or filling mechanism, operable to charge, recharge, fill, or refill the transfer element with aerosol precursor. The transfer element may be for transferring aerosol precursor to an aerosol generator of the aerosol delivery device.

Optionally, the transfer element may be selectively exposable to the storage to selectively open and close the barrier arrangement.

Advantageously, the transfer element may be movable with respect to the barrier arrangement to selectively expose the transfer element to the storage. Conveniently, the barrier arrangement may comprise a barrier element configured to move with the transfer element, the barrier element configured to inhibit flow of aerosol precursor from the storage to the transfer element when the barrier arrangement is in the closed position.

Optionally, the barrier arrangement may further comprise a tube, the transfer element received in the tube and the barrier element configured to block the tube when the barrier arrangement is in the closed position.

Advantageously, the barrier element may be fixed to an end portion of the transfer element, and the barrier element may be configured to be out of the tube such that a side portion of the transfer element is exposed to the storage when the barrier arrangement is in the open position.

Conveniently, the aerosol delivery device may further comprise an aerosol generator configured to receive aerosol precursor from the storage and form an aerosol from the aerosol precursor.

Optionally, the aerosol generator may comprise an aerosol generator portion configured to receive the aerosol precursor from the storage, and the aerosol delivery device comprises an air flow passage configured to direct air past the aerosol generator portion to pick up the aerosol precursor from the aerosol generator portion to form an aerosol. Advantageously, the aerosol delivery device may further comprise a member, the member comprising the transfer element and the aerosol generator portion.

Conveniently, the member may be movable with respect to the barrier arrangement to selectively expose the transfer element to the storage.

Optionally, the aerosol delivery device may further comprise a mouthpiece and a body, wherein the barrier arrangement is configured to open in response to sliding of the mouthpiece relative to the body.

Advantageously, the transfer element may be porous.

In a third aspect of the first mode, there is provided an aerosol delivery device comprising: a storage for storing an aerosol precursor; an additional storage; and a barrier arrangement for inhibiting flow of aerosol precursor from the storage to the additional storage, the barrier arrangement openable to permit flow of aerosol precursor from the storage to the additional storage.

Such an aerosol delivery device is less prone to leakage during transit.

Optionally, the aerosol delivery device may comprise an aerosol generator configured to receive aerosol precursor from the additional storage and form an aerosol from the aerosol precursor.

Advantageously, the aerosol generator may comprise an aerosol generator portion configured to receive the aerosol precursor from the additional storage, and the aerosol delivery device may comprise an air flow passage configured to direct air past the aerosol generator portion to pick up the aerosol precursor from the aerosol generator portion to form an aerosol.

Conveniently, the aerosol delivery device may comprise a transfer element for transferring aerosol precursor from the additional storage to the aerosol generator portion. The transfer element may be at least partially contained within the additional storage. The additional storage is, in some examples, a container into which aerosol precursor can freely flow once the barrier mechanism is opened.

Optionally, the aerosol delivery device may comprise a member, the member comprising the transfer element and the aerosol generator portion.

Advantageously, the transfer element may be porous.

Conveniently, the barrier arrangement may comprise a barrier component between the storage and the additional storage, and the transfer element is movable to pierce the barrier component to open the barrier arrangement.

Optionally, the barrier component may be a foil membrane.

Advantageously, the aerosol delivery device may comprise a mouthpiece and a body, wherein the barrier arrangement is configured to open in response to sliding of the mouthpiece relative to the body.

Conveniently, the aerosol delivery device may comprise a supporting portion for maintaining a position of the transfer element with respect to the mouthpiece during sliding of the mouthpiece.

Optionally, the storage may comprise a free liquid tank and the additional storage comprises a porous reservoir. Advantageously, the additional storage may be located closer to a mouthpiece opening than the storage.

In a fourth aspect of the first mode, there is provided aerosol delivery device comprising: a storage for storing an aerosol precursor; a transfer element; and a barrier arrangement comprising a plug, the plug configured to inhibit flow of aerosol precursor from the storage to the transfer element when the plug is in a closed position, wherein the plug is displaceable to open the barrier arrangement so that the transfer element can transfer aerosol precursor from the storage.

Such an aerosol delivery device is less prone to leakage during transit. The transfer element may be for transferring aerosol precursor from the storage to an aerosol generator of the aerosol delivery device.

Optionally, the transfer element may be movable to displace the plug to open the transfer element.

Advantageously, the aerosol delivery device may comprise a tube, wherein the transfer element and the plug are received in the tube, and the plug is displaceable from the tube to open the barrier arrangement.

Conveniently, the aerosol delivery device may comprise an aerosol generator comprising an aerosol generator portion configured to receive the aerosol precursor from the transfer element; and an air flow passage configured to direct air past the aerosol generator portion to pick up the aerosol precursor from the aerosol generator portion to form an aerosol.

Optionally, the aerosol delivery device may comprise a member, the member comprising the transfer element and the aerosol generator portion, wherein the member is movable from a first position to a second position to open the barrier arrangement.

Advantageously, the aerosol delivery device may comprise a guide for inhibiting return of the plug to the closed position after displacement of the plug.

Conveniently, the guide may comprise a recess for receiving the plug. Optionally, the plug may be formed of silicone.

Advantageously, the aerosol delivery device may comprise a mouthpiece and a body, wherein the barrier arrangement is configured to open in response to sliding of the mouthpiece relative to the body. Conveniently, the aerosol delivery device may comprise a supporting portion for maintaining a position of the member with respect to the mouthpiece during sliding of the mouthpiece.

Optionally, the aerosol delivery device may comprise a pressure relief opening in the storage; and a blocking arrangement for inhibiting flow through the pressure relief opening, wherein the blocking arrangement is openable to permit air to flow through the pressure relief opening and into the storage as the storage empties of aerosol precursor.

Advantageously, the transfer element may be porous.

In a fifth aspect of the first mode, there is provided an aerosol delivery device comprising: a storage for storing an aerosol precursor; a transfer element; and a barrier arrangement for inhibiting flow of aerosol precursor from the storage to the transfer element, wherein the storage is movable with respect to the barrier arrangement to open the barrier arrangement so that the transfer element can transfer aerosol precursor from the storage.

Such an aerosol delivery device is less prone to leakage during transit. The transfer element may be for transferring aerosol precursor from the storage to an aerosol generator of the aerosol delivery device.

The storage maybe movable relative to a mouthpiece of the aerosol delivery device, and this movement may cause the barrier arrangement to be opened. The barrier arrangement may be fixed relative to the mouthpiece until the barrier arrangement is opened.

Optionally, the storage may be movable relative to the transfer element to open the barrier arrangement.

Advantageously, the barrier arrangement may comprise a plug received in a tube, the plug configured to inhibit flow of aerosol precursor from the storage to the transfer element, wherein the tube is configured to move with the storage, and the plug is displaceable from the tube on movement of the storage so that the transfer element can transfer aerosol precursor from the storage.

Conveniently, movement of the storage may cause the transfer element to contact the plug to displace the plug from the tube. For example, the plug may be freely placed in the tube (or held only by a relatively light interference fit). Thus, when the tube is moved relative to the transfer element, the plug will no longer be retained within the tube.

Optionally, the barrier arrangement may comprise a deformable barrier component, the barrier component configured to deform to open the barrier arrangement on movement of the storage.

Advantageously, movement of the storage may cause the transfer element to pierce the barrier component to open the barrier arrangement. Conveniently, the aerosol delivery device may comprise a slidable switch for moving the storage.

Optionally, the aerosol delivery device may comprise a pressure relief opening in the storage; and a blocking arrangement for inhibiting flow through the pressure relief opening, wherein the blocking arrangement is openable to permit air to flow through the pressure relief opening and into the storage as the storage empties of aerosol precursor. Advantageously, the moving the switch may cause the blocking arrangement to open.

Conveniently, the connector may provide the blocking arrangement, and the aerosol delivery device further comprises a stop, the stop configured to inhibit movement of the storage after the barrier arrangement is open, such that further movement of the switch causes the connector to disconnect from the storage to open the blocking arrangement. Optionally, the aerosol delivery device may further comprise an aerosol generator comprising an aerosol generator portion configured to receive the aerosol precursor from the transfer element; and an air flow passage configured to direct air past the aerosol generator portion to pick up the aerosol precursor from the aerosol generator portion to form an aerosol.

Advantageously, the aerosol delivery device may further comprise a member, the member comprising the transfer element and the aerosol generator portion, wherein the member is movable from a first position to a second position to open the barrier arrangement.

Conveniently, the aerosol delivery device may further comprise a mouthpiece and a supporting portion for maintaining a position of the member with respect to the mouthpiece during movement of the storage.

In a sixth aspect of the first mode, there is provided aerosol delivery device comprising: a storage for storing an aerosol precursor; a pressure relief opening in the storage; and a blocking arrangement for inhibiting flow through the pressure relief opening, wherein the blocking arrangement is openable to permit air to flow through the pressure relief opening and into the storage as the storage empties of aerosol precursor.

Optionally, the aerosol delivery device may comprise a mouthpiece and a body, the mouthpiece movable relative to the body to open the blocking arrangement.

Advantageously, twisting of the mouthpiece relative to the body may cause opening of the blocking arrangement.

Conveniently, sliding of the mouthpiece relative to body may cause opening of the blocking arrangement.

Optionally, the blocking arrangement may comprise a blocking component for inhibiting flow through the pressure relief opening, the blocking component defining an aperture, the aperture alignable with the pressure relief opening to open the blocking arrangement.

Advantageously, the blocking arrangement may comprise a blocking component for inhibiting flowthrough the pressure relief opening and a piercing component movable relative to the blocking component, wherein the blocking component is pierceable by the piercing component to open the blocking arrangement. Conveniently, the aerosol delivery device may comprise a transfer element; and a barrier arrangement for inhibiting flow of aerosol precursor from the storage to the transfer element, the barrier arrangement openable to permit flow of aerosol precursor from the storage to the transfer element.

Optionally, the aerosol delivery device may comprise an aerosol generator comprising an aerosol generator portion configured to receive the aerosol precursor from the transfer element; and an air flow passage configured to direct air past the aerosol generator portion to pick up the aerosol precursor from the aerosol generator portion to form an aerosol.

Advantageously, the aerosol delivery device may comprise a member, the member comprising the transfer element and the aerosol generator portion, wherein the member is movable from a first position to a second position to open the barrier arrangement. Conveniently, the aerosol delivery device may comprise a supporting portion for maintaining a position of the member with respect to the mouthpiece during sliding of the mouthpiece.

Optionally, opening of the barrier arrangement may cause open of the blocking arrangement.

Advantageously, the member may be slidable from the first position to the second position to open the barrier arrangement.

In a seventh aspect of the first mode, there is provided aerosol delivery device comprising: a storage for storing an aerosol precursor; a transfer element; and a barrier arrangement for inhibiting flow of aerosol precursor from the storage to the transfer element, wherein the transfer element is movable with respect to the barrier arrangement to open the barrier arrangement so that the transfer element can transfer aerosol precursor from the storage. Optionally, the aerosol delivery device may further comprise an aerosol generator comprising an aerosol generator portion configured to receive the aerosol precursor from the transfer element; and an air flow passage configured to direct air past the aerosol generator portion to pick up the aerosol precursor from the aerosol generator portion to form an aerosol. The transfer element may be configured to transfer aerosol precursor from the storage to the aerosol generator once the barrier arrangement is open. Advantageously, the aerosol generator portion may further comprise a member, the member comprising the transfer element and the aerosol generator portion, wherein the member is movable from a first position to a second position to open the barrier arrangement.

Conveniently, the member may be slidable from the first position to the second position to open the barrier arrangement. Optionally, the aerosol delivery device may further comprise a mouthpiece and a body, wherein the barrier arrangement is configured to open in response to sliding of the mouthpiece relative to the body.

Advantageously, the aerosol delivery device may further comprise a supporting portion for maintaining a position of the member with respect to the mouthpiece during sliding of the mouthpiece.

Conveniently, the barrier arrangement may be configured to remain permanently open after opening.

Optionally, the barrier arrangement may comprise a plug received in a tube, the plug configured to inhibit flow of aerosol precursor from the storage to the transfer element, wherein the plug is displaceable from the tube on movement of the transfer element so that the transfer element can transfer aerosol precursor from the storage.

Advantageously, the aerosol delivery device may further comprise a guide for inhibiting return of the plug to the tube after the plug is displaced from the tube. Conveniently, the barrier arrangement may comprise a deformable barrier component, and the transfer element is configured to deform the barrier component to open the barrier arrangement.

Optionally, the aerosol delivery device may further comprise a pressure relief opening in the storage; and a blocking arrangement for inhibiting flow through the pressure relief opening, wherein the blocking arrangement is openable to permit air to flow through the pressure relief opening and into the storage as the storage empties of aerosol precursor.

Advantageously, the transfer element may be porous.

The present disclosure also relates to an aerosol delivery device comprising a frangible seal between a reservoir and an aerosol generator.

In an eighth aspect of the first mode, there is provided aerosol delivery device comprising: a reservoir containing an aerosol precursor; an aerosol generator, operable to aerosolize the aerosol precursor and provide it to a user; and a frangible seal, which is located between the reservoir and the aerosol generator, and which, when unbroken, fluidly seals the aerosol generator from the reservoir and which, when broken, allows the aerosol precursor to fluidly contact the aerosol generator. Such an aerosol delivery device may be stored for a longer period of time without degradation of the aerosol precursor. Further, such an aerosol delivery device is less prone to leakage during transportation.

Optionally, the device may further comprise an aerosol generator portion configured to receive the aerosol precursor, when the frangible seal is broken, and an airflow passage, configured to direct air past the aerosol generator portion to pick up the aerosol precursor from the aerosol generator portion to form an aerosol.

Advantageously, the aerosol generator portion may include a Venturi aperture and a porous member located within the Venturi aperture and fluidly connectable to the reservoir.

Conveniently, the device may further comprise a housing of the reservoir which is configured to deform and break the frangible seal. Optionally, the device may further comprise an outer housing, adjacent to the housing of the reservoir and configured to deform upon application of a force and impact the housing of the reservoir.

Advantageously, the frangible seal may be a cylindrical glass seal encapsulating a region of the aerosol generator. Conveniently, the aerosol generator may comprise a nib and a shaft, and the shaft may be disposed within the cylindrical glass seal.

Conveniently, the frangible seal may be configured to break when a force of greater than 10 kgf is applied.

Optionally, the device may further comprise a button which, when pressed, breaks the frangible seal.

Advantageously, the device may further comprise a vapor generator, for vaporizing a vapor precursor, and the aerosol generator by the aerosol generator may be mixed with the vapor downstream of the vapor generator.

Conveniently, the aerosol precursor may be a flavor aerosol precursor and may be substantially nicotine free.

Optionally, the aerosol generator may be made of a material having a different colour to the aerosol precursor.

Advantageously, the aerosol delivery device may have a longitudinal axis, and the frangible seal may be configured to break upon application of a force transversal to the longitudinal axis.

Conveniently, the aerosol delivery device is a consumable for a smoking substitute device.

Optionally, the device further comprises an additional aerosol generator, the additional aerosol generator being configured to heat an additional aerosol precursor to produce an additional aerosol.

In a ninth aspect of the first mode, there is provided a smoking substitute device including the aerosol delivery device according to the eighth aspect of the first mode.

In a tenth aspect of the first mode, there is provided a method of activating the aerosol delivery device of the eighth aspect of the first mode, comprising the step of applying a force to the frangible seal to break it. The method may further comprise a step, performed before or after the step of applying the force, of moving the aerosol generator relative to the reservoir. The step of moving the aerosol generator relative to the reservoir may cause a piercing member to open a pressure relief opening in the reservoir.

In any of the aspects of the first mode described above, the aerosol delivery device may be a consumable for a vaping device. In any of the aspects of the first mode described above, the aerosol delivery device may further comprise an additional aerosol generator, the additional aerosol generator configured to produce an additional aerosol from an additional aerosol precursor.

In any of the aspects of the first mode described above, the additional aerosol generator may be configured to heat the additional aerosol precursor to form the additional aerosol.

The disclosure includes the combination of the aspects and preferred features of the first mode described except where such a combination is clearly impermissible or expressly avoided.

Second Mode: An Aerosol Delivery Device Comprising a Switching Device

At its most general, a second mode of the present disclosure relates to an aerosol delivery device comprising a switching device configured to provide relative movement between an aerosol generator and an airflow passage to vary a mass of first aerosol precursor per delivery event.

In a first aspect of the second mode, there is provided an aerosol delivery device comprising an aerosol generator and a switching device, the aerosol generator comprising: an aerosol generator portion configured to receive an aerosol precursor; and an air flow passage configured to direct air past the aerosol generator portion to pick up the aerosol precursor from the aerosol generator portion to form an aerosol during a delivery event, wherein the switching device is configured to provide relative movement between the aerosol generator portion and the airflow passage to vary a mass of aerosol precursor per delivery event.

Optionally, the switching device may be configured to provide the relative movement to vary a surface area of the aerosol generator portion located in an aerosol generation region of the airflow passage and thereby vary the mass of aerosol precursor per delivery event.

Advantageously, the switching device may be configured to provide the relative movement to vary a velocity of airflow past the aerosol generator portion and thereby vary the mass of aerosol precursor per delivery event.

Conveniently, the switching device may be configured to slide the aerosol generator portion to provide the relative movement.

Optionally, the aerosol delivery device may comprise a storage for storing the aerosol precursor.

Conveniently, the switching device may be further configured to slide the storage with the aerosol generator portion.

Advantageously, the switching device may be configured to provide a relative bias between the aerosol generator and the airflow passage towards a position in which the mass of aerosol precursor per delivery event is reduced.

Conveniently, the switching device may permit switching between a normal mode and a boost mode, wherein the aerosol generator is configured to: in the normal mode, produce aerosol comprising a first mass of aerosol precursor per delivery event; and in the boost mode, produce aerosol comprising a second mass of aerosol precursor per delivery event, wherein the second mass is greater than the first mass.

Optionally, the switching device may permit switching into an off mode, wherein in the off mode, the aerosol delivery device is configured not to produce aerosol during the delivery event.

Conveniently, the switching device may be configured to bias the aerosol generator from the boost mode towards the normal mode.

Advantageously, the switching device may permit continuous variation in mass of aerosol precursor per delivery event.

Conveniently, the aerosol generator may comprise a member, the member comprising the aerosol generator portion, wherein the member is configured to transfer the aerosol precursor to the aerosol generator portion.

Optionally, the aerosol may comprise a flavor component.

Advantageously, the aerosol may be sized to inhibit pulmonary penetration, and the aerosol is transmissible within at least one of a mammalian oral cavity and a mammalian nasal cavity.

Conveniently, the aerosol delivery device may be a consumable for a smoking substitute device.

Advantageously, the storage may comprise a reservoir, the reservoir formed of a first porous material.

Optionally, the storage may comprise a tank configured to store the first aerosol precursor as a free liquid. Advantageously, the aerosol delivery device may be a consumable for a smoking substitute device.

Conveniently, the aerosol delivery device may comprise an additional aerosol generator, the additional aerosol generator configured to produce an additional aerosol from an additional aerosol precursor during the delivery event.

Optionally, the additional aerosol generator may be configured to produce the additional aerosol comprising substantially the same mass of additional aerosol precursor per delivery event independently of the mass of aerosol precursor per delivery event.

Advantageously, the additional aerosol generator may be configured to heat the additional aerosol precursor to form the additional aerosol.

Conveniently, the second aerosol precursor may comprise an active component.

Optionally, the active component may be nicotine.

Advantageously, the additional aerosol may be sized for pulmonary penetration.

The present disclosure also relates to an aerosol delivery device which is switchable between: a normal mode in which an aerosol comprising a first mass of aerosol precursor is produced; and a boost mode in which an aerosol comprising a second mass of aerosol precursor is produced, wherein the second mass is greater than the first mass.

In a second aspect of the second mode, there is provided an aerosol delivery device comprising: an aerosol generator configured to produce an aerosol from an aerosol precursor during a delivery event, wherein the aerosol comprises a flavor component; and a switching device permitting switching of the aerosol generator between a normal mode and a boost mode, wherein the aerosol generator is configured to: in the normal mode, produce aerosol comprising a first mass of aerosol precursor per delivery event; and in the boost mode, produce aerosol comprising a second mass of aerosol precursor per delivery event, wherein the second mass is greater than the first mass.

Optionally, the switching device may further permit switching of the aerosol generator into an off mode, wherein in the off mode, the aerosol generator is configured not to produce aerosol during the delivery event.

Advantageously, the switching device may permit continuous variation in mass of aerosol precursor per delivery event between the normal mode and the boost mode.

Conveniently, the switching device may be configured to bias the aerosol generator from the boost mode towards the normal mode. Optionally, the switching device may comprise a sliding switching mechanism slidable to switch the aerosol generator between the normal mode and the boost mode.

Advantageously, the aerosol generator may comprise: an aerosol generator portion configured to receive the aerosol precursor; and an air flow passage configured to direct air past the aerosol generator portion to pick up the aerosol precursor from the aerosol generator portion to form the aerosol, wherein the switching device is configured to provide relative movement between the aerosol generator portion and the airflow passage to switch the aerosol generator between the normal mode and the boost mode.

Conveniently, the switching device may be configured to provide the relative movement to vary a surface area of the aerosol generator portion located in an aerosol generation region of the airflow passage to switch the aerosol generator between the normal mode and the boost mode.

Optionally, the switching device may be configured to provide the relative movement to vary a velocity of airflow past the aerosol generator portion to switch the aerosol generator between the normal mode and the boost mode.

Advantageously, the switching device may be configured to slide the aerosol generator portion to switch the aerosol generator between the normal mode and the boost mode.

Optionally, the aerosol delivery device may comprise a storage for storing the aerosol precursor.

Conveniently, the switching device may be further configured to slide the storage with the aerosol generator portion.

Advantageously, the switching device may be configured to provide a relative bias between the aerosol generator and the airflow passage towards the normal mode.

Optionally, the aerosol generator may comprise a member, the member comprising the aerosol generator portion, wherein the member is configured to transfer the aerosol precursor to the aerosol generator portion.

Optionally, the aerosol may comprise a flavor component.

Advantageously, the aerosol may be sized to inhibit pulmonary penetration, and the aerosol is transmissible within at least one of a mammalian oral cavity and a mammalian nasal cavity.

Conveniently, the aerosol delivery device may be a consumable for a smoking substitute device. Advantageously, the storage may comprise a reservoir, the reservoir formed of a first porous material. Optionally, the storage may comprise a tank configured to store the aerosol precursor as a free liquid. Advantageously, the aerosol delivery device may be a consumable for a smoking substitute device.

Conveniently, the aerosol delivery device may comprise an additional aerosol generator, the additional aerosol generator configured to produce an additional aerosol from an additional aerosol precursor during the delivery event.

Optionally, the additional aerosol generator may be configured to produce the additional aerosol comprising substantially the same mass of additional aerosol precursor per delivery event independently of the mass of aerosol precursor per delivery event.

Advantageously, the additional aerosol generator may be configured to heat the additional aerosol precursor to form the additional aerosol.

Conveniently, the second aerosol precursor may comprise an active component.

Optionally, the active component may be nicotine.

Advantageously, the additional aerosol may be sized for pulmonary penetration.

The present disclosure also relates to an aerosol delivery device comprising a supporting portion connecting a transfer element to a switch such that movement of the switch causes movement of the transfer element.

In a third aspect of the second mode, there is provided aerosol delivery device comprising: a storage for storing an aerosol precursor; a transfer element for transferring aerosol precursor from the storage; a switch; and a supporting portion connecting the transfer element to the switch such that movement of the switch causes movement of the transfer element. Such an aerosol delivery device can be used to easily transition from a deactivated to activated state whilst not hindering the flow of air through the aerosol delivery device. Further, by initially providing the aerosol delivery device in a deactivated state the risk of leakage can be minimized. The transfer element may be for transferring aerosol precursor from the storage to an aerosol generator. The switch may be referred to as an activation mechanism. The supporting portion may have the shape of an incomplete ring or collar, the transfer element being provided within the incomplete ring/collar and held therein through a friction fit. The supporting portion e.g., the ring/collar may be integrally formed with a mouthpiece of the aerosol delivery device.

Optionally, the aerosol delivery device may comprise a barrier arrangement for inhibiting flow of aerosol precursor from the storage, wherein the transfer element is movable with respect to the barrier arrangement to open the barrier arrangement so that the transfer element can transfer aerosol precursor from the storage on movement of the switch.

Advantageously, the aerosol delivery device may comprise an aerosol generator comprising an aerosol generator portion configured to receive the aerosol precursor from the transfer element; and an air flow passage configured to direct air past the aerosol generator portion to pick up the aerosol precursor from the aerosol generator portion to form an aerosol.

Conveniently, the aerosol delivery device may comprise a member, the member comprising the transfer element and the aerosol generator portion, wherein the member is movable from a first position to a second position to open the barrier arrangement.

Optionally, the member may be slidable from the first position to the second position to open the barrier arrangement.

Advantageously, the aerosol delivery device may comprise a mouthpiece and a body, wherein the mouthpiece is slidable relative to the body to provide the switch.

Conveniently, the barrier arrangement may be configured to open in response to sliding of the mouthpiece relative to the body. Optionally, the barrier arrangement may be configured to remain permanently open after opening.

Advantageously, the barrier arrangement may comprise a plug received in a tube, the plug configured to inhibit flow of aerosol precursor from the storage to the transfer element, wherein the plug is displaceable from the tube on movement of the transfer element so that the transfer element can transfer aerosol precursor from the storage. Conveniently, the aerosol delivery device may comprise a guide for inhibiting return of the plug to the tube after the plug is displaced from the tube.

Optionally, the barrier arrangement may comprise a deformable barrier component, and the transfer element is configured to deform the barrier component to open the barrier arrangement.

Advantageously, the aerosol delivery device may comprise a pressure relief opening in the storage; and a blocking arrangement for inhibiting flow through the pressure relief opening, wherein the blocking arrangement is openable to permit air to flow through the pressure relief opening and into the storage as the storage empties of aerosol precursor.

Conveniently, the aerosol delivery device may be a consumable for a vaping device.

Optionally, the aerosol delivery device may comprise an additional aerosol generator, the additional aerosol generator configured to produce an additional aerosol from an additional aerosol precursor.

The disclosure includes the combination of the aspects and preferred features of the second mode described except where such a combination is clearly impermissible or expressly avoided.

Third Mode: An Aerosol Delivery Device Comprising an Aerosol Airflow Stream and a Separate Airflow Stream At its most general, a third mode of the present disclosure relates to an aerosol delivery device comprising an aerosol airflow stream and a separate airflow stream which at least partially bypasses the aerosol airflow stream.

In a first aspect of the third mode, there is provided aerosol delivery device comprising: a passive aerosol generator, located within a first airflow path, and configured to aerosolize an aerosol precursor; a second airflow path; wherein the second airflow path at least partially bypasses the aerosol generator; and wherein the first airflow path is configured to direct air around or through the passive aerosol generator to form an aerosol, the aerosol being provided to the first airflow path.

Such an aerosol delivery device ensures that the draw resistance of the vapor generator as compared to the aerosol generator can be separately controlled.

By at least partially bypass, it may be meant that the second airflow path impinges the aerosol generator downstream of an inlet to the aerosol generator forming a part of the first airflow path. By passive, it may be meant that the aerosol generator functions without the provision of electrical power e.g., without a heater or active aerosolization mechanism. The second airflow path may extend from an air inlet of the aerosol delivery device to an outlet of the aerosol delivery device. The second airflow path may be contained entirely, or at least partially, within a housing of the aerosol delivery device. The passive aerosol generator may include a porous member, and the first airflow path may be configured to direct air around the porous member to pick up the aerosol precursor from the porous member to form an aerosol.

The first airflow path and the second airflow path may be formed from the bifurcation of a main airflow path, the main airflow path extending from an air inlet of the aerosol delivery device to the point of bifurcation. The main airflow path may include a vapor generator, and may be located upstream of the passive aerosol generator. Alternatively, the first airflow path may be entirely separate to the main airflow path and/or the second airflow path. The main airflow path may be the second airflow path.

Optionally, the first airflow path and the second airflow path may converge at a point downstream of the aerosol generator. Advantageously, the first airflow path and the second airflow path may converge in a mouthpiece of the aerosol delivery device.

Conveniently, the aerosol delivery device may include a mouthpiece, and a portion of the aerosol generator may be provided within the mouthpiece.

Optionally, the mouthpiece may include one or more air outlet holes, which form a portion of the second airflow path.

Advantageously, the mouthpiece may include a central aperture, within which a portion of the aerosol generator is disposed.

Conveniently, the passive aerosol generator may include a Venturi aperture, and a porous member may be located within the Venturi aperture and fluidly connected to a reservoir of aerosol precursor. Optionally, the aerosol generator may be located within a cylindrical tube, a porous member of the aerosol generator may extend coaxially through a first end of the tube into a mouthpiece of the aerosol delivery device, said first end having a radius greater than a radius of the porous member, and the porous member extending through a second end of the tube into a reservoir of aerosol precursor, said second end being dimensioned such that the aerosol generator is retained therein through an interference fit. Advantageously, the aerosol precursor may be a flavor precursor and may be substantially nicotine free.

Optionally, the aerosol delivery device may include a vapor generator, configured to vaporize a vapor precursor and provide the vapor to the second airflow path or the main airflow path. In such an example, by at least partially bypassing the aerosol generator, the degree to which the vapor effects the generated aerosol can be reduced. For example, when the vapor contains nicotine, the bypass can ensure that the nicotine does not leach into the aerosol generator.

Conveniently the vapor precursor contains nicotine.

Optionally, the vapor generator may include a coil and wick assembly, and the vapor generator may be configured to heat vapor precursor contained within the wick by passing an electrical current through the coil.

Advantageously, the vapor generator may be a heated vapor generator. The aerosol generator may be a passive (i.e., non-heated) aerosol generator.

Conveniently, the second airflow path may completely bypass the aerosol generator. Optionally, the aerosol delivery device may be a consumable for a smoking substitute device. The aerosol delivery device includes the combination of the features described except where such a combination is clearly impermissible or expressly avoided.

In a second aspect of the third mode, there is provided an aerosol delivery device comprising: a passive aerosol generator, configured to generate an aerosol from an aerosol precursor; a vapor generator, configured to generate a vapor from a vapor precursor; a first airflow path, which extends from a first inlet of the aerosol delivery device through the vapor generator and the passive generator to an outlet of the aerosol delivery device; and a second airflow path, which extends from a second inlet of the aerosol delivery device through the passive aerosol generator to the outlet.

Such an aerosol delivery device can ensure that airflow with appropriate properties (e.g., flow rate) are provided to both the vapor generator and the passive aerosol generator.

The aerosol delivery device may be configured such that a total airflow through the aerosol delivery device from both the first inlet and the second inlet is split such that at least 40%, or at least 42%, or at least 44%, or at least 46%, or at least 48% of the airflow passes along the first airflow path.

The aerosol delivery device may be configured such that a total airflow through the aerosol delivery device from both the first inlet and the second inlet is split such that 50% of the airflow passes along the first airflow path and 50% of the airflow passes along the second airflow path.

The first airflow path may extend from the first inlet, through the vapor generator, and up a chimney or airflow passage which connects the vapor generator to the aerosol generator. The second airflow passage may extend between an inner surface of a housing for the passive aerosol generator and an outer surface of a housing for the vapor generator. The second airflow passage may then extend around a reservoir of aerosol precursor, between the inner surface of the housing for the passive aerosol generator and an outer surface of the reservoir of aerosol precursor.

The vapor generator may be configured to actuate only when a threshold airflow rate is achieved. The aerosol delivery device may be configured such that the total airflow through the aerosol delivery device is split such that the airflow rate through the vapor generator exceeds the threshold airflow rate. The vapor generator may be triggered by a pressure transducer or puff sensor. The aerosol delivery device may be configured such that a total airflow rate of at least 2.5 liters per minute is achieved through the passive aerosol generator, with at least 1.25 liters per minute passing along the first airflow path and at least 1.25 liters per minute passing along the second airflow path. The aerosol delivery device may further comprise a truncated O-ring located between the passive aerosol generator and the vapor generator, the truncated O-ring partially defining the second airflow path.

The truncated O-ring may function as a liquid seal for an aerosol precursor storage. The aerosol precursor storage may provide aerosol precursor to the aerosol generator, and may be located within a housing of the aerosol delivery device. The truncated O-ring may act to provide a liquid seal between the aerosol precursor storage and an exterior of the housing of the aerosol delivery device. The first airflow path and the second airflow path may converge at a point downstream of the vapor generator.

The first airflow path and the second airflow path may converge at a point upstream of the passive aerosol generator.

The aerosol delivery device may include a mouthpiece, and a portion of the aerosol generator may be provided within the mouthpiece.

The passive aerosol generator may include a Venturi aperture and a porous member located within the Venturi aperture and fluidly connected to a reservoir of aerosol precursor.

The aerosol precursor may be a flavor aerosol precursor and may be substantially nicotine free. The vapor precursor may contain nicotine. The vapor generator may include a coil and wick assembly, and the vapor generator may be configured to heat vapor precursor contained within the wick by passing an electrical current through the coil.

The aerosol delivery device may be a consumable for a smoking substitute device.

The aerosol delivery device includes the combination of the features described except where such a combination is clearly impermissible or expressly avoided.

In a third aspect of the third mode, there is provided a smoking substitute device including the aerosol delivery device of the first aspect of the third mode including any, or any combination insofar as they are compatible, of the optional features disclosed with reference to the first aspect of the third mode.

In a fourth aspect of the third mode, there is provided a smoking substitute device including the aerosol delivery device of the second aspect including any, or any combination insofar as they are compatible, of the optional features disclosed with reference to the second aspect.

Fourth Mode: An Aerosol Delivery Device Comprising a Deformable Container

At its most general, embodiments of a fourth mode of the present disclosure relate to an aerosol delivery device comprising a deformable container for containing an aerosol precursor.

Accordingly, in a first aspect of the fourth mode, there is provided aerosol delivery device comprising: an aerosol delivery device comprising: an aerosol generator, configured to generate an aerosol from an aerosol precursor; and a reservoir, containing the aerosol precursor; wherein the reservoir is a deformable container, configured such that exerting pressure to the deformable container provides or increases the provision of aerosol precursor to the aerosol generator.

Optional features will now be set out. These are applicable singly or in any combination with any aspect described below.

The deformable container may be made from a relatively soft material, e.g., high-density polyethylene or similar. The deformable container may be made of a material softer than a material forming a portion of a housing of the aerosol delivery device (for example a region of the housing encapsulating a battery).

Optionally, the deformable container may be located within a flexible housing, the flexible housing may be configured to impart any pressure exerted thereto on to the deformable container.

Advantageously, the aerosol delivery device may further comprise a button located on a housing of the aerosol delivery device, and the button may be configured to impart any force exerted thereto on to the deformable container.

Conveniently, the aerosol delivery device may further comprise a pressure-actuatable seal located between the reservoir and the aerosol generator, the pressure-actuatable seal may be configured to open when a threshold pressure is exerted on to the deformable container.

Optionally, the aerosol generator may be made of a material having a different color to the aerosol precursor. This can enable a user to visually verify that aerosol precursor is present in the aerosol generator and therefore the device is ready for use. Advantageously, the device may further comprise a one-way valve, located between reservoir and the aerosol generator, and the one-way valve may be configured to allow aerosol precursor to flow only from the reservoir to the aerosol generator.

Conveniently, the aerosol delivery device may further comprise a vapor generator, for vaporizing a vapor precursor, and the aerosol generated by the aerosol generator may be mixed with the vapor downstream of the vapor generator.

Optionally, the aerosol precursor may be a flavor precursor and may be substantially nicotine free. Advantageously, the aerosol delivery device may be a consumable for a smoking substitute device.

Conveniently, the device may further comprise an additional aerosol generator, the additional aerosol generator being configured to heat an additional aerosol precursor to produce an additional aerosol. Optionally, the device may further comprise: an aerosol generator portion configured to receive the aerosol precursor; and an airflow passage, configured to direct air past the aerosol generator portion to pick up the aerosol precursor from the aerosol generator portion to form an aerosol.

Advantageously, the aerosol generator portion may include a Venturi aperture and a porous member located within the Venturi aperture and fluidly connected to the reservoir.

This disclosure also relates to an aerosol delivery device comprising a pump for providing a predetermined quantity of aerosol.

In a second aspect of the fourth mode, there is provided aerosol delivery device comprising: a reservoir of aerosol precursor; an aerosol generator, operable to generate an aerosol from the aerosol precursor; and a mechanically actuatable pump, actuatable to dispense a predetermined quantity of aerosol precursor to the aerosol generator.

Advantageously, such an aerosol delivery device can help ensure the consistent delivery of aerosol precursor over an intended usage period. The predetermined quantity may be, for example, a predetermined volume of aerosol precursor or a predetermined mass of aerosol precursor. The predetermined mass may be no more than 0.1 mg, no more than 0.2 mg, no more than 0.3 mg, no more than 0.4 mg, or no more than 0.5 mg. The predetermined value may be within the range of no less than 0.1 mg and no more than 10 mg, no less than 0.2 mg and no more than 8.0 mg, no less than 0.3 mg and no more than 6.0 mg, no less than 0.4 mg and no more than 4.0 mg, and no less than 0.5 mg and no more than 2.0 mg.

Optionally, the mechanically actuatable pump may be actuated by deforming an elastomeric portion of the aerosol delivery device.

Advantageously, the elastomeric portion may be configured to actuate the pump and dispense the predetermined quantity of aerosol precursor when compressed. That is to say, the degree to which the elastomeric portion can be compressed may be determinative of the volume of aerosol precursor to be dispensed. In other words, the pump may be configured to dispense the predetermined quantity of aerosol precursor when the elastomeric portion is compressed.

Conveniently, the mechanically actuatable pump may be formed as a portion of an outer housing of the device.

Optionally, the actuatable pump may include a slidable actuator located on an external surface of the device.

Advantageously, the device may further comprise a vapor generator, for vaporizing a vapor precursor, and the aerosol generated by the aerosol generator may be mixed with the vapor downstream of the vapor generator. Conveniently, the aerosol precursor may be a flavor precursor and may be substantially nicotine free.

Optionally, the reservoir of aerosol precursor may be held at ambient pressure. By ambient pressure, it may be meant that the reservoir of aerosol precursor is not pressurised relative to atmospheric pressure. In use, it may mean that the reservoir is fluidly open to the atmosphere external to the device.

Advantageously, the device may further comprise: an aerosol generator portion configured to receive the aerosol precursor; and an airflow passage, configured to direct air past the aerosol generator portion to pick up the aerosol precursor from the aerosol generator portion to form an aerosol when the mechanically actuatable pump is activated.

Optionally, the aerosol generator portion may include a Venturi aperture and a porous member located within the Venturi aperture and fluidly connected to the reservoir.

Conveniently, the aerosol delivery device may be a consumable for a smoking substitute device.

Advantageously, the device may further comprise an additional aerosol generator, the additional aerosol generator being configured to heat an additional aerosol precursor to produce an additional aerosol.

Optionally, the aerosol delivery device may further comprise a puff sensor, configured to sense when a user is drawing on a mouthpiece of the aerosol delivery device, and the mechanically actuatable pump may be configured to actuate when the puff sensor senses a user is drawing on the mouthpiece.

Conveniently, the aerosol generator may comprise an aerosolizing spray nozzle coupled to or forming a part of the mechanically actuatable pump, configured to generate an aerosol from the aerosol precursor when the mechanically actuatable pump is actuated. The aerosolizing spray nozzle may be located within or proximal to a mouthpiece of the aerosol delivery device. The aerosolizing spray nozzle may have a clear line of sight between a spray aperture of the nozzle and an outlet of the mouthpiece.

The present disclosure also relates to an aerosol delivery device comprising a frangible seal between a reservoir and an aerosol generator.

In a third aspect of the fourth mode, there is provided a smoking substitute device, including the aerosol delivery device of the first or second aspects of the fourth mode.

The aerosol delivery device as used in the third aspect may have any, or any combination insofar as they are compatible, of the optional features of any of the first or second aspects of the fourth mode.

The disclosure includes the combination of the aspects and preferred features of the fourth mode described except where such a combination is clearly impermissible or expressly avoided.

Fifth Mode: A Refill Device or Cap for an Aerosol Delivery Device

At its most general, a fifth mode of the present disclosure relates to a refill device or cap for an aerosol delivery device.

According to a first aspect of the fifth mode, there is provided a refill device for an aerosol delivery device comprising: a porous liquid transfer element containing aerosol precursor; and an engagement unit, located at one end of the refill device and including at least a portion of the porous liquid transfer element, the engagement unit being suitable for engaging with a corresponding engagement unit of the aerosol delivery device, so as to allow aerosol precursor to flow from the porous liquid transfer element into the aerosol delivery device.

Advantageously, such a device can be used to refill, recharge, or charge an aerosol generator of the aerosol delivery device to help facilitate consistent provision of aerosol during use of the aerosol delivery device. The porous liquid transfer element may be configured to contact an aerosol generator of the aerosol delivery device when the engagement unit of the refill device is engaged with the corresponding engagement unit of the aerosol delivery device.

Optionally, the device may further comprise a liquid reservoir, fluidly connected to the porous liquid transfer element and containing aerosol precursor. The porous liquid transfer element may extend into the liquid reservoir. The liquid reservoir may contain no more than 5 ml of aerosol precursor. The refill device may further comprise a pump which, when operated may pressurize the liquid reservoir to a pressure above an ambient pressure (e.g., a pressure above atmospheric pressure).

Conveniently, the engagement unit may be a cavity into which a mouthpiece of the aerosol delivery device can be introduced, and a portion of the porous liquid transfer element may extend into the cavity so as to contact a protruding portion of the aerosol generator within the mouthpiece of the aerosol delivery device.

Optionally, the porous liquid transfer element may be at least partially contained within a housing. The engagement unit may be integrally formed from the housing. When the refill device includes a liquid reservoir, the housing may be deformable so as to exert a pressure on aerosol precursor stored within the liquid reservoir when a force is applied to the housing.

In a second aspect of the fifth mode there is provided a reservoir-less aerosol delivery device usable with the refill device of the first aspect of the fifth mode, the reservoir-less aerosol delivery device comprising: an aerosol generator, configured to generate an aerosol from an aerosol precursor; and a mouthpiece, in which a portion of the aerosol generator is provided; wherein the aerosol generator is not provided with a reservoir of aerosol precursor, and the aerosol generator is charged with aerosol precursor solely through use of the refill device.

By not provided with a reservoir of aerosol precursor, it may be meant that the reservoir-less aerosol delivery device does not comprise a reservoir which is distinct from the aerosol generator and which is fluidly connected to the aerosol generator.

In a third aspect of the fifth mode, there is provided a method of charging an aerosol generator of an aerosol delivery device using the refill device according to the first aspect of the fifth mode, the method comprising the step of: engaging the engaging unit of the refill device with the corresponding engagement unit of the aerosol deliver device, such that aerosol precursor flows form the porous liquid transfer element into the aerosol delivery device. The refill device as used in the third aspect of the fifth mode may have any, or any combination insofar as they are compatible, of the optional features of the first aspect of the fifth mode.

When the refill device includes a pump, the method may include a step of actuating the pump after the engaging unit of the refill device has engaged the corresponding engagement unit of the aerosol delivery device.

In a fourth aspect of the fifth mode, there is provided a smoking substitute system, including an aerosol delivery device and the refill device of the first aspect of the fifth mode (including any, or any combination insofar as they are compatible, of the optional features of the fifth mode disclosed therein), wherein the aerosol delivery device includes an aerosol generator connected to the porous liquid transfer element and a corresponding engagement unit engaged with the engagement unit of the refill device.

The aerosol generator may include: an aerosol generator portion configured to receive the aerosol precursor; and an airflow passage, configured to direct air past the aerosol generator portion to pick up the aerosol precursor from the aerosol generator portion to form an aerosol.

The aerosol generator portion may include a Venturi aperture and a porous member located within the Venturi aperture. According to a fifth aspect of the fifth mode, there is provided an aerosol delivery system comprising: a reservoir-less aerosol delivery device comprising: an aerosol generator, configured to generate an aerosol from an aerosol precursor; and a mouthpiece, in which a portion of the aerosol generator is provided; wherein the aerosol generator is not provided with a reservoir of aerosol precursor, and the refill device of the first aspect of the fifth mode, wherein the aerosol generator is charged with aerosol precursor solely through use with the refill device.

The disclosure includes the combination of the aspects and preferred features of the fifth mode described above except where such a combination is clearly impermissible or expressly avoided.

In a sixth aspect of the fifth mode, there is provided a refill cap for an aerosol delivery device, the aerosol delivery device including an aerosol generator, and the refill cap comprising: an adaptor, for securing the refill cap to an external portion of the aerosol delivery device; a reservoir for storing an aerosol precursor; and a transfer member, which is configured to transfer aerosol precursor form the reservoir to the aerosol generator of the aerosol delivery device when the adaptor secures the refill cap to the aerosol delivery device.

Such a refill cap can ensure that the aerosol generator does not run out of aerosol precursor during the lifetime of the aerosol delivery device. The reservoir may contain aerosol precursor.

Conveniently, the refill cap may be configured to cover a mouthpiece aperture of the aerosol delivery device. Optionally, the refill cap may include an aperture, into which a mouthpiece of the aerosol delivery device is introduced when the adaptor secures the refill cap to the aerosol delivery device.

Advantageously, the reservoir may have a capacity of no more than 5 ml. The capacity of the reservoir may be no more than 4 ml, no more than 3 ml, no more than 2.5 ml, or no more than 2 ml. The reservoir may have a capacity of at least 0.5 ml, at least 1 ml, or at least 2 ml. Conveniently, the transfer member may be porous, and wicks aerosol precursor from the reservoir to the aerosol generator when the adaptor secures the refill cap to the aerosol delivery device.

Optionally, a housing of the refill cap may be deformable, so as to exert a pressure on the aerosol precursor stored within the reservoir when a force is applied to the housing.

Advantageously, the adaptor may be a push-fit adaptor, and may be securable to the aerosol delivery device by pushing the adaptor onto the external portion of the aerosol delivery device.

Conveniently, the adaptor may be a screw-fit adaptor, and may be securable to the aerosol delivery device by screwing the adaptor onto the external portion of the aerosol delivery device. The refill cap of the sixth aspect of the fifth mode may otherwise be referred to as a refill device.

In a seventh aspect of the fifth mode, there is provided a reservoir-less aerosol delivery device usable with the refill cap of the sixth aspect of the fifth mode, the reservoir-less aerosol delivery device comprising: an aerosol generator, configured to generate an aerosol from an aerosol precursor; and a mouthpiece, in which a portion of the aerosol generator is provided; wherein the aerosol generator is not provided with a reservoir of aerosol precursor, and the aerosol generator is charged with aerosol precursor solely through use with the refill cap.

Advantageously, the refill cap of the sixth aspect of the fifth mode and including any, or any combination insofar as they are compatible, of the optional features of the fifth mode disclosed with reference thereto may be secured to an external portion of the aerosol delivery device.

Conveniently, the cap may cover a mouthpiece aperture of the aerosol generator when it is secured to the external portion of the aerosol delivery device.

Optionally, the aerosol generator may be a passive aerosol generator, and may include: an aerosol generating portion configured to receive the aerosol precursor; and an airflow passage, configured to direct air past the aerosol generator portion to pick up the aerosol precursor from the aerosol generator portion to form an aerosol.

Advantageously, the aerosol generator portion may include a Venturi aperture and a porous member located within the Venturi aperture.

Conveniently, the aerosol delivery device may be a consumable in a smoking substitute device.

In an eighth aspect of the fifth mode, there is provided a method of charging an aerosol delivery device using the refill cap of the sixth aspect of the fifth mode, the method comprising: using the adaptor to secure the refill cap to an external portion of the aerosol delivery device.

The disclosure includes the combination of the sixth, seventh and/or eighth aspects of the fifth mode and preferred features described above except where such a combination is clearly impermissible or expressly avoided.

According a ninth aspect of the fifth mode, there is provided a refill device for an aerosol delivery device, the refill device comprising: a refill reservoir containing aerosol precursor; and a valve connected to the refill reservoir, openable by contact with a liquid transfer element of an aerosol generator of the aerosol delivery device, to allow the aerosol precursor contained within the refill reservoir to flow into the aerosol generator.

Such a refill device allows a user of the aerosol delivery device to refill, or charge, the aerosol generator in the aerosol delivery device. The user can then draw or puff on the device, receiving aerosol provided from said aerosol generator. When the aerosol generator is then depleted of aerosol precursor, the refill device can be used again to refill or charge the aerosol generator. Optionally, the valve may be biased into a closed position, such that the valve closes when the liquid transfer element is withdrawn.

Advantageously, the refill device may further comprise a locking mechanism which seals the valve.

Conveniently, the refill reservoir may comprise a first volume adjacent to the valve and a second volume sealable from the first volume by a dividing mechanism. The dividing mechanism may comprise a first and second conduit, located in respective portions of a flow path, and the first conduit may be movable relative to the second between an open position in which aerosol precursor can flow through the flow path and a closed position in which aerosol precursor cannot flow through the flow path. The first conduit may be rotatable relative to the second conduit, such that the closed position is one in which the first and second conduits are entirely misaligned. The valve may be a duckbill valve.

The device may further comprise a pump which, when operated when the valve is open, pumps aerosol precursor into the liquid transfer element of the aerosol delivery device.

The device may further comprise an engagement mechanism, located at an end of the refill device proximal to the valve such that the refill device can be engaged to a corresponding mechanism of the aerosol delivery device.

At its most general, the ninth aspect of the fifth mode relates to a refill device for an aerosol delivery device comprising a valve openable by contact with a liquid transfer element of an aerosol generator.

In a tenth aspect of the fifth mode, there is provided a method of refilling an aerosol delivery device using the refill device of the ninth aspect of the fifth mode, the method comprising the step of: introducing the liquid transfer element of the aerosol delivery device through the valve of the refill device, so as to cause aerosol precursor to flow from the refill reservoir into the aerosol delivery device.

The method may include an initial priming step, the initial priming step including the sub-steps of: holding the refill device such that the first volume is located below the second volume, when the dividing mechanism is not dividing the two volumes, such that the first volume fills with aerosol precursor; and operating the dividing mechanism so as to seal the first volume from the second volume; wherein after the initial priming step has been performed, the liquid transfer element is introduced through the valve.

The refill device of the tenth aspect of the fifth mode may have any, or any combination insofar as they are compatible, of the optional features of the ninth aspect of the fifth mode.

In an eleventh aspect of the fifth mode, there is provided an aerosol delivery device comprising: an aerosol generator, having a liquid transfer element at one end thereof; a mouthpiece, in which the aerosol generator is disposed; and a refill mechanism, which is usable to move the liquid transfer element of the aerosol generator relative to the mouthpiece.

The refill mechanism may be a mechanical slider, located on an external surface of the aerosol delivery device and configured to move the liquid transfer element relative to the mouthpiece.

The movement relative to the mouthpiece may be such as to expose more or less of the liquid transfer element to an exterior of the device. Preferably, the refill mechanism moves the liquid transfer element away from the mouthpiece when the aerosol generator is to be refilled, and away from the mouthpiece when the aerosol generator has been refilled.

The aerosol generator may further comprise: an aerosol generator portion, configured to receive the aerosol precursor; and an airflow passage, configured to direct air past the aerosol generator to pick up the aerosol precursor from the aerosol generator portion to form an aerosol.

The aerosol generator portion may include a Venturi aperture and a porous member located within the Venturi aperture and fluidly connected to the liquid transfer element.

The aerosol generator may be a consumable for a smoking substitute device.

The device may further comprise an additional aerosol generator, the additional aerosol generator being configured to heat an additional aerosol precursor to produce an additional aerosol.

The aerosol delivery device may further comprise a puff sensor, configured to sense when a user is drawing on a mouthpiece of the aerosol delivery device, and the mechanically actuatable pump may be configured to actuate when the puff sensor senses a user is drawing on the mouthpiece.

In a twelfth aspect of the fifth mode, there is provided a system comprising: an aerosol delivery device including: an aerosol generator, having a liquid transfer element at one end thereof; and a mouthpiece, in which the aerosol generator is disposed; the system also comprising: a refill device for the aerosol delivery device, the refill device including: a refill reservoir containing aerosol precursor; and a valve, connected to the refill reservoir and openable by contact with the liquid transfer element of the aerosol generator of the aerosol delivery device, to allow the aerosol precursor contained within the refill reservoir to flow into the aerosol generator.

The aerosol delivery device and the refill device of the twelfth aspect of the fifth mode may have any, or any combination insofar as they are compatible, of the features of the refill device of the ninth aspect of the fifth mode or the aerosol delivery device of the eleventh aspect of the fifth mode.

The disclosure includes the combination of the ninth, tenth, eleventh and/or twelfth aspects of the fifth mode and preferred features of the fifth mode described above except where such a combination is clearly impermissible or expressly avoided.

The disclosure includes the combination of the aspects and preferred features of the fifth mode described above except where such a combination is clearly impermissible or expressly avoided.

SUMMARY OF THE FIGURES

So that the disclosure may be understood, and so that further aspects and features thereof may be appreciated, embodiments illustrating the principles will now be discussed in further detail with reference to the accompanying figures, in which.

DETAILED DESCRIPTION

Aspects and embodiments will now be discussed with reference to the accompanying figures. Further aspects and embodiments will be apparent to those skilled in the art.

Figure 1:
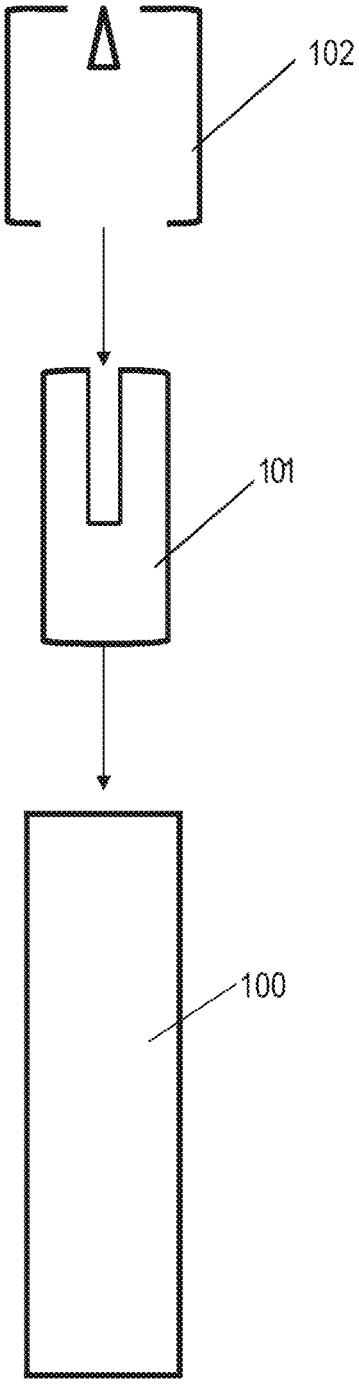
FIG. 1 shows a schematic drawing of a smoking substitute device of the first mode.

First Mode: An Aerosol Delivery Device in which a Barrier Arrangement Inhibits Evaporation of Aerosol Precursor Referring to FIG. 1 and FIG. 2, there is shown a smoking substitute device 10. In this example, the smoking substitute device comprises a cartomiser 101 and a flavor pod 102 connected to a base unit 100. In this example, the base unit 100 includes elements of the smoking substitute device such as a battery, an electronic controller, and a pressure transducer. The cartomiser 101 may engage with the base unit 100 via a push-fit engagement, a screw-thread engagement, or a bayonet fit, for example. A cartomiser may also be referred to as a "pod". The smoking substitute device can include an aerosol delivery device according to the present disclosure.

Figure 2:
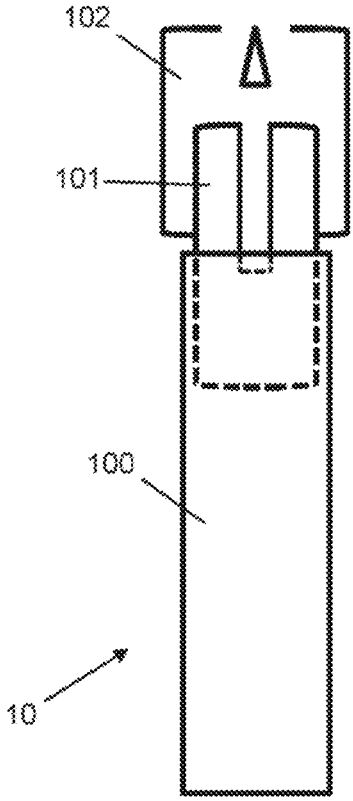
FIG. 2 shows a schematic drawing of a smoking substitute device of the first mode.

The flavor pod 102 is configured to engage with the cartomiser 101 and thus with the base unit 100. The flavor pod 102 may engage with the cartomiser 101 via a push-fit engagement, a screw-thread engagement, or a bayonet fit, for example. FIG. 2 illustrates the cartomiser 101 engaged with the base unit 100, and the flavor pod 102 engaged with the cartomiser 101. As will be appreciated, in this example, the cartomiser 101 and the flavor pod 102 are distinct elements. Each of the cartomiser 101 and the flavor pod may be an aerosol delivery device according to the present disclosure.

As will be appreciated from the following description, the cartomiser 101 and the flavor pod 102 may alternatively be combined into a single component that implements the functionality of the cartomiser 101 and flavor pod 102. Such a single component may also be an aerosol delivery device according to the present disclosure. In other examples, the cartomiser may be absent, with only a flavor pod 102 present.

A "consumable" component may mean that the component is intended to be used once until exhausted, and then disposed of as waste or returned to a manufacturer for reprocessing.

Figure 3:
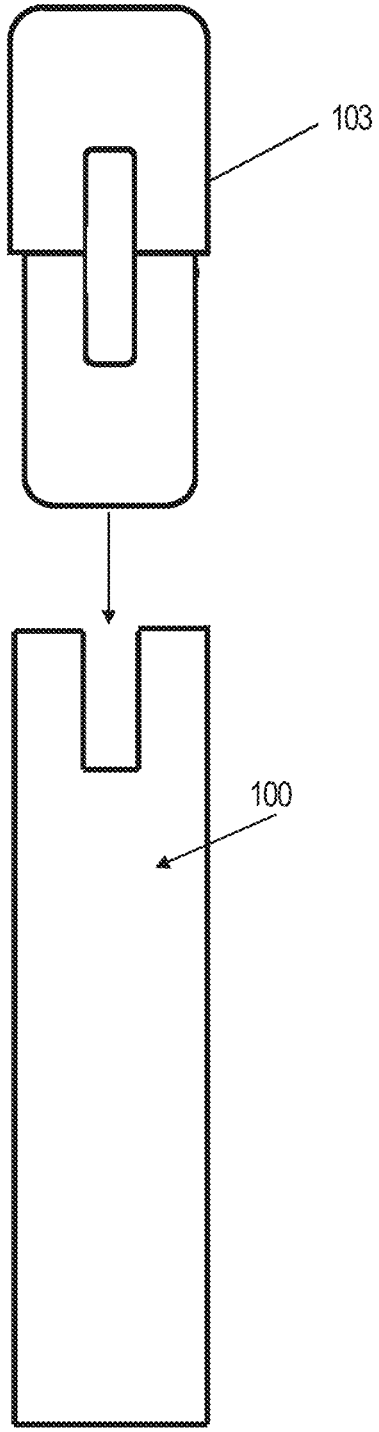
FIG. 3 shows a schematic drawing of a smoking substitute device of the first mode.
Figure 4:
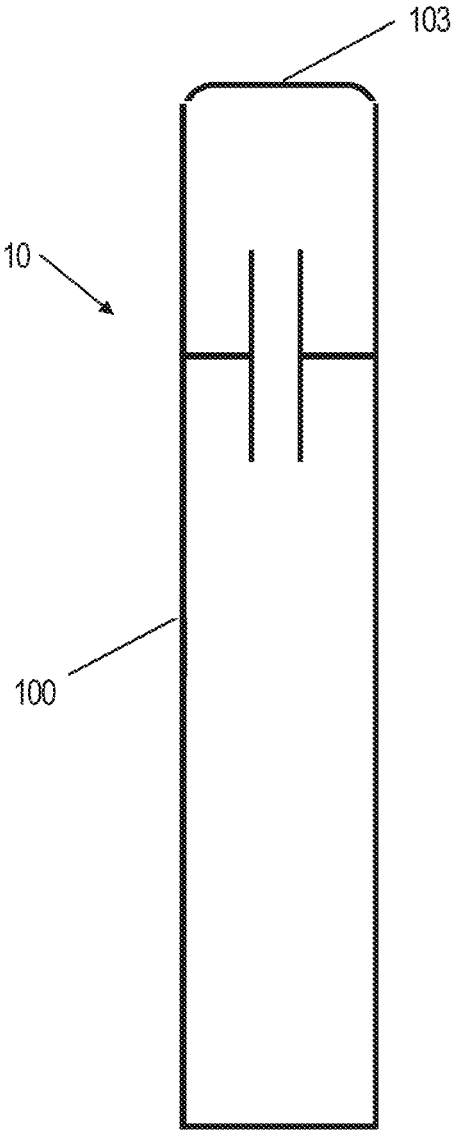
FIG. 4 shows a schematic drawing of a smoking substitute device of the first mode.

Referring to FIG. 3 and FIG. 4, there is shown a smoking substitute device comprising a base unit 100 and a consumable 103. The consumable 103 combines the functionality of the cartomiser 101 and the flavor pod 102. In FIG. 3, the consumable 103 and the base unit 100 are shown separated from one another. In FIG. 4, the consumable 103 and the base unit 100 are engaged with each other to form the smoking substitute device 10.

Figure 5:
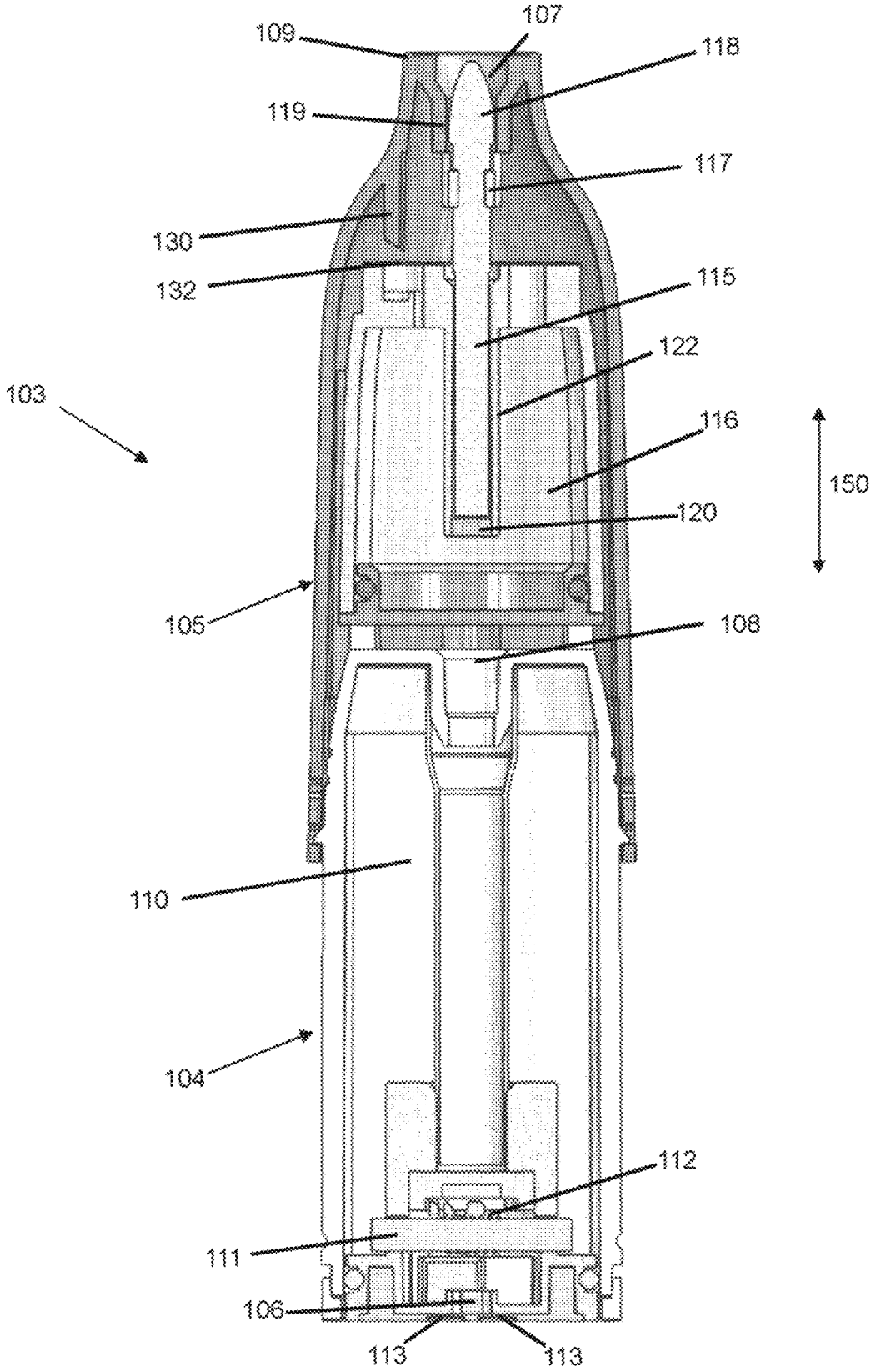
FIG. 5 shows a cross-sectional view of the first mode of a consumable in a deactivated state.

Referring to FIG. 5, there is shown a consumable 103 engagable with a base unit via a push-fit engagement in a deactivated state. The consumable 103 may be considered to have two portions—a cartomiser portion 104 and a flavor pod portion 105, both of which are located within a single component (as in FIG. 3 and FIG. 4). The consumable 103 includes an upstream airflow inlet 106 and a downstream airflow outlet 107. In other examples a plurality of inlets and/or outlets are included. Between and fluidly connecting the inlet 106 and the outlet 107 there is an airflow passage 108. The outlet 107 is located at the mouthpiece 109 of the consumable 103, and is formed by a mouthpiece aperture.

As above, the consumable 103 includes a flavor pod portion 105. The flavor pod portion 105 is configured to generate a first (flavor) aerosol for output from the outlet 107 of the mouthpiece 109 of the consumable 103. The flavor pod portion 105 of the consumable 103 includes a liquid transfer element 115, in the form of a member 115. The member 115 acts as a passive aerosol generator (e.g., an aerosol generator which does not use heat to form the aerosol, also referred to as a "first aerosol generator" in this example), and is formed of a porous material. The member 115 comprises a supporting portion 117, which is located inside a housing, and an aerosol generator portion 118, which is located in the airflow passage 108. In this example, the aerosol generator portion 118 is a porous nib. When activated, as discussed in more detail below, a first storage 116 (in this example a tank) for storing a first aerosol precursor (i.e., a flavor liquid) is fluidly connected to the member 115. The porous nature of the member 115 means that flavor liquid from the first storage 116 is drawn into the member 115. As the first aerosol precursor in the member 115 is depleted in use, further flavor liquid is drawn from the first storage 116 into the member 115 via a wicking action. Before activation, the barrier arrangement 120 is closed and inhibits evaporation of aerosol precursor. In this example, this is achieved by the barrier arrangement inhibiting flow of aerosol precursor from the first storage 116 to the member 115. In order to inhibit flow of aerosol precursor, the barrier arrangement 120 substantially isolates the first storage 116 from the member 115. In this example, the barrier arrangement comprises a plug 120 (preferably formed from silicon) located at one end of a tube 122 containing the member 115 close to the first storage 116. The tube 122 may be an example of the frangible seal discussed above in relation to the eighth aspect. To activate the consumable 103, a user may squeeze the flavor pod portion 105 thereby breaking the frangible seal.

In other examples, the plug may be replaced by a deformable and/or breakable barrier component, e.g., any one of: a duck bill valve; a split valve or diaphragm; or a sheet of foil, which may be pierced by the member 115 when opening the barrier arrangement.

The first storage 116 further includes a pressure relief opening 132, which in the deactivated state is sealed by blocking arrangement. In this example, the blocking arrangement comprises a pierceable cover (preferably made from foil). Piercing member 130, which is formed as a part of the mouthpiece 109 and may take the form of a blade, pierces the pierceable cover and opens the pressure relief opening 132 when the consumable is moved to the activated state (as is discussed in more detail below). This means that opening of the barrier arrangement also effects opening of the blocking arrangement.

As described above, the aerosol generator portion 118 is located within the airflow passage 108 through the consumable 103. The aerosol generator portion 118 therefore constricts or narrows the airflow passage 108. The aerosol generator portion 118 occupies some of the area of the airflow passage, resulting in constriction of the airflow passage 108. The airflow passage 108 is narrowest adjacent to the aerosol generator portion 118. Since the constriction results in increased air velocity and corresponding reduction in air pressure at the aerosol generator portion 118, the constriction is a Venturi aperture 119. The constriction is generally toroidal in shape, and may include one or more intersections where supports contact the aerosol generator portion 118.

The cartomiser portion 104 of the consumable 103 includes a second storage 110 (in this example a tank) for storing a second aerosol precursor (i.e., e-liquid, which may contain nicotine). Extending into the second storage 110 is a wick 111. The wick 111 is formed from a porous wicking material (e.g., a polymer) that draws second aerosol precursor from the second storage 110 into a central region of the wick 111 that is located outside the e-liquid storage tank 110.

A heater 112 is a configured to heat the central region of the wick 111. The heater 112 includes a resistive heating filament that is coiled around the central region of the wick 111. The wick 111, the heater 112 and the e-liquid storage tank 110 together act as an active aerosol generator (i.e., an aerosol generator which uses heat to form the aerosol, referred to as a "second aerosol generator" in this example).

As described above, the first and second aerosol generators are both at least partially located within the airflow passage 108, with the first aerosol generator downstream (with respect to air flow in use) of the second aerosol generator.

So that the consumable 103 may be supplied with electrical power for activation of the heater 112, the consumable 103 includes a pair of consumable electrical contacts 113. The consumable electrical contacts 113 are configured for electrical connection to a corresponding pair of electrical supply contacts in the base unit 100. The consumable electrical contacts 113 are electrically connected to the electrical supply contacts 114 when the consumable 103 is engaged with the base unit 100. The base unit 100 includes an electrical power source (not shown), for example a battery.

Figure 6:
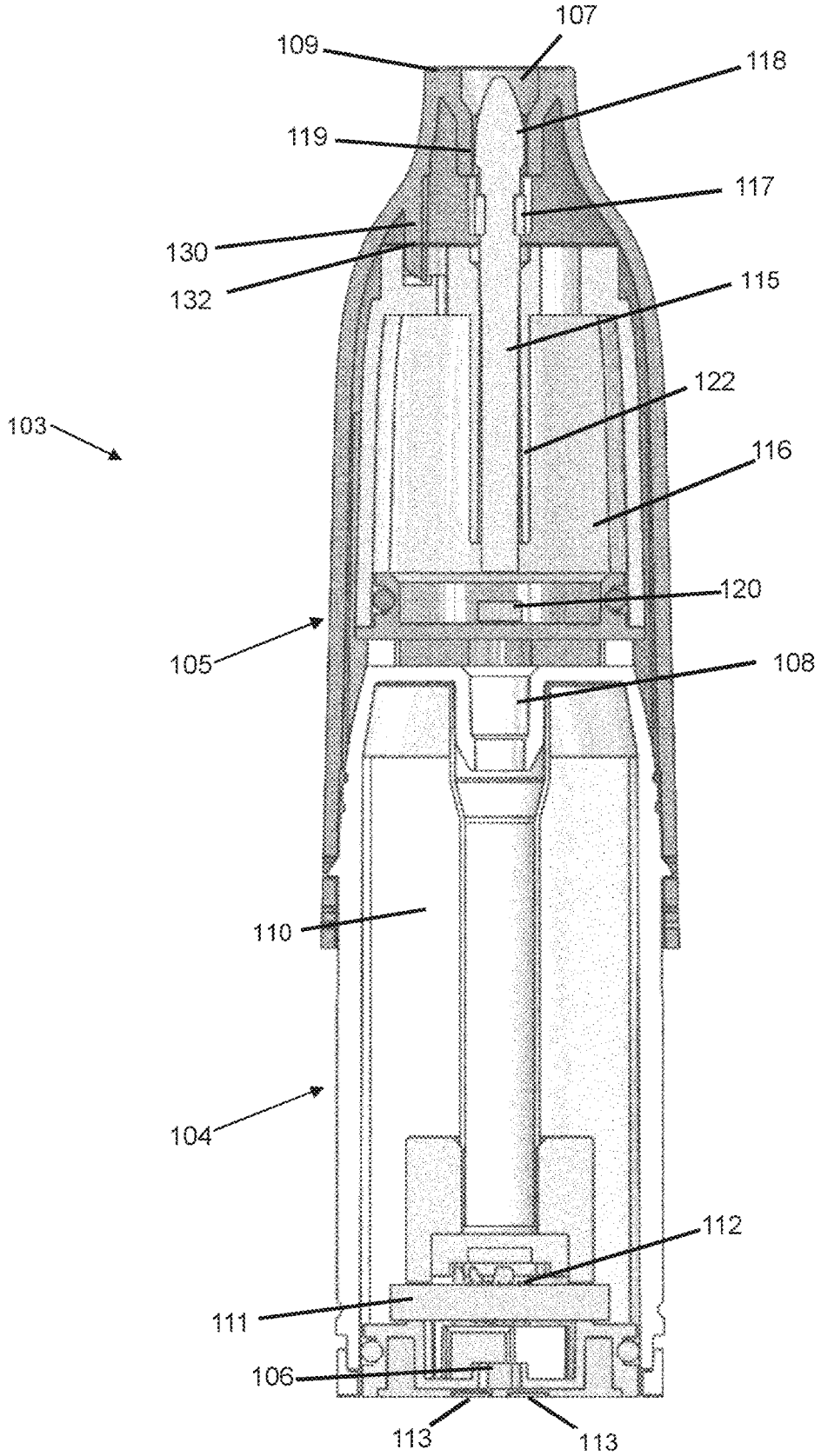
FIG. 6 shows a cross-sectional view of the first mode of the consumable of FIG. 5 in an activated state.

FIG. 6 shows the consumable 103 of FIG. 5 in an activated state, like features are indicated by like reference numerals. To transition from the deactivated state to the activated state, mouthpiece 109 is moved along a central axis 150 towards cartomizer portion 104 (e.g., one along which the consumable extends, and along which member 115 extends). Moving the mouthpiece 109 in this way effects relative movement between the liquid transfer element (i.e., the member 115) and the barrier arrangement. This causes the barrier arrangement to open. In other examples, a switch is provided for opening the barrier arrangement. The mouthpiece 109, via supporting portion 117, is fixed to the member 115 and therefore member 115 moves with the mouthpiece 109. The mouthpiece 109, and member 115, is moved relative to the tank 116. This causes displacement of the plug 120 and opening of the barrier arrangement 116.

At the same time, movement of the mouthpiece 109 causes the piercing member 130 to contact and pierce pressure relief opening 132, thereby fluidly connecting the airflow passage 108 to an interior of the first storage 116. This permits air to flow into the first storage 116 as the first storage empties of aerosol precursor in use.

In the present example, once the barrier arrangement is open, the plug 120 is unconstrained within the first storage. However, in other cases, the plug 120 may be received by a guide for inhibiting return of the plug to the closed position after displacement of the plug. The guide may comprise a recess for receiving the plug 120.

In the present example, the barrier arrangement remains permanently open after opening, as the plug 120 does not return to the tube 122. However, in other examples, the barrier arrangement is selectively openable and closable by the user. This may be achieved by the plug (or another type of barrier arrangement) being fixed to an end portion of the member 115, such that the member 115 is selectively exposable to the first storage 116.

Once activated, and in use, a user draws (or "sucks", "pulls", or "puffs") on the mouthpiece 109 of the consumable 103, which causes a drop in air pressure at the outlet 107, thereby generating air flow through the inlet 106, along the airflow passage 108, out of the outlet 107 and into the user's mouth.

When the heater 112 is activated (by passing an electric current through the heating filament in response to the user drawing on the mouthpiece 109, the drawing of air may be detected by a pressure transducer) the e-liquid located in the wick 111 adjacent to the heating filament is heated and vaporized to form a vapor. The vapor condenses to form the second aerosol within the airflow passage 108. Accordingly, the second aerosol is entrained in an airflow along the airflow flow passage 108 to the outlet 107 and ultimately out from the mouthpiece 109 for inhalation by the user when the user draws on the mouthpiece 109.

The base unit 100 supplies electrical current to the consumable electrical contacts 113. This causes an electric current flow through the heating filament of the heater 112 and the heating filament heats up. As described, the heating of the heating filament causes vaporization of the e-liquid in the wick 111 to form the second aerosol.

As the air flows up through the airflow passage 108, it encounters the aerosol generator portion 118. The constriction of the airflow passage 108 caused by the aerosol generator portion 118 results in an increase in air velocity and corresponding decrease in air pressure in the airflow in the vicinity of the porous surface 118 of the aerosol generator portion 115. The corresponding low pressure and high air velocity region causes the generation of the first (flavor) aerosol from the porous surface 118 of the aerosol generator portion 118. The first (flavor) aerosol is entrained into the airflow and ultimately is output from the outlet 107 of the consumable 103 and thus from the mouthpiece 109 into the user's mouth. The first aerosol is sized to inhibit pulmonary penetration. The first aerosol is formed of particles with a mass median aerodynamic diameter that is greater than or equal to 15 microns, in particular, greater than 30 microns, more particularly greater than 50 microns, yet more particularly greater than 60 microns, and even more particularly greater than 70 microns.

The first aerosol is sized for transmission within at least one of a mammalian oral cavity and a mammalian nasal cavity. The first aerosol is formed by particles having a maximum mass median aerodynamic diameter that is less than 300 microns, in particular less than 200 microns, yet more particularly less than 100 microns. Such a range of mass median aerodynamic diameter will produce aerosols which are sufficiently small to be entrained in an airflow caused by a user drawing air through the flavor element and to enter and extend through the oral and or nasal cavity to activate the taste and/or olfactory receptors.

The second aerosol generated is sized for pulmonary penetration (i.e., to deliver an active ingredient such as nicotine to the user's lungs). The second aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapor. The size of aerosol formed without heating is typically smaller than that formed by condensation of a vapor.

As a brief aside, it will be appreciated that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol.

Figure 7:
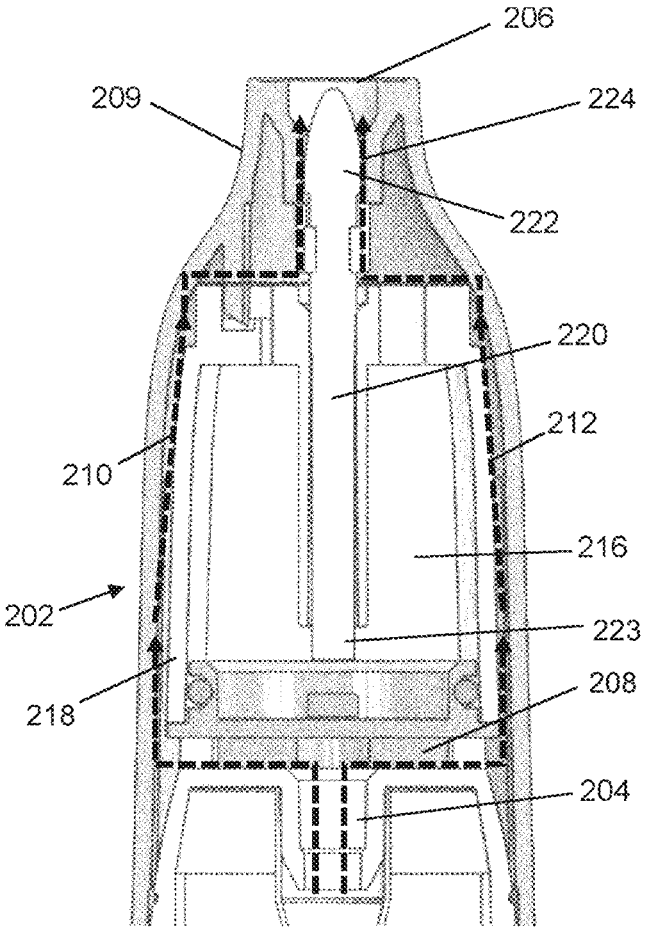
FIG. 7 shows a cross-sectional view of a flavor pod portion of a consumable of the first mode.

Referring to FIG. 7, there is shown a flavor pod portion 202 of a consumable in an activated state, the consumable providing an aerosol delivery device. The consumable further comprises a cartomiser portion (not shown in FIG. 7)

having all of the features of the cartomiser portion 104 described above with respect to FIGS. 5 and 6. However, in other examples, the consumable does not comprise the cartomiser portion, and provides only flavor to the user.

The flavor pod portion 202 comprises an upstream (i.e., upstream with respect to flow of air in use) inlet 204 and a downstream (i.e., downstream with respect to flow of air in use) outlet 206. Between and fluidly connecting the inlet 204 and the outlet 206 the flavor pod portion 204 comprises an airflow passage 208. The airflow passage 208 comprises a first airflow branch 210 and a second airflow branch 212, each of the first airflow branch 210 and the second airflow branch 212 fluidly connecting the inlet 204 and the outlet 206. In other examples the airflow passage 208 may have an annular shape. The outlet 206 is located at the mouthpiece 209 of the consumable 103, and is also referred to as a mouthpiece aperture 206.

The flavor pod portion 202 comprises a storage, which stores a first aerosol precursor. The storage comprises a reservoir 216 located within a chamber 218. The reservoir 216 is formed of a first porous material. The flavor pod portion 202 comprises a member 220, which comprises an aerosol generator portion 222 and a supporting portion 223. The aerosol generator portion 222 is located at a downstream end (an upper end in FIG. 6) of the member 220, while the supporting portion 223 makes up the rest of the member 220. The supporting portion 223 is elongate and substantially cylindrical. The aerosol generator portion 222 is bulb-shaped, and comprises a portion which is wider than the supporting portion 223. The aerosol generator portion 222 tapers to a tip at a downstream end of the aerosol generator portion 222.

The member 220 extends into and through the reservoir 216. The member 220 is in contact with the reservoir 216. More specifically, the supporting portion 223 extends into and 6 is in contact with the reservoir 216. The member 220 is located in a substantially central position within the reservoir 216 and is substantially parallel to a central axis of the consumable. The member 220 is formed of a second porous material.

The first and second airflow branches 210, 212 are located on opposite sides of the member 220. Additionally, the first and second airflow branches 210, 212 are located on opposite sides of the reservoir 216. The first and second airflow branches 210, 212 branch in a radial outward direction (with respect to the central axis of the consumable 200) downstream of the inlet 204 to reach the opposite sides of the reservoir 216.

The aerosol generator portion 222 is located in the airflow passage 208 downstream of the first and second airflow branches 210, 212. The first and second airflow branches 210, 212 turn in a radially inward direction to merge at the member 220, at a point upstream of the aerosol generator portion 222.

The aerosol generator portion 222 is located in a narrowing section 224 of the airflow passage 208. The narrowing section 224 is downstream of the point at which the first and second airflow branches 210 212 merge, but upstream of the mouthpiece aperture 207. The mouthpiece aperture 207 flares outwardly in the downstream direction, such that a width of the mouthpiece aperture 207 increases in the downstream direction.

In use, when a user draws on the mouthpiece 209, air flow is generated through the air flow passage 208. Air (comprising the second aerosol from the cartomiser portion as explained above with respect to FIG. 5) flows through the inlet 204 before the air flow splits to flow through the first and second airflow branches 210, 212. Further downstream, the first and second airflow branches 210, 212 provide inward airflow towards the member 220 and the aerosol generator portion 222.

As air flows past the aerosol generator portion in the narrowing section 224, the velocity of the air increases, resulting in a drop in air pressure. This means that the air picks up the first aerosol precursor from the aerosol generator portion 222 to form the first aerosol. The first aerosol has the particle size and other properties described above with respect to FIG. 5.

As the first aerosol precursor is picked up by the air, the member 220 transfers further first aerosol precursor from the reservoir 216 to the aerosol generator portion 222. More specifically, the member 220 wicks the first aerosol precursor from the reservoir 216 to the aerosol generator portion 224.

In other examples, the storage comprises a tank containing the first aerosol precursor as free liquid, rather than the reservoir 216 and the chamber 218. In such examples, the member 220 still extends into the tank to transfer first aerosol precursor from the tank to the aerosol generator portion 224.

Figure 8A:
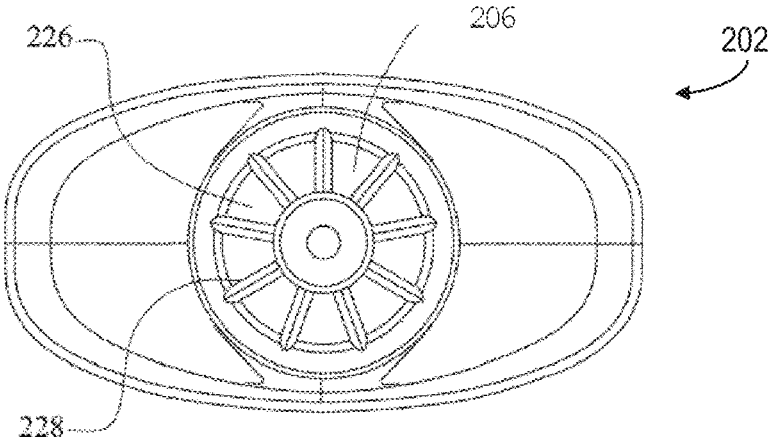
FIG. 8A shows a top view of the first mode of a flavor pod portion of a consumable.
Figure 8B:
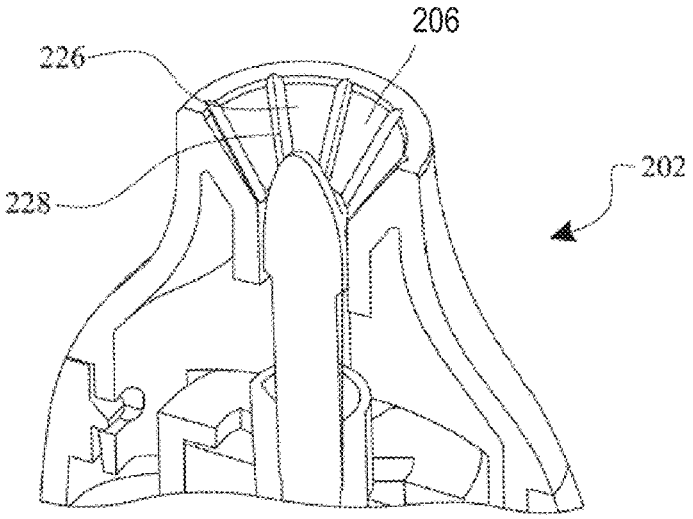
FIG. 8B shows a cut away perspective view of the first mode of a flavor pod portion of a consumable.

FIGS. 8A and 8B show further views of the flavor pod portion 202 which highlight features of the mouthpiece 209. Many of the reference numerals of FIG. 7 are omitted from FIGS. 8A and 8B for clarity.

The mouthpiece aperture 206 comprises an inner surface 226, which is uneven. In the present example, the inner surface 226 has the form of a substantially frustoconical surface, but includes grooves or channels 228 to make the inner surface 226 somewhat uneven. In other examples, the inner surface 226 may have another form (for example, the form a substantially cylindrical surface), and may include any type of protrusion or groove to make the inner surface uneven.

The inner surface 226 is angled with respect to an axial direction (i.e., relative to a central axis extending from a base of the consumable to the mouthpiece) such that the width of the mouthpiece aperture 209 increases in the downstream direction. The inner surface 226 is immediately downstream of the narrowing section 224 of the airflow passage 108.

The grooves 228 are generally v-shaped in cross-sectional profile, and extend in the axial direction for the full length of the inner surface 226. Each groove 228 is formed from a pair of surfaces angled at between 30 and 90 degrees relative to each other. More specifically, each groove 228 is formed from a pair of surfaces angled at 60 degrees relative to each other.

The grooves 228 have a depth (measured normal to the inner surface 226) of at least 0.2 mm. More specifically, the grooves 228 have a depth of at least 0.3 mm. More specifically, the grooves 228 have a depth of at least 0.4 mm.

The grooves 228 have a depth of less than 0.8 mm. More specifically, the grooves have a depth of less than 0.7 mm. More specifically, the grooves have a depth of less than 0.6 mm.

More specifically, the grooves have a depth of substantially 0.5 mm.

The grooves 228 are substantially equi-spaced in a circumferential manner around the inner surface 226. The inner surface 226 comprises at least 6 grooves. More specifically, the inner surface comprises at least 7 grooves. More specifically, the inner surface 226 comprises at least 8 grooves.

The inner surface 226 comprises at most 12 grooves 228. More specifically, the inner surface 226 comprises at most 11 grooves 228. More specifically, the inner surface 226 comprises at most 10 grooves 228.

More specifically, the inner surface 226 comprises 9 grooves 228.

The grooves 228 are spaced apart from each other by substantially 1 mm at the downstream end of the inner surface 226. In other examples, the spacing at the downstream end of grooves or protrusions may be selected such that it is equal to or less than the mass median diameter (as described above) of particles in the first aerosol.

The inner surface 226 comprises a smooth polished surface between the grooves 228. Polishing the surface in this way provides improved aerodynamic properties. However, in other examples, the inner surface 226 may be textured. In such examples, the texture of the surface may provide the uneven surface, and no grooves are required, In use, the uneven nature of the inner surface 226 makes it easier for droplets to form on the inner surface 226, preventing large droplets from entering the user's mouth. The grooves 228 help to channel the large droplets back into the consumable.

Figure 9:
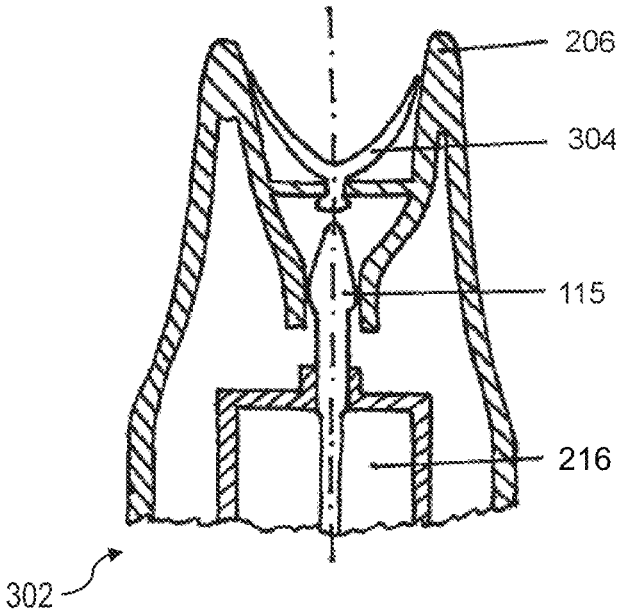
FIG. 9 shows a cross-sectional view of the first mode of a flavor pod portion of a consumable.

Referring to FIG. 9 there is shown a sectional drawing of a second flavor pod portion 302. The second flavor pod portion 302 comprises all of the features of the flavor pod portion 202 aside from the differences described here. Many of the reference numerals relating to features which are common between the second flavor pod portion 302 and the flavor pod portion 202 are omitted from FIG. 9 for clarity. However, like reference numerals are used in FIG. 9 where features referred to previously are referred to again.

The second flavor pod portion 302 comprises a second barrier arrangement 304 for inhibiting evaporation of aerosol precursor when the second barrier arrangement 304 is closed. The second barrier arrangement 302 does not inhibit flow between the first storage and the member 115, which means that the member 115 contains aerosol precursor even when the second barrier arrangement 304 is closed. The second barrier arrangement 304 comprises a valve 304 which is located in the outlet 206 of the second flavor pod portion 302. The valve 304 is a diaphragm valve. The valve 304 substantially seals the outlet 206.

In use, the user inhales on the mouthpiece, which causes the second barrier arrangement 302/valve 304 to open, permitting aerosol to flow out of the outlet 206. The second barrier arrangement 302 closes when the user stops inhaling.

Figure 10:
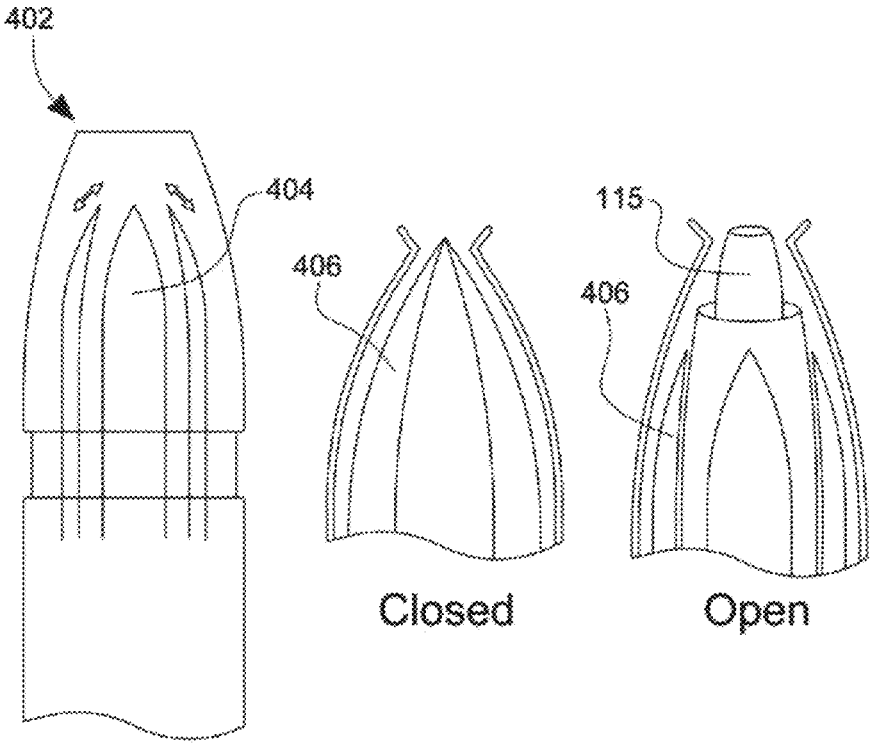
FIG. 10 shows a cross-sectional view of the first mode of a flavor pod portion of a consumable.

Referring to FIG. 10 there is shown a sectional drawing of a third flavor pod portion 402. The third flavor pod portion 402 comprises all of the features of the flavor pod portion 202 aside from the differences described here. Many of the reference numerals relating to features which are common between the second flavor pod portion 402 and the flavor pod portion 202 are omitted from FIG. 10 for clarity. However, like reference numerals are used in FIG. 10 where features referred to previously are referred to again.

The third flavor pod portion 402 comprises a third barrier arrangement 404 for inhibiting evaporation of aerosol precursor when the third barrier arrangement 404 is closed. As with the second barrier arrangement 302, the third barrier arrangement 402 does not inhibit flow between the first storage and the member 115, which means that the member 115 contains aerosol precursor even when the third barrier arrangement 404 is closed. The third barrier arrangement 404 is a shield 404. The shield 404 is formed of a plastic material. The shield 404 encloses the member 115 when the shield 404 is closed.

The shield 404 comprises four curved plates 406. When the shield 404 opens, the curved plates 406 separate and slide to expose the member 115 to permit generation of aerosol.

Figure 11:
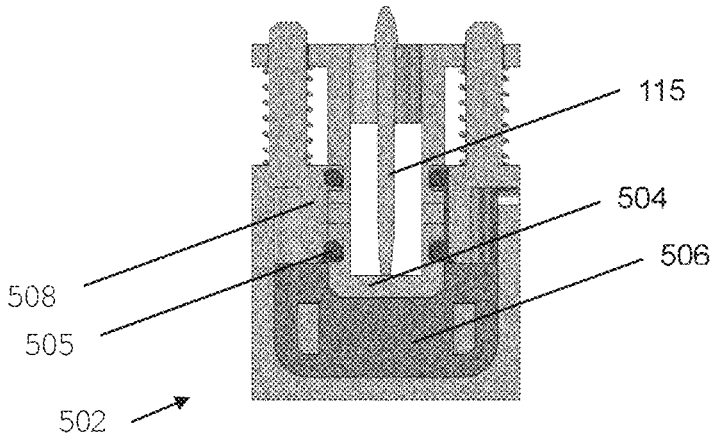
FIG. 11 shows a cross-sectional view of the first mode of a flavor pod portion of a consumable.
Figure 12:
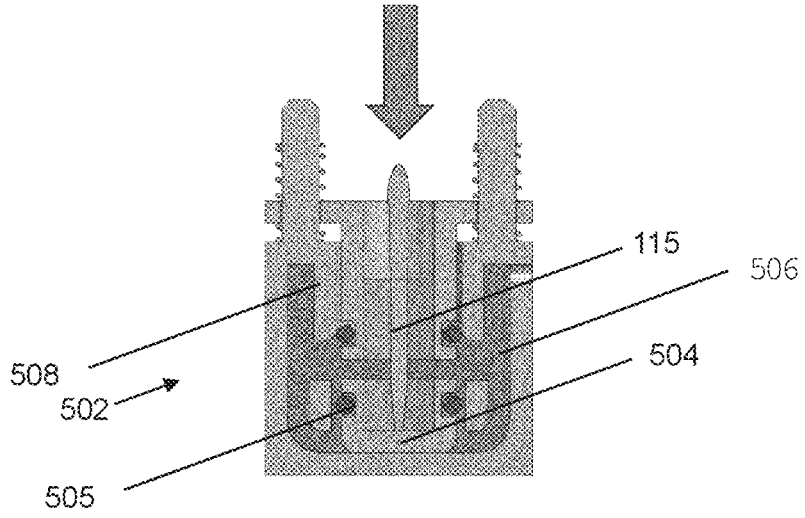
FIG. 12 shows a cross-sectional view of the first mode of the consumable of FIG. 11 in an activated state.

Referring to FIG. 11 and FIG. 12 there are shown cross sectional drawings of a fourth flavor pod portion 502 in deactivated and activated states respectively. The fourth flavor pod portion 502 comprises all of the features of the flavor pod portion 202 aside from the differences described here. Many features and reference numerals relating to features which are common between the fourth flavor pod portion 502 and the flavor pod portion 202 are omitted from FIGS. 11 and 12 for clarity. However, like reference numerals are used in FIGS. 11 and 12 where features referred to previously are referred to again.

The fourth flavor pod portion 502 comprises a fourth barrier arrangement 504 and a second storage 506. The fourth barrier arrangement 504 is configured to inhibit the flow of aerosol precursor from the storage 506 to the transfer element 115 (i.e., the member 115) when the barrier arrangement is in a closed position, as shown in FIG. 11. The fourth barrier arrangement 504 comprises a barrier element 504. The barrier element 504 is fixed to an end portion of the member 115. The barrier element 504 encloses the end portion of the member 115.

The member 115 and the barrier element 504 are located in a tube 508. The barrier element 504 blocks the tube 508 to prevent flow of aerosol precursor to the tube 508 when the fourth barrier arrangement 504 is in the closed position. The barrier element 504 comprises an o-ring 505, which extends around the member 115 to seal the tube 508.

In order to open the fourth barrier arrangement 504, the user slides the mouthpiece (not shown) to effect sliding of the member 115 and the barrier element 504. This causes the barrier element 504 and a side portion 310 of the member 115 to leave the tube 508, thereby exposing the side portion 310 to the aerosol precursor in the storage 506. Aerosol precursor then moves from the storage 506 and into the member for aerosolization. FIG. 12 shows the fourth barrier arrangement 504 in the open position.

The fourth barrier arrangement 504 can then be closed by the user by sliding the mouthpiece (or in other examples a switch) in the opposite direction. This returns the member 115 and the barrier element 504 to the tube 508 such that the barrier element 504 seals the tube 508 again. In this way, the fourth barrier arrangement 504 is selectively openable and closable by the user. If the fourth barrier arrangement 504 is closed again, aerosol will be produced for a small number of "puffs" before the aerosol precursor in the member 115 is depleted. The user can then choose to open the fourth barrier arrangement 504 if required.

Figure 13:
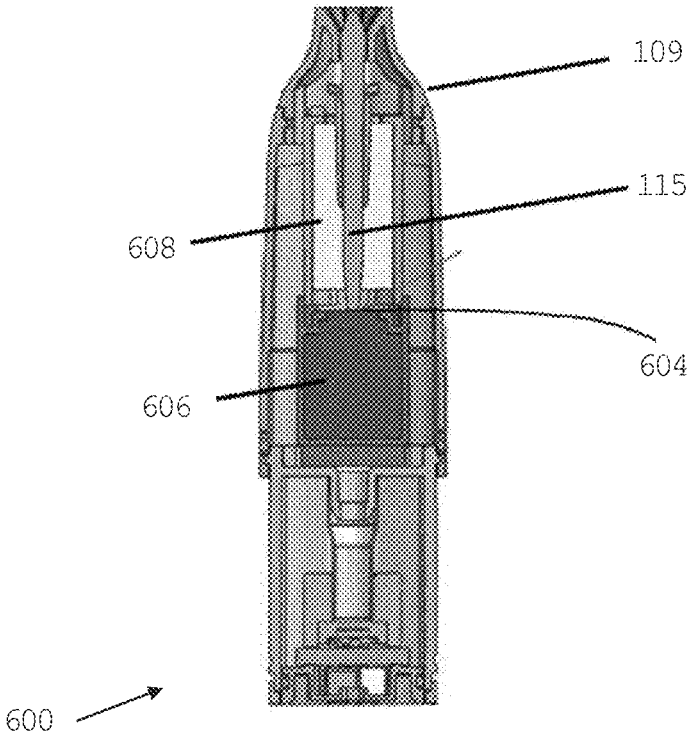
FIG. 13 shows a cross-sectional view of the first mode of a consumable in a deactivated state.
Figure 14:
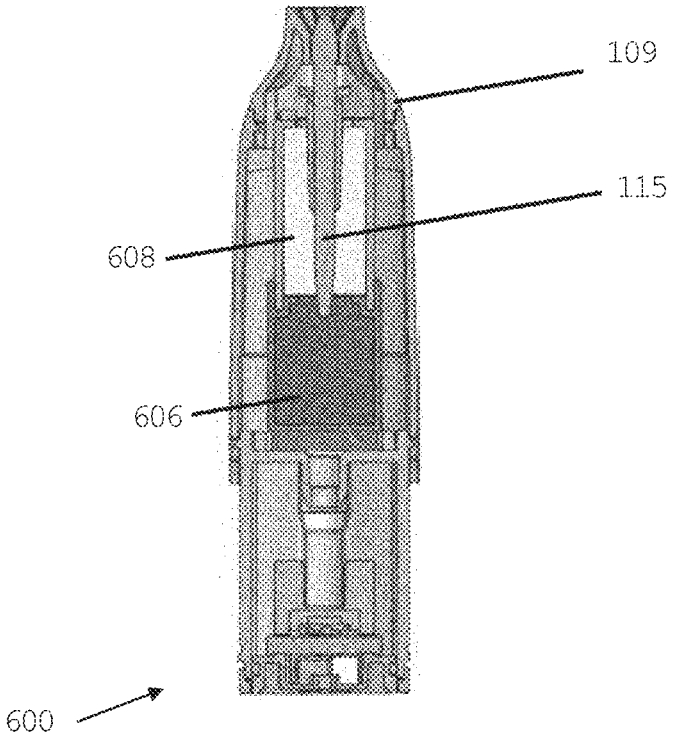
FIG. 14 shows a cross-sectional view of the first mode of a consumable in an activated state.

Referring to FIG. 13 and FIG. 14 there are shown cross sectional drawings of a further consumable 600 comprising a fifth flavor pod portion 602 in activated and deactivated states respectively. The fifth flavor pod portion 602 comprises all of the features of the flavor pod portion 202 aside from the differences described here. Many of the reference numerals relating to features which are common between the fifth flavor pod portion 602 and the flavor pod portion 202 are omitted from FIG. 13 for clarity. However, like reference numerals are used in FIG. 13 where features referred to previously are referred to again.

The fifth flavor pod portion 602 comprises a storage 606 and an additional storage 608. The storage 606 is a free liquid tank and the additional storage 608 is a porous reservoir. Aerosol precursor is initially stored in the storage 606 with the additional storage 608 empty.

The fifth flavor pod portion 602 comprises a fifth barrier arrangement 604 for inhibiting evaporation of aerosol precursor when the fifth barrier arrangement 604 is closed. The fifth barrier arrangement 604 inhibits evaporation of aerosol precursor by preventing flow of aerosol precursor between the storage 606 and the additional storage 608. As can be seen in FIG. 13, when the fifth barrier arrangement is closed, the member 115 is located within and in contact with the empty additional storage 608. The member 115 is distinct from the storage 606.

When the fifth barrier arrangement is closed, the member 115 is not in contact with the storage 606. The fifth barrier arrangement 604 comprises a pierceable substrate (in this example a foil substrate) located between the storage 606 and the additional storage 608.

As before, to open the fifth barrier arrangement 604, the mouthpiece 109 is moved relative to a body of the further consumable 600, which effects relative movement between the liquid transfer element (i.e., the member 115) and the fifth barrier arrangement 604. The movement of the member 115 causes the member to pierce the substrate of the fifth barrier arrangement 604, thereby opening the fifth barrier arrangement 604. This allows aerosol precursor to flow from the storage 606 to the additional storage 608 and into the member 115 for aerosolization.

The user may need to turn the further consumable 600 upside down in order to move aerosol precursor to the additional storage 608. Aerosol precursor is then held in the porous reservoir of the additional storage 608. The fifth barrier arrangement 604 remains permanently open after opening.

Figure 15:
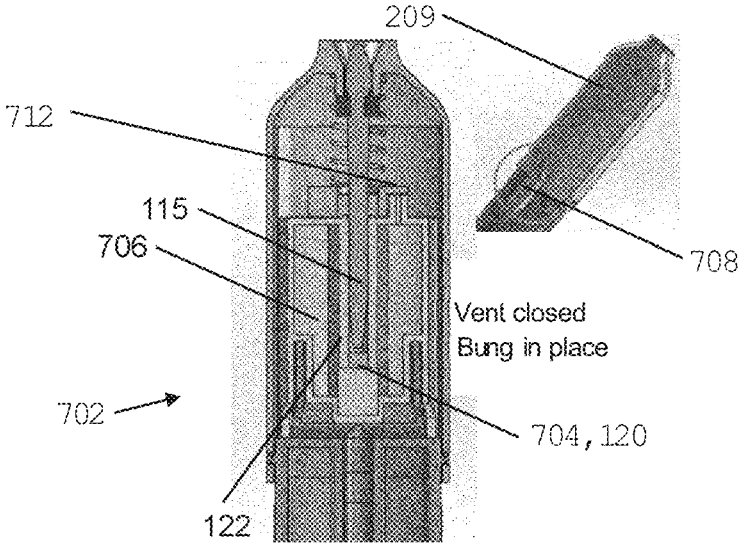
FIG. 15 shows a cross-sectional view of the first mode of a flavor pod portion in a deactivated state.
Figure 16:
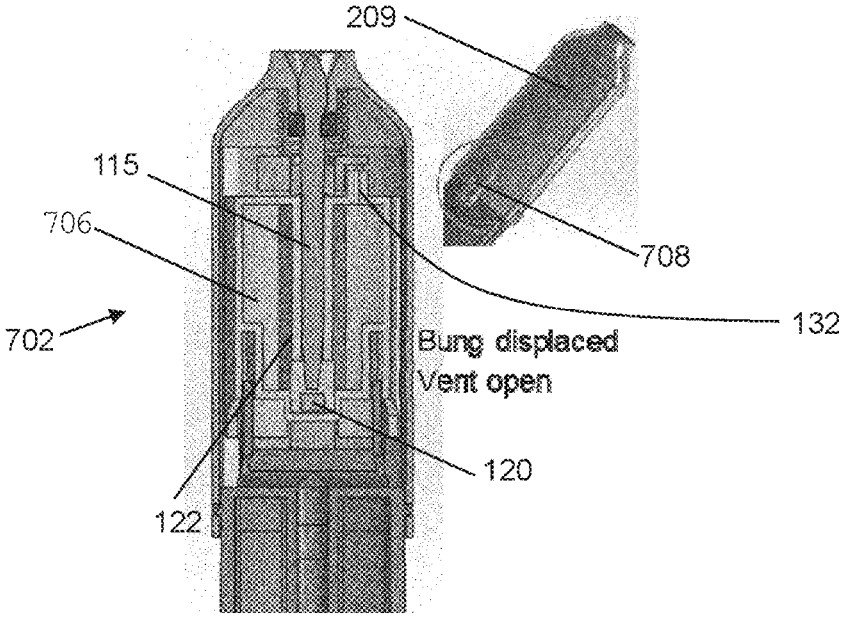
FIG. 16 shows a cross-sectional view of the first mode of the flavor pod portion of FIG. 15 in an activated state.

Referring to FIGS. 15 and 16 there is shown a sectional drawing of a sixth flavor pod portion 702 in a deactivated and activated state respectively. The sixth flavor pod portion 702 comprises all of the features of the flavor pod portion 202 aside from the differences described here. Many of the reference numerals relating to features which are common between the sixth flavor pod portion 702 and the flavor pod portion 202 are omitted from FIG. 15 for clarity. However, like reference numerals are used in FIG. 15 where features referred to previously are referred to again.

The sixth flavor pod portion 702 comprises a sixth barrier arrangement 704 and a storage 706. As with the first barrier arrangement, the sixth barrier arrangement 704 comprises a plug 120 located at one of the tube 122 when the sixth barrier arrangement 704 is in the closed position as shown in FIG. 15. However, unlike the first barrier arrangement, the sixth barrier arrangement 704 is openable by moving the storage 706 with respect to the sixth barrier arrangement 704. More specifically, the sixth barrier arrangement 704 is openable by sliding the storage 706 with respect to the sixth barrier arrangement 704. Since the tube 122 is integrally formed with the storage 706, moving the storage 706 in this way causes relative movement between the storage 706 and the member 115, causing the member 115 to displace the plug 120 from the tube 122 to open the sixth barrier arrangement 704. The member 115 is held in position relative to the mouthpiece by the second supporting portion 710.

The sixth flavor pod portion 702 comprises a switch 708. The switch 708 is located on a front face of the sixth flavor pod portion 702. As shown in FIG. 15 and FIG. 16, the switch 708 is slidable. Sliding of the switch 708 effects sliding of the storage 706 to open the sixth barrier arrangement 704.

The sixth flavor pod portion 702 comprises a blocking arrangement 712. The blocking arrangement 712 inhibits flow through the pressure relief opening 132 when the blocking arrangement 712 is in the closed position as in FIG. 15. When the sixth barrier arrangement 704 is in the closed position as in FIG. 15, the blocking arrangement 712 is connected to the switch 708 and the storage 706. This means that sliding of the switch 708 causes sliding of the blocking arrangement 712, which in turn causes sliding of the storage 706.

Figure 17:
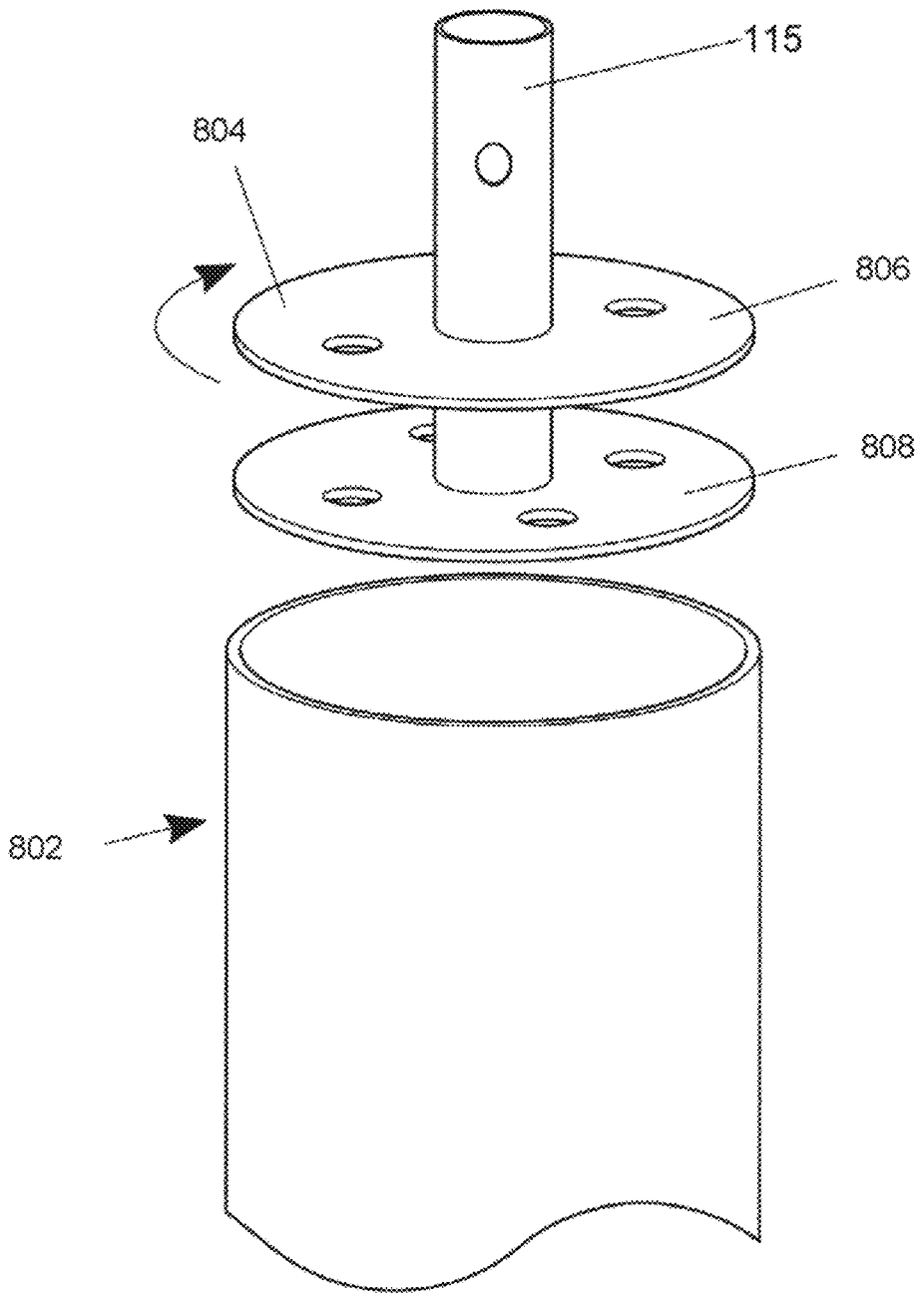
FIG. 17 shows a cut away view of the first mode of a flavor pod portion of a consumable.

The sixth flavor pod portion 702 comprises a stop (not shown). The stop prevents the storage moving beyond a point. Beyond this point, further moving of the switch 708 causes the blocking arrangement 712 to disconnect from the storage 706. This causes the blocking arrangement 712 to move away from the pressure relief opening 732 to open the blocking arrangement 712. Referring to FIG. 17 there is shown a sectional drawing of a seventh flavor pod portion 802. The seventh flavor pod portion 802 comprises all of the features of the flavor pod portion 202 aside from the differences described here. Many of the reference numerals relating to features which are common between the seventh flavor pod portion 802 and the flavor pod portion 202 are omitted from FIG. 17 for clarity. However, like reference numerals are used in FIG. 17 where features referred to previously are referred to again.

The seventh flavor pod portion 802 does not comprise a barrier arrangement as described previously, including only a second blocking arrangement 804. The second blocking arrangement also inhibits evaporation from the aerosol generator portion (by preventing air flow into the storage), in some cases to a sufficient extent. The second blocking arrangement 804 comprises first and second blocking plates 806, 808. The first and second blocking plates 806, 808 are rotatable relative to each other to selectively line up apertures in the first and second blocking plates 806, 808. When the apertures in the first and second blocking plates 806, 808 are lined up, a pressure relief valve (i.e., permitting air flow into the storage) is opened. The first blocking plate 806 is fixed to the mouthpiece. In this way, rotation of the mouthpiece relative to the body of the device permits selective opening of the second blocking arrangement 804.

Figure 18:
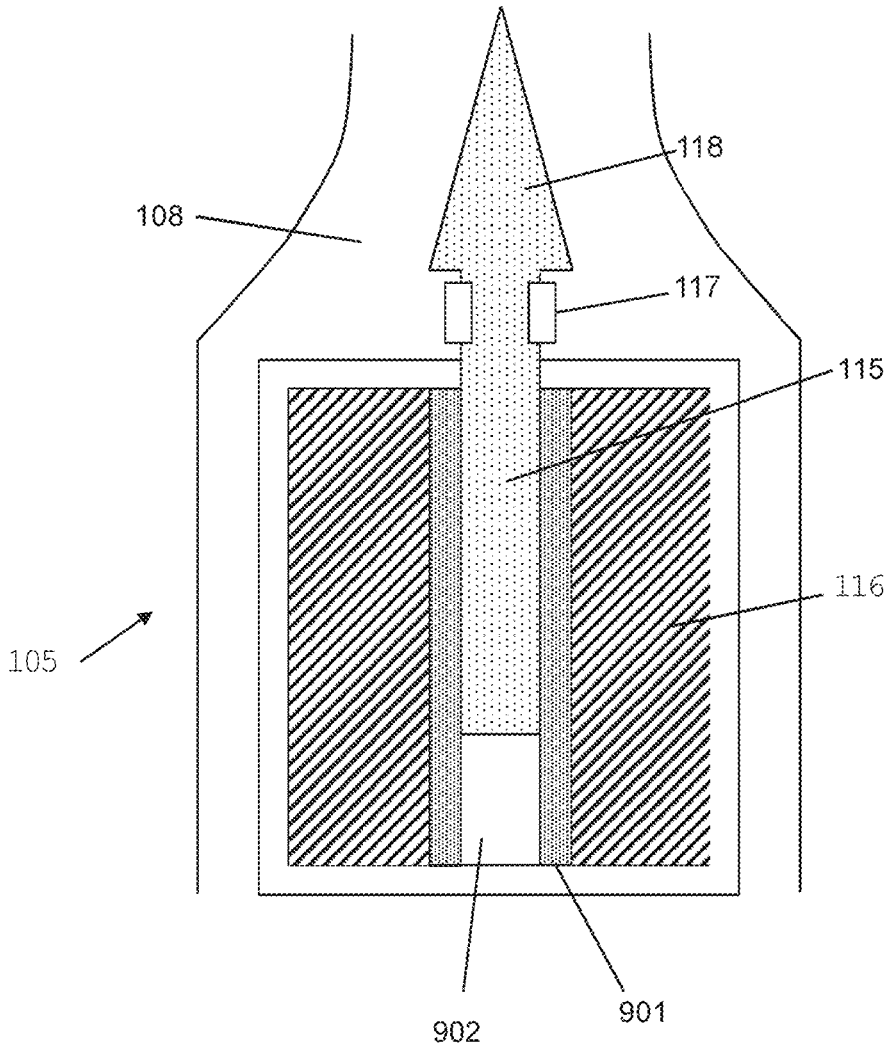
FIG. 18 shows a cross-sectional view of the first mode of a consumable.

FIG. 18 shows a cross-sectional view of a flavor pod portion 105 of a consumable. As before, member 115 functions as a passive aerosol generator and is formed of a porous material. The member includes an aerosol generator portion 118, located within airflow passage 108, and is supported via supporting portion 117. The member 115 is partially located within the first storage 116 which stores a first aerosol precursor. In the state shown in FIG. 18, the member is fluidly isolated from the first aerosol precursor by frangible seal 901. In this example, the frangible seal 901 is a cylindrical glass tube which seals member 115 from the contents of the first storage 116.

In use, the user applies a force to the first storage 116 (for example, by squeezing the casing of the flavor pod 105) which in turn applies a force to the frangible seal 901. Advantageously, the first storage 116 containing first aerosol precursor is, before activation, substantially full of first aerosol precursor such that the squeezing force is efficiently transferred to the frangible seal 901 (the first aerosol precursor being, in this example, an essentially incompressible liquid).

Moreover, there is, in this example, a void 902 containing air or another gas and notably not containing any portion of the member 115. Advantageously, this can help ensure that the frangible seal breaks with less application than if the member 115 extended all of the way to a base of the first storage 116 i.e., the user does not need to apply a force sufficient to compress the member 115, but rather just compress the gas within void 902. However in other examples (not shown) the member 115 extends to the base of the first storage 116 such that there is no void 902 present. The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

Second Mode: An Aerosol Delivery Device Comprising a Switching Device

Aspects and embodiments of the second mode will now be discussed with reference to the accompanying figures. Further aspects and embodiments will be apparent to those skilled in the art.

Figure 19:
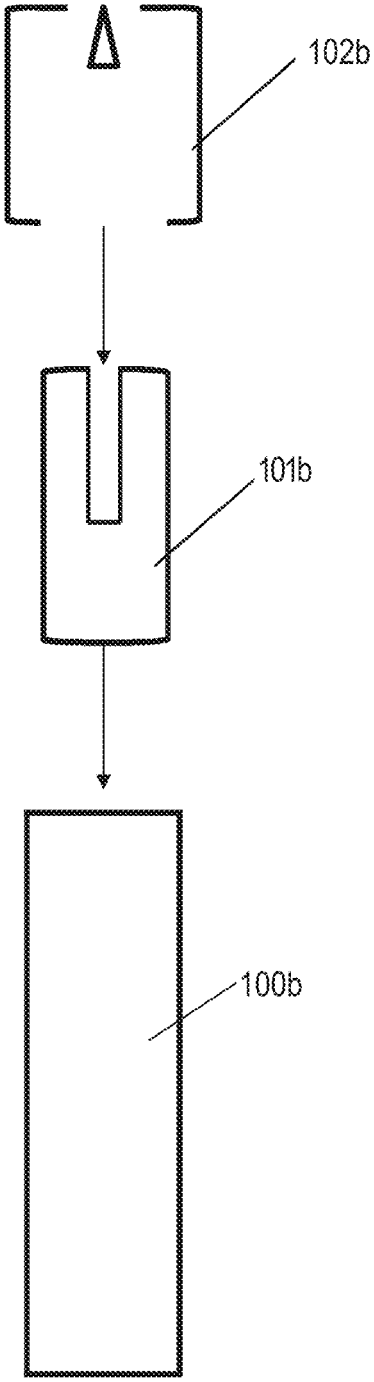
FIG. 19 shows a schematic drawing of a smoking substitute system of the second mode.
Figure 20:
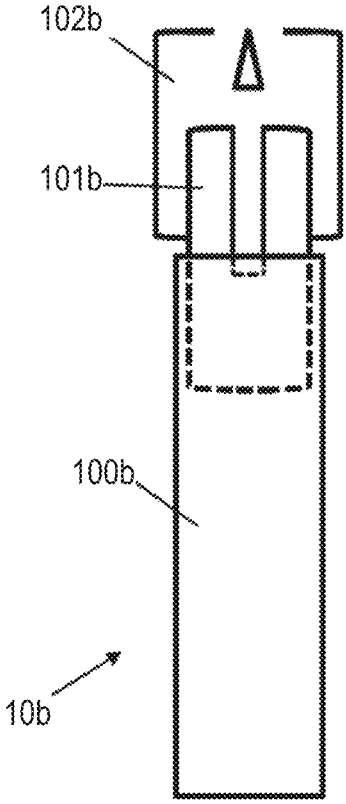
FIG. 20 shows a schematic drawing of a smoking substitute system of the second mode.

Referring to FIG. 19 and FIG. 20, there is shown a smoking substitute system comprising a smoking substitute device 100*b*. The base unit 100*b* includes elements such as a battery, an electronic controller, and a pressure transducer. In this example, the substitute smoking system comprises a cartomiser 101*b* and a flavor pod 102*b*. The cartomiser 101*b* may engage with the smoking substitute device 100*b* via a push-fit engagement, a screw-thread engagement, or a bayonet fit, for example. A cartomiser may also be referred to as a "pod". The smoking substitute system may be an aerosol delivery device according to the present disclosure. The flavor pod 102*b* is configured to engage with the cartomiser 101*b* and thus with the substitute smoking device 100*b*. The flavor pod 102*b* may engage with the cartomiser 101*b* via a push-fit engagement, a screw-thread engagement, or a bayonet fit, for example. FIG. 20 illustrates the cartomiser 101*b* engaged with the substitute smoking device 100*b*, and the flavor pod 102*b* engaged with the cartomiser 101*b*. As will be appreciated, in this example, the cartomiser 101*b* and the flavor pod 102*b* are distinct elements. Each of the cartomiser 101*b* and the flavor pod may be an aerosol delivery device according to the present disclosure.

As will be appreciated from the following description, the cartomiser 101*b* and the flavor pod 102*b* may alternatively be combined into a single component that implements the functionality of the cartomiser 101*b* and flavor pod 102*b*. Such a single component may also be an aerosol delivery device according to the present disclosure. In other examples, the cartomiser may be absent, with only a flavor pod 102*b* present.

A "consumable" component may mean that the component is intended to be used once until exhausted, and then disposed of as waste or returned to a manufacturer for reprocessing.

Figure 21:
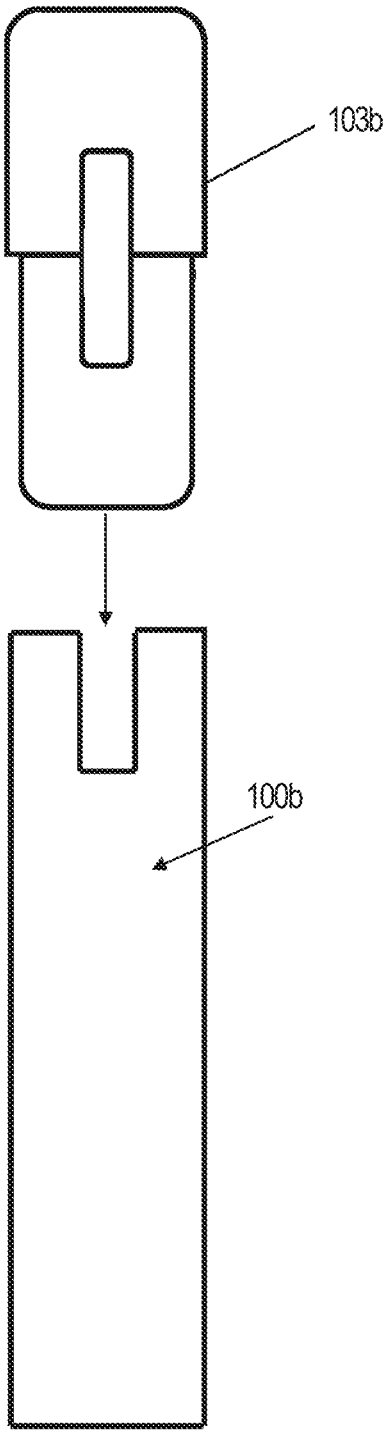
FIG. 21 shows a schematic drawing of a smoking substitute system of the second mode.
Figure 22:
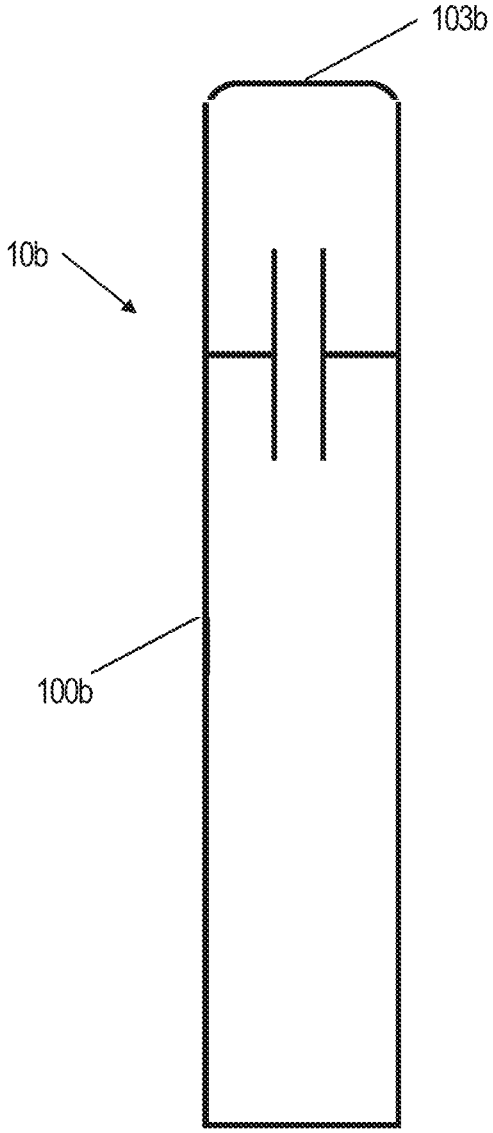
FIG. 22 shows a schematic drawing of a smoking substitute system of the second mode.

Referring to FIG. 21 and FIG. 22, there is shown a smoking substitute system comprising a smoking substitute device 100*b* and a consumable 103*b*. The consumable 103*b* combines the functionality of the cartomiser 101*b* and the flavor pod 102*b*. In FIG. 21, the consumable 103*b* and the smoking substitute device 100*b* are shown separated from one another. In FIG. 22, the consumable 103*b* and the smoking substitute device 100*b* are engaged with each other.

Figure 23:
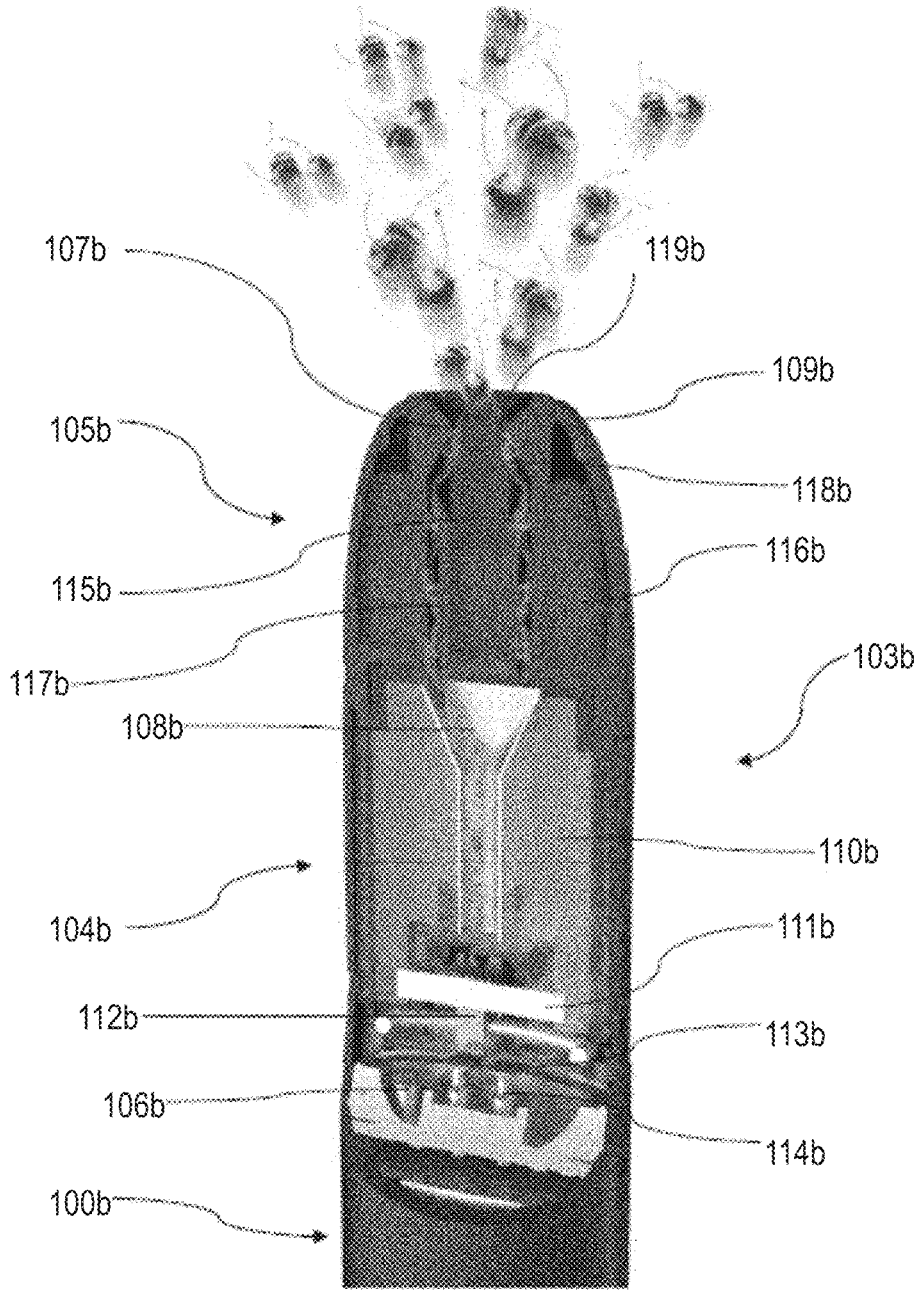
FIG. 23 shows a cutaway view of a consumable of the second mode.
Figure 26:
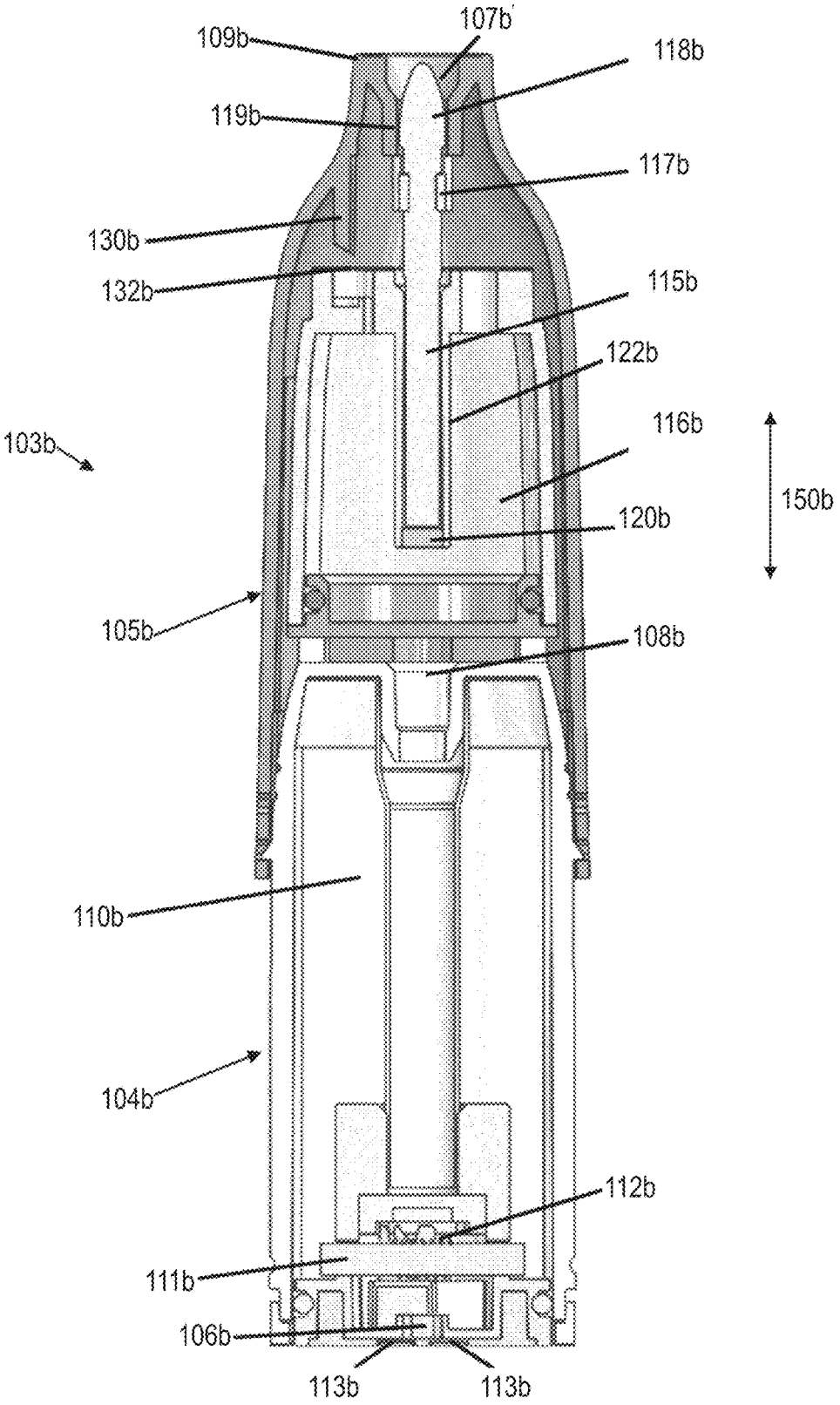
FIG. 26 shows a cross-sectional view of a consumable in a deactivated state of the second mode.

Referring to FIG. 23 and FIG. 26, there is shown a consumable 103*b* engaged (in FIG. 23) or engageable (FIG. 26) with a smoking substitute device 100*b* via a push-fit engagement. The consumable 103*b* may be considered to have two portions—a cartomiser portion 104*b* and a flavor pod portion 105*b*, both of which are located within a single component (as in FIG. 21 and FIG. 22).

The consumable 103*b* includes an upstream airflow inlet 106*b* and a downstream airflow outlet 107*b*. In other examples a plurality of inlets and/or outlets are included. Between and fluidly connecting the inlet 106*b* and the outlet 107*b* there is an airflow passage 108*b*. The outlet 107*b* is located at the mouthpiece 109*b* of the consumable 103*b*, and is formed by a mouthpiece aperture.

As above, the consumable 103*b* includes a flavor pod portion 105*b*. The flavor pod portion 105*b* is configured to generate a first (flavor) aerosol for output from the outlet 107*b* of the mouthpiece 109*b* of the consumable 103*b*. The flavor pod portion 105*b* of the consumable 103*b* includes a liquid transfer element in the form of a member 115*b*. The member 115*b* acts as a passive aerosol generator (i.e., an aerosol generator which does not use heat to form the aerosol, also referred to as an "aerosol generator" and a "first aerosol generator"), and is formed of a porous material. The member 115*b* comprises a supporting portion 117*b*, which is located inside a housing, and an aerosol generator portion 118*b*, which is located in the airflow passage 108*b*. In this example, the aerosol generator portion 118*b* is a porous nib. When activated, as discussed in more detail below, a first storage 116*b* (in this example a tank) for storing an aerosol precursor (i.e., "first aerosol precursor", which is a flavor liquid) is fluidly connected to the member 115*b*. The porous nature of the member 115*b* means that flavor liquid from the first storage 116*b* is drawn into the member 115*b*. As the first aerosol precursor in the member 115*b* is depleted in use, further flavor liquid is drawn from the first storage 116*b* into the member 115*b* via a wicking action. Before activation, the barrier arrangement 120*b* (see FIG. 26) is closed and inhibits evaporation of aerosol precursor. In this example, this is achieved by the barrier arrangement inhibiting flow of aerosol precursor from the first storage 116*b* to the member 115*b*. In order to inhibit flow of aerosol precursor, the barrier arrangement 120*b* substantially isolates the first storage 116*b* from the member 115*b*. In this example, the barrier arrangement comprises a plug 120*b* (preferably formed from silicon) located at one end of a tube 122*b* containing the member 115*b* close to the first storage 116*b*. In other examples, the plug may be replaced by a deformable and/or breakable barrier component, e.g., any one of: a duck bill valve; a split valve or diaphragm; or a sheet of foil, which may be pierced by the member 115*b* when opening the barrier arrangement.

The first storage 116*b* further includes a pressure relief opening 132*b*, which in the deactivated state is sealed by blocking arrangement. In this example, the blocking arrangement comprises a pierceable cover (preferably made from foil). Piercing member 130*b*, which is formed as a part of the mouthpiece 109*b* and may take the form of a blade, pierces the pierceable cover and opens the pressure relief opening 132*b* when the consumable is moved to the activated state (as is discussed in more detail below). This means that opening of the barrier arrangement also effects opening of the blocking arrangement.

As described above, the aerosol generator portion 118*b* is located within the airflow passage 108*b* through the consumable 103*b*. The aerosol generator portion 118*b* therefore constricts or narrows the airflow passage 108*b*. The aerosol generator portion 118*b* occupies some of the area of the airflow passage, resulting in constriction of the airflow passage 108*b*. The airflow passage 108*b* is narrowest adjacent to the aerosol generator portion 118*b*. Since the constriction results in increased air velocity and corresponding reduction in air pressure at the aerosol generator portion 118*b*, the constriction is a Venturi aperture 119*b*. The constriction is generally toroidal in shape, and may include one or more intersections where supports contact the aerosol generator portion 118*b*.

The cartomiser portion 104*b* of the consumable 103*b* includes a second storage 110*b* (in this example a tank) for storing a second aerosol precursor (i.e., e-liquid, which may contain nicotine). Extending into the second storage 110*b* is a wick 111*b*. The wick 111*b* is formed from a porous wicking material (e.g., a polymer) that draws second aerosol precursor from the second storage 110*b* into a central region of the wick 111*b* that is located outside the e-liquid storage tank 110*b*.

A heater 112*b* is a configured to heat the central region of the wick 111*b*. The heater 112*b* includes a resistive heating filament that is coiled around the central region of the wick 111*b*. The wick 111*b*, the heater 112*b* and the e-liquid storage tank 110*b* together act as an active aerosol generator (i.e., an aerosol generator which uses heat to form the aerosol, also referred to as an "additional aerosol generator" and a "second aerosol generator").

As described above, the first and second aerosol generators are both at least partially located within the airflow passage 108*b*, with the first aerosol generator downstream (with respect to air flow in use) of the second aerosol generator. So that the consumable 103*b* may be supplied with electrical power for activation of the heater 112*b*, the consumable 103*b* includes a pair of consumable electrical contacts 113*b*. The consumable electrical contacts 113*b* are configured for electrical connection to a corresponding pair of electrical supply contacts 114*b* in the smoking substitute device 100*b*. The consumable electrical contacts 113*b* are electrically connected to the electrical supply contacts 114*b* when the consumable 103*b* is engaged with the smoking substitute device 100*b*. The smoking substitute device 100*b* includes an electrical power source (not shown), for example a battery.

Figure 27:
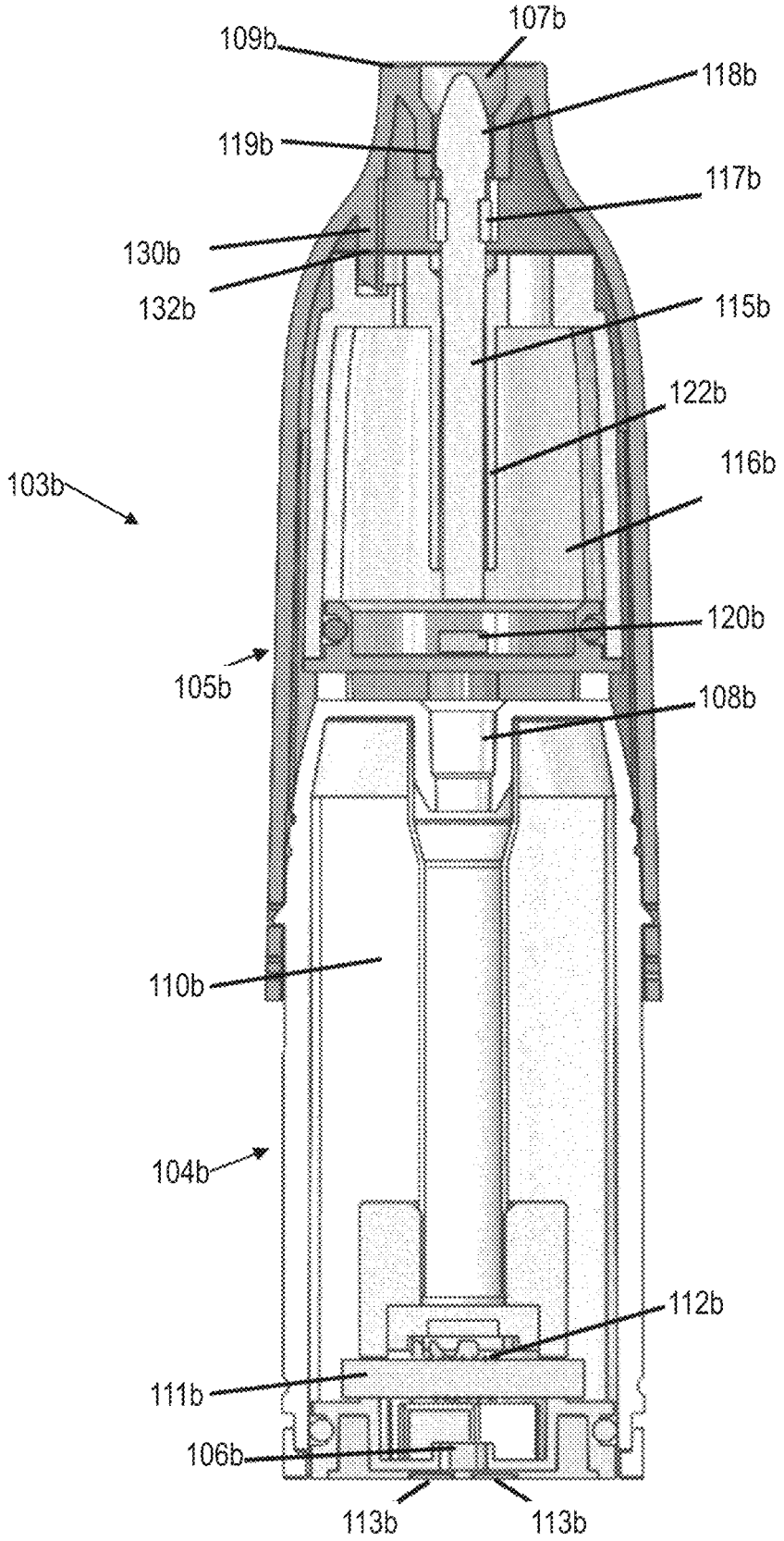
FIG. 27 shows a cross-sectional view of the consumable of FIG. 23 in an activated state of the second mode.

FIG. 27 shows the consumable 103*b* of FIG. 26 in an activated state, like features are indicated by like reference numerals. To transition from the deactivated state to the activated state, mouthpiece 109*b* is moved along a central axis 150*b* towards cartomizer portion 104*b* (e.g., one along which the consumable extends, and along which member 115*b* extends). Moving the mouthpiece 109*b* in this way effects relative movement between the liquid transfer element (i.e., the member 115*b*) and the barrier arrangement. This causes the barrier arrangement to open. In other examples, an activation switch is provided on an outer portion of the consumable for opening the barrier arrangement.

The mouthpiece 109*b*, via supporting portion 117*b*, is fixed to the member 115*b* and therefore member 115*b* moves with the mouthpiece 109*b*. The mouthpiece 109*b*, and member 115*b*, is moved relative to the tank 116*b*. This causes displacement of the plug 120*b* and opening of the barrier arrangement 116*b*.

The supporting portion 117*b* may be integrally formed with the mouthpiece 109*b*. This helps facilitate assembly and also provides better concentricity with the member 115*b*.

At the same time, movement of the mouthpiece 109*b* causes the piercing member 130*b* to contact and pierce pressure relief opening 132*b*, thereby fluidly connecting the airflow passage 108*b* to an interior of the first storage 116*b*. This permits air to flow into the first storage 116*b* as the first storage empties of aerosol precursor in use.

In the present example, once the barrier arrangement is open, the plug 120*b* is unconstrained within the first storage. However, in other cases, the plug 120*b* may be received by a guide for inhibiting return of the plug to the closed position after displacement of the plug. The guide may comprise a recess for receiving the plug 120*b*.

In the present example, the barrier arrangement remains permanently open after opening, as the plug 120*b* does not return to the tube 122*b*. However, in other examples, the barrier arrangement is selectively openable and closable by the user. This may be achieved by the plug (or another type of barrier arrangement) being fixed to an end portion of the member 115*b*, such that the member 115*b* is selectively exposable to the first storage 116*b*.

Once activated, and, in use, a user draws (or "sucks", or "pulls") on the mouthpiece 109*b* of the consumable 103*b*, which causes a drop in air pressure at the outlet 107*b*, thereby generating air flow through the inlet 106*b*, along the airflow passage 108*b*, out of the outlet 107*b* and into the user's mouth.

When the heater 112*b* is activated (by passing an electric current through the heating filament in response to the user drawing on the mouthpiece 109*b*) the e-liquid located in the wick 111*b* adjacent to the heating filament is heated and vaporized to form a vapor. The vapor condenses to form the second aerosol within the airflow passage 108*b*. Accordingly, the second aerosol is entrained in an airflow along the airflow flow passage 108*b* to the outlet 107*b* and ultimately out from the mouthpiece 109*b* for inhalation by the user when the user draws on the mouthpiece 109*b*. The substitute smoking device 100*b* supplies electrical current to the consumable electrical contacts 113*b*. This causes an electric current flow through the heating filament of the heater 112*b* and the heating filament heats up. As described, the heating of the heating filament causes vaporization of the e-liquid in the wick 111*b* to form the second aerosol.

As the air flows up through the airflow passage 108*b*, it encounters the aerosol generator portion 118*b*. The constriction of the airflow passage 108*b* caused by the aerosol generator portion 118*b* results in an increase in air velocity and corresponding decrease in air pressure in the airflow in the vicinity of the porous surface 118*b* of the aerosol generator portion 115*b*. The corresponding low pressure region causes the generation of the first (flavor) aerosol from the porous surface 118*b* of the aerosol generator portion 118*b*. The first (flavor) aerosol is entrained into the airflow and ultimately is output from the outlet 107*b* of the consumable 103*b* and thus from the mouthpiece 109*b* into the user's mouth.

The first aerosol is sized to inhibit pulmonary penetration. The first aerosol is formed of particles with a mass median aerodynamic diameter that is greater than or equal to 15 microns, in particular, greater than 30 microns, more particularly greater than 50 microns, yet more particularly greater than 60 microns, and even more particularly greater than 70 microns.

The first aerosol is sized for transmission within at least one of a mammalian oral cavity and a mammalian nasal cavity. The first aerosol is formed by particles having a maximum mass median aerodynamic diameter that is less than 300 microns, in particular less than 200 microns, yet more particularly less than 100 microns. Such a range of mass median aerodynamic diameter will produce aerosols which are sufficiently small to be entrained in an airflow caused by a user drawing air through the flavor element and to enter and extend through the oral and or nasal cavity to activate the taste and/or olfactory receptors. The second aerosol generated is sized for pulmonary penetration (i.e., to deliver an active ingredient such as nicotine to the user's lungs). The second aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapor.

The size of aerosol formed without heating is typically smaller than that formed by condensation of a vapor.

Figure 24:
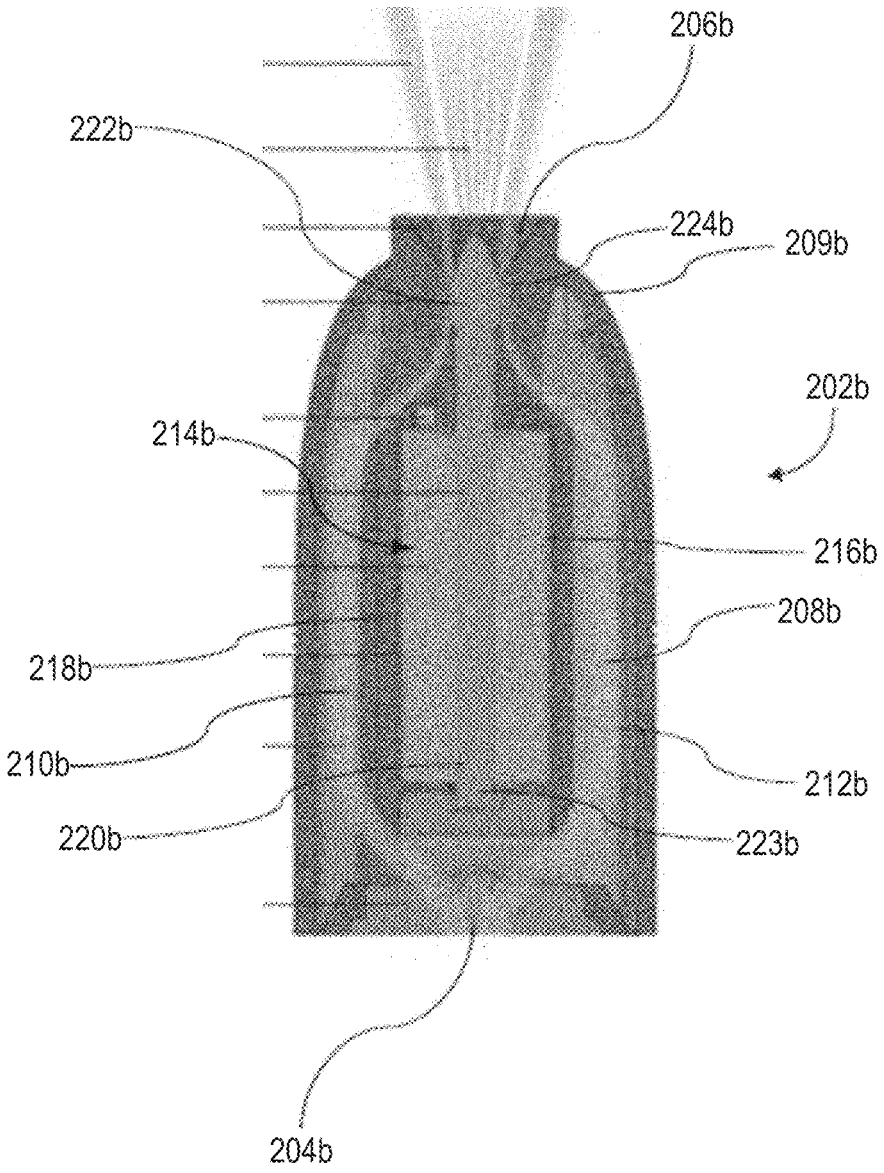
FIG. 24 shows a cross-sectional view of a flavor pod portion of a consumable of the second mode.
Figure 28:
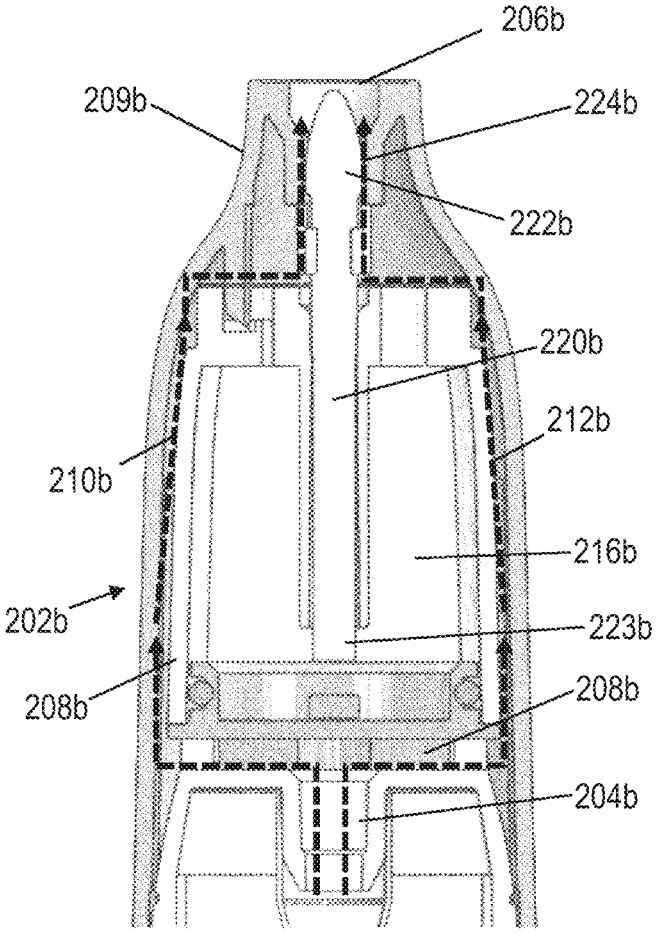
FIG. 28 a cross-sectional view of a flavor pod portion of a consumable of the second mode.

As a brief aside, it will be appreciated that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol. Referring to FIGS. 24 and 28, there is shown a flavor pod portion 202*b* of a consumable, the consumable providing an aerosol delivery device. The consumable further comprises a cartomiser portion (not shown in FIG. 24/28) having all of the features of the cartomiser portion 104*b* described above with respect to FIG. 23. However, in other examples, the consumable does not comprise the cartomiser portion, and provides only flavor to the user. The flavor pod portion 202*b* comprises an aerosol generator (also referred to as a "first aerosol generator"), which comprises an upstream (i.e., upstream with respect to flow of air in use) inlet 204*b* and a downstream (i.e., downstream with respect to flow of air in use) outlet 206*b*. Between and fluidly connecting the inlet 204*b* and the outlet 206*b* the flavor pod portion 204*b* comprises an airflow passage 208*b*. The airflow passage 208*b* comprises a first airflow branch 210*b* and a second airflow branch 212*b*, each of the first airflow branch 210*b* and the second airflow branch 212*b* fluidly interconnecting the inlet 204*b* and the outlet 206*b*. In other examples the airflow passage 208*b* may have an annular shape. The outlet 206*b* is located at the mouthpiece 209*b* of the consumable 103*b*, and is also referred to as a mouthpiece aperture 206*b*.

The flavor pod portion 202*b* comprises a storage 214*b*, which stores a first aerosol precursor (also referred to as an "aerosol precursor". The storage 214*b* comprises a reservoir 216*b* located within a chamber 218*b*.

The reservoir 216*b* is formed of a first porous material.

The aerosol generator comprises a member 220*b*, which comprises an aerosol generator portion 222*b* and a supporting portion 223*b*. The aerosol generator portion 222*b* is located at a downstream end (an upper end in FIG. 24) of the member 220*b*, while the supporting portion 223*b* makes up the rest of the member 220*b*. The supporting portion 223*b* is elongate and substantially cylindrical. The aerosol generator portion 222*b* is bulb-shaped, and comprises a portion which is wider than the supporting portion 223*b*. The aerosol generator portion 222*b* tapers to a tip at a downstream end of the aerosol generator portion 222*b*. The member 220*b* extends into and through the storage 214*b*. The member 220*b* is in contact with the reservoir 216*b*. More specifically, the supporting portion 223*b* extends into and through the storage 204*b* and is in contact with the reservoir 216*b*. The member 220*b* is located in a substantially central position within the reservoir 216*b* and is substantially parallel to a central axis of the consumable. The member 220*b* is formed of a second porous material. The first and second airflow branches 210*b*, 212*b* are located on opposite sides of the member 220*b*. Additionally, the first and second airflow branches 210*b*, 212*b* are located on opposite sides of the reservoir 216*b*. The first and second airflow branches 210*b*, 212*b* branch in a radial outward direction (with respect to the central axis of the consumable 200*b*) downstream of the inlet 204*b* to reach the opposite sides of the reservoir 216*b*. The aerosol generator portion 222*b* is located in the airflow passage 208*b* downstream of the first and second airflow branches 210*b*, 212*b*. The first and second airflow branches 210*b*, 212*b* turn in a radially inward direction to merge at the member 220*b*, at a point upstream of the aerosol generator portion 222*b*.

The aerosol generator portion 222*b* is located in a narrowing section 224*b* of the airflow passage 208*b*. The narrowing section 224*b* is downstream of the point at which the first and second airflow branches 210*b*, 212*b* merge, but upstream of the mouthpiece aperture 207*b*. The mouthpiece aperture 207*b* flares outwardly in the downstream direction, such that a width of the mouthpiece aperture 207*b* increases in the downstream direction.

In use, when a user draws on the mouthpiece 209*b*, air flow is generated through the air flow passage 208*b*. Air (comprising the second aerosol from the cartomiser portion as explained above with respect to FIG. 23) flows through the inlet 204*b* before the air flow splits to flow through the first and second airflow branches 210*b*, 212*b*. Further downstream, the first and second airflow branches 210*b*, 212*b* provide inward airflow towards the member 220*b* and the aerosol generator portion 222*b*.

As air flows past the aerosol generator portion in the narrowing section 224*b*, the velocity of the air increases, resulting in a drop in air pressure. This means that the air picks up the first aerosol precursor from the aerosol generator portion 222*b* to form the first aerosol. The first aerosol has the particle size and other properties described above with respect to FIG. 23.

As the first aerosol precursor is picked up by the air, the member 220*b* transfers further first aerosol precursor from the storage 214*b* to the aerosol generator portion 222*b*. More specifically, the member 220*b* wicks the first aerosol precursor from the storage 214*b* to the aerosol generator portion 223*b*.

In other examples, the storage 214*b* comprises a tank containing the first aerosol precursor as free liquid, rather than the reservoir 216*b* and the chamber 218*b*. In such examples, the member 220*b* still extends into the tank to transfer first aerosol precursor from the tank to the aerosol generator portion 223*b*.

Figures 25A, 25B:
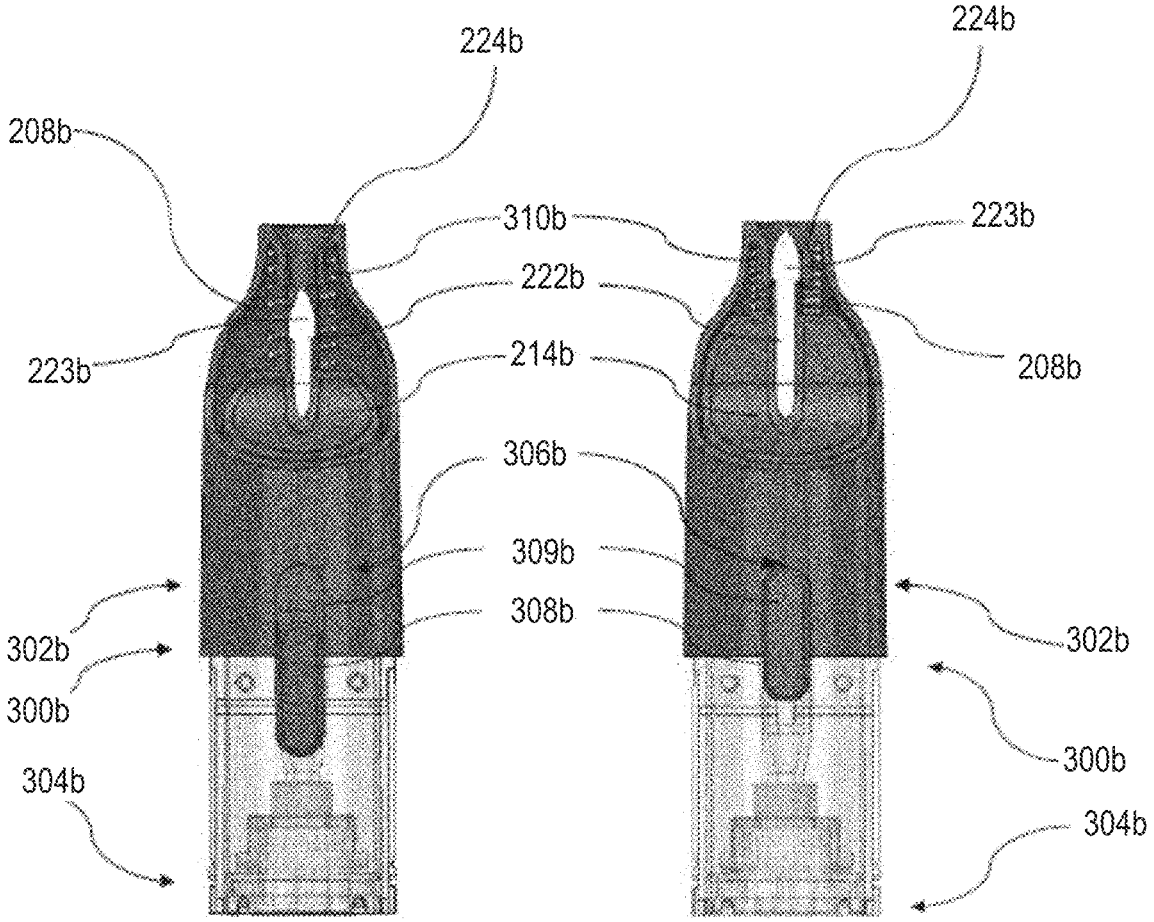
FIG. 25A shows a partial cutaway view of a consumable with an aerosol generator portion in a normal mode of the second mode.
FIG. 25B shows a partial cutaway view of a consumable with an aerosol generator portion in a boost mode of the second mode.

Referring to FIGS. 25A and 25B, there is shown a third consumable 300*b*. The third consumable 300*b* comprises a flavor pod portion 302*b* and a cartomiser portion 304*b*. The third consumable 300*b* comprises all of the features of the second consumable (and may also comprise all of the variations of the second consumable 200*b* described above), and only the differences are described here. For clarity many of the reference numerals are omitted from FIGS. 25A and 25B.

The flavor pod portion 302*b* further comprises a switching device 306*b*. The switching device 306*b* comprises a button 308*b* and a switching mechanism (not shown). The flavor pod portion 302*b* comprises a recess 309*b* for receiving the button 308*b*. The button 308*b* is located on an in use front face of the third consumable 300*b*. The button 308*b* is slidable within the recess 309*b* upwardly and downwardly (i.e., in a downstream direction towards and an upstream direction away from the mouthpiece 209*b*).

In other examples, the button may be slidable in a horizontal plane or may be a rotary switch. These options may help to prevent accidental removal of the third consumable 300*b*.

The switching mechanism connects the button 308*b* to the storage 214*b* and the member 222*b*. The switching device 306*b* further comprises a bias device, which is a spring 310*b*. The spring 310*b* is connected to the storage 214*b* and an underside of the mouthpiece 209*b*. The spring 310*b* is configured to push the storage 214*b* (and hence the member 222*b*) away from the mouthpiece 209*b*.

The third consumable 300*b* comprises an aerosol generator, which comprises all of the features of the first aerosol generator described above. FIG. 25A shows the aerosol generator portion 223*b* of the aerosol generator in a normal mode, while FIG. 25B shows the aerosol generator portion 223*b* in a boost mode.

In the boost mode, a larger area of the aerosol generator portion 223*b* is located in an aerosol generation region of the air flow passage 208*b* than is the case in the normal mode. The aerosol generation region of the air flow passage 208*b* may be defined as a region in which the velocity of air flow is sufficiently high to generate the first aerosol in use. In the present example, the aerosol generation region of the air flow passage 208*b* is the narrowing section 224*b*.

Additionally, in the boost mode, the aerosol generator portion 223*b* provides an increased area of constriction in the narrowing section 224*b* than is the case in the normal mode, which increases the velocity of airflow past the aerosol generator portion 223*b* in use compared to the normal mode.

Each of increasing the surface area of the aerosol generator portion 223*b* in the aerosol generation region and increasing the velocity of airflow past the aerosol generator portion 223*b* result in increased mass of first aerosol precursor in the first aerosol.

The button 308*b* therefore allows the user to provide relative movement between the aerosol generator portion 223*b* and the airflow passage 208*b*. This allows the user to vary/adjust a mass flow of aerosol precursor produced per delivery event (i.e., per puff taken by the user).

In the present example, the normal mode is the position in which the surface area of aerosol generator portion 223*b* located in the aerosol generation region is at a minimum. Additionally, the normal mode is the position in which the constriction in the narrowing section 224*b* is at a minimum.

In the present example, the boost mode is the position in which the surface area of aerosol generator portion 223*b* located in the aerosol generation region is at a maximum. Additionally, the boost mode is the position in which the constriction in the narrowing section 224*b* is at a maximum. In use, to switch the aerosol generator portion 223*b* from the normal mode to the boost mode, the user slides the button 308*b* in an upward direction (i.e., in a downstream direction and towards the mouthpiece). This effects relative movement between the aerosol generator portion 223*b* and the airflow passage 208*b*. More specifically, this effects sliding of the storage 214*b* and the member 222*b*. As the button slides in the upward direction, the aerosol generator portion 223*b* slides further into the narrowing section 224*b* until the boost mode position is reached.

The user may slide the button 308*b* to any extent between the normal mode and the boost mode, permitting continuous variation in position of the aerosol generation portion 223*b* and continuous variation in mass of first aerosol precursor per delivery event between the normal mode and the boost mode. In general, as the user pushes the button 308*b* upwards, the surface area of the aerosol generator portion 223*b* in the aerosol generation region (in this case the narrowing section 224*b*) increases. Additionally, as the user pushes the button 308*b* upwards, the aerosol generator portion 223*b* increases the area of constriction in the narrowing section 224*b*, thereby increasing the velocity of airflow past the aerosol generator portion 223*b*.

When the button 308*b* is released by the user, the spring 310*b* forces the aerosol generator portion 223*b* back into the normal mode.

In each of the normal mode and the boost mode (and any position of the aerosol generation portion 223*b* between the normal mode and the boost mode), the aerosol generator generally operates in the same way as the aerosol generator described above with respect to FIG. 24, with air flowing past the aerosol generator portion 223*b* to pick up aerosol precursor to generate aerosol during a delivery event when a user inhales.

In the present example, in the normal mode, the aerosol generator produces an aerosol comprises a first mass of aerosol precursor per delivery event. The first mass is less than 10 mg. More specifically, the first mass is less than 8 mg. More specifically, the first mass is less than 6 mg.

The first mass is at least 2 mg. More specifically, the first mass is at least 3 mg. More specifically, the first mass is at least 4 mg. More specifically, the first mass is substantially 5 mg.

In the boost mode, the aerosol generator produces an aerosol which comprises a second mass of aerosol precursor per delivery event. The second mass is greater than the first mass. The second mass is at least 10 mg. More specifically, the second mass is at least 12 mg. More specifically, the second mass is at least 14 mg. The second mass is not more than 20 mg. More specifically, the second mass is not more than 18 mg. More specifically, the second mass is not more than 16 mg. More specifically, the second mass is substantially 15 mg.

The second aerosol generator (or "additional aerosol generator") of the cartomiser portion continues to produce second aerosol (or "additional aerosol") comprising substantially the same mass of second aerosol precursor (or "additional aerosol precursor") per delivery event regardless of the mode of the aerosol generator and the position of the aerosol generator portion 223*b*.

In other examples, the switching device permits the aerosol generator portion 223*b* to be moved beyond the normal mode, to a position in which in the aerosol generator portion 223*b* has substantially zero surface area in the generation region. In this position, substantially zero aerosol precursor is produced during the delivery event, thereby providing an off mode.

Figure 29A:
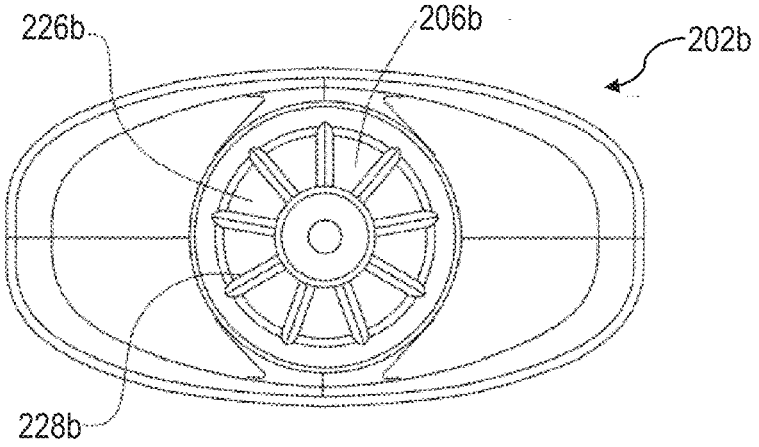
FIG. 29A shows a top view of a flavor pod portion of a consumable of the second mode.
Figure 29B:
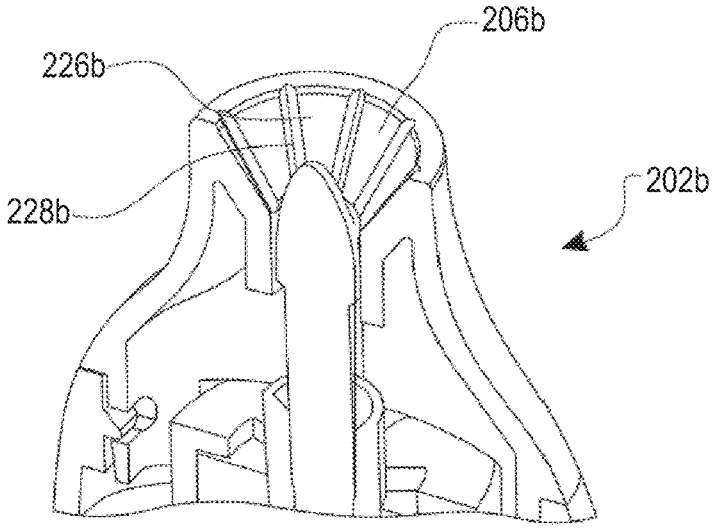
FIG. 29B shows a cut away perspective view of a flavor pod portion of a consumable of the second mode.

FIGS. 29A and 29B show further views of the flavor pod portion 202*b* which highlight features of the mouthpiece 209*b*. Many of the reference numerals of FIG. 28 are omitted from FIGS. 29A and 29B for clarity.

The mouthpiece aperture 206*b* comprises an inner surface 226*b*, which is uneven. In the present example, the inner surface 226*b* has the form of a substantially frustoconical surface, but includes grooves or channels 228*b* to make the inner surface 226*b* somewhat uneven. In other examples, the inner surface 226*b* may have another form (for example, the form a substantially cylindrical surface), and may include any type of protrusion or groove to make the inner surface uneven.

The inner surface 226*b* is angled with respect to an axial direction (i.e., relative to a central axis extending from a base of the consumable to the mouthpiece) such that the width of the mouthpiece aperture 209*b* increases in the downstream direction. The inner surface 226*b* is immediately downstream of the narrowing section 224*b* of the airflow passage 108*b*.

The grooves 228*b* are generally v-shaped in cross-sectional profile, and extend in the axial direction for the full length of the inner surface 226*b*. Each groove 228*b* is formed from a pair of surfaces angled at between 30 and 90 degrees relative to each other. More specifically, each groove 228*b* is formed from a pair of surfaces angled at 60 degrees relative to each other.

The grooves 228*b* have a depth (measured normal to the inner surface 226*b*) of at least 0.2 mm. More specifically, the grooves 228*b* have a depth of at least 0.3 mm. More specifically, the grooves 228*b* have a depth of at least 0.4 mm.

The grooves 228*b* have a depth of less than 0.8 mm. More specifically, the grooves have a depth of less than 0.7 mm. More specifically, the grooves have a depth of less than 0.6 mm.

More specifically, the grooves have a depth of substantially 0.5 mm.

The grooves 228*b* are substantially equi-spaced in a circumferential manner around the inner surface 226*b*. The inner surface 226*b* comprises at least 6 grooves. More specifically, the inner surface comprises at least 7 grooves. More specifically, the inner surface 226*b* comprises at least 8 grooves.

The inner surface 226*b* comprises at most 12 grooves 228*b*. More specifically, the inner surface 226*b* comprises at most 11 grooves 228*b*. More specifically, the inner surface 226*b* comprises at most 10 grooves 228*b*.

More specifically, the inner surface 226*b* comprises 9 grooves 228*b*.

The grooves 228*b* are spaced apart from each other by substantially 1 mm at the downstream end of the inner surface 226*b*. In other examples, the spacing at the downstream end of grooves or protrusions may be selected such that it is equal to or less than the mass median diameter (as described above) of particles in the first aerosol.

The inner surface 226*b* comprises a smooth polished surface between the grooves 228*b*. Polishing the surface in this way provides improved aerodynamic properties. However, in other examples, the inner surface 226*b* may be textured. In such examples, the texture of the surface may provide the uneven surface, and no grooves are required, In use, the uneven nature of the inner surface 226*b* makes it easier for droplets to form on the inner surface 226*b*, preventing large droplets from entering the user's mouth. The grooves 228*b* help to channel the large droplets back into the consumable.

Third Mode: An Aerosol Delivery Device Comprising an Aerosol Airflow Stream and a Separate Airflow Stream Aspects and embodiments of the third mode will now be discussed with reference to the accompanying figures. Further aspects and embodiments of the third mode will be apparent to those skilled in the art. All documents mentioned in this text are incorporated herein by reference.

Figure 30:
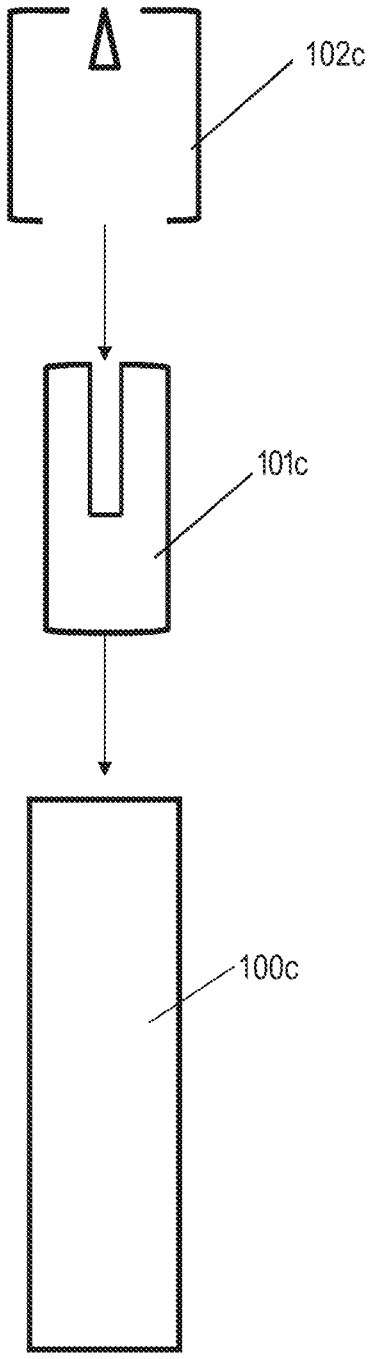
FIG. 30 shows a schematic drawing of a smoking substitute device of the third mode.
Figure 31:
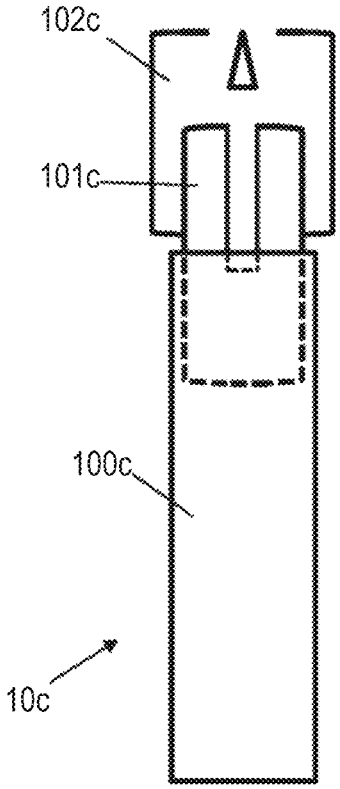
FIG. 31 shows a schematic drawing of a smoking substitute device of the third mode.

Referring to FIG. 30 and FIG. 31, there is shown a smoking substitute device 10*c*. In this example, the smoking substitute device comprises a cartomiser 101*c* and a flavor pod 102*c* connected to a base unit 100*c*. In this example, the base unit 100*c* includes elements of the smoking substitute device such as a battery, an electronic controller, and a pressure transducer. The cartomiser 101*c* may engage with the base unit 100*c* via a push-fit engagement, a screw-thread engagement, or a bayonet fit, for example. A cartomiser may also be referred to as a "pod". The smoking substitute device can include an aerosol delivery device according to the present disclosure.

The flavor pod 102*c* is configured to engage with the cartomiser 101*c* and thus with the base unit 100*c*. The flavor pod 102*c* may engage with the cartomiser 101*c* via a push-fit engagement, a screw-thread engagement, or a bayonet fit, for example. FIG. 31 illustrates the cartomiser 101*c* engaged with the base unit 100*c*, and the flavor pod 102*c* engaged with the cartomiser 101*c*. As will be appreciated, in this example, the cartomiser 101*c* and the flavor pod 102*c* are distinct elements. Each of the cartomiser 101*c* and the flavor pod may be an aerosol delivery device according to the present disclosure.

As will be appreciated from the following description, the cartomiser 101*c* and the flavor pod 102*c* may alternatively be combined into a single component that implements the functionality of the cartomiser 101*c* and flavor pod 102*c*. Such a single component may also be an aerosol delivery device according to the present disclosure. In other examples, the cartomiser may be absent, with only a flavor pod 102*c* present.

A "consumable" component may mean that the component is intended to be used once until exhausted, and then disposed of as waste or returned to a manufacturer for reprocessing.

Figure 32:
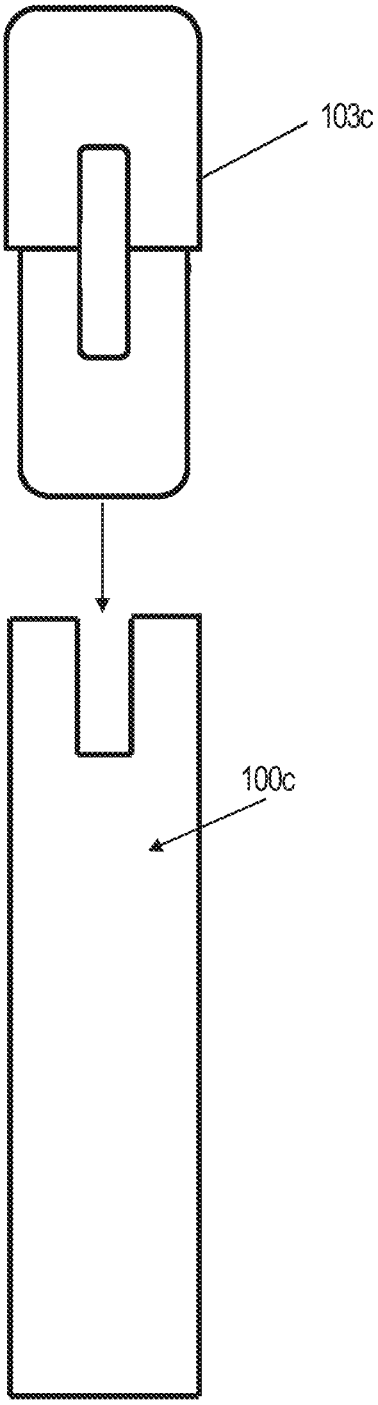
FIG. 32 shows a schematic drawing of a smoking substitute device of the third mode.
Figure 33:
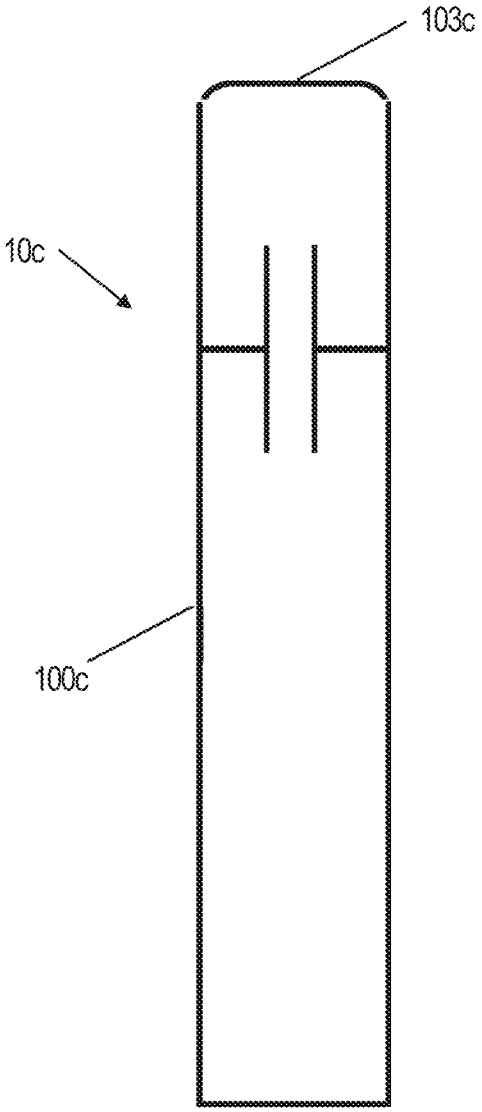
FIG. 33 shows a schematic drawing of a smoking substitute device of the third mode.

Referring to FIG. 32 and FIG. 33, there is shown a smoking substitute device comprising a base unit 100*c* and a consumable 103*c*. The consumable 103*c* combines the functionality of the cartomiser 101*c* and the flavor pod 102*c*. In FIG. 32, the consumable 103*c* and the base unit 100*c* are shown separated from one another. In FIG. 33, the consumable 103*c* and the base unit 100*c* are engaged with each other to form the smoking substitute device 10*c*.

Figure 34:
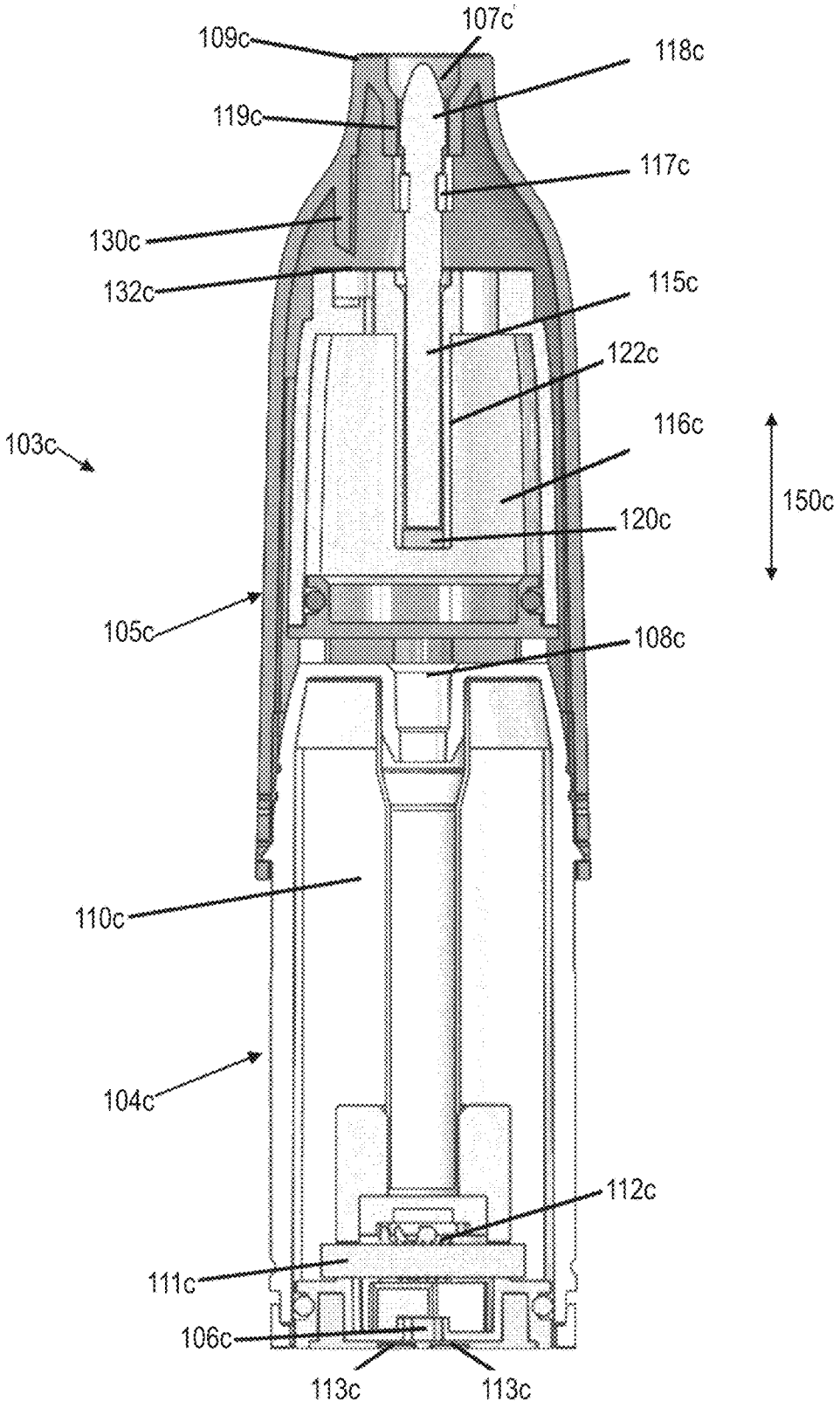
FIG. 34 shows a cross-sectional view of a consumable in a deactivated state of the third mode.

Referring to FIG. 34, there is shown a consumable 103*c* engageable with a base unit via a push-fit engagement in a deactivated state. The consumable 103*c* may be considered to have two portions—a cartomiser portion 104*c* and a flavor pod portion 105*c*, both of which are located within a single component (as in FIG. 32 and FIG. 33).

The consumable 103*c* includes an upstream airflow inlet 106*c* and a downstream airflow outlet 107*c*. In other examples a plurality of inlets and/or outlets are included. Between and fluidly connecting the inlet 106*c* and the outlet 107*c* there is an airflow passage 108*c*. The outlet 107*c* is located at the mouthpiece 109*c* of the consumable 103*c*, and is formed by a mouthpiece aperture.

As above, the consumable 103*c* includes a flavor pod portion 105*c*. The flavor pod portion 105*c* is configured to generate a first (flavor) aerosol for output from the outlet 107*c* of the mouthpiece 109*c* of the consumable 103*c*. The flavor pod portion 105*c* of the consumable 103*c* includes a member 115*c*. The member 115*c* acts as a passive aerosol generator (e.g., an aerosol generator which does not use heat to form the aerosol, also referred to as a "first aerosol generator" in this example), and is formed of a porous material. The member 115*c* comprises a supporting portion 117*c*, which is located inside a housing, and an aerosol generator portion 118*c*, which is located in the airflow passage 108*c*. In this example, the aerosol generator portion 118*c* is a porous nib.

When activated, as discussed in more detail below, a first storage 116*c* (in this example a tank) for storing a first aerosol precursor (i.e., a flavor liquid) is fluidly connected to the member 115*c*. The porous nature of the member 115*c* means that flavor liquid from the first storage 116*c* is drawn into the member 115*c*. As the first aerosol precursor in the member 115*c* is depleted in use, further flavor liquid is drawn from the first storage 116*c* into the member 115*c* via a wicking action. Before activation, the first storage 116*c* is fluidly isolated from the member 115*c*. In this example, the isolation is achieved via plug 120*c* (preferably formed from silicon) located at one end of a conduit 122*c* containing the member 115*c*. In other examples, the plug may be replaced by any one of: a duck bill valve; a split valve or diaphragm; or a sheet of foil. The first storage 116*c* further includes a pressure relief opening 132*c*, which in the deactivated state is sealed by a pierceable cover (preferably made from foil). Piercing member 130*c*, which is formed as a part of the mouthpiece 109*c* and may take the form of a blade, pierces the pierceable cover and opens the pressure relief opening 132*c* when the consumable is moved to the activated state (as is discussed in more detail below).

As described above, the aerosol generator portion 118*c* is located within the airflow passage 108*c* through the consumable 103*c*. The aerosol generator portion 118*c* therefore constricts or narrows the airflow passage 108*c*. The aerosol generator portion 118*c* occupies some of the area of the airflow passage, resulting in constriction of the airflow passage 108*c*. The airflow passage 108*c* is narrowest adjacent to the aerosol generator portion 118*c*. Since the constriction results in increased air velocity and corresponding reduction in air pressure at the aerosol generator portion 118*c*, the constriction is a Venturi aperture 119*c*. The constriction is generally toroidal in shape, and may include one or more intersections where supports contact the aerosol generator portion 118*c*.

The cartomiser portion 104*c* of the consumable 103*c* includes a second storage 110*c* (in this example a tank) for storing a vapor precursor (i.e., e-liquid, which may contain nicotine). Extending into the second storage 110*c* is a wick 111*c*. The wick 111*c* is formed from a porous wicking material (e.g., a polymer) that draws vapor precursor from the second storage 110*c* into a central region of the wick 111*c* that is located outside the e-liquid storage tank 110*c*.

A heater 112*c* is a configured to heat the central region of the wick 111*c*. The heater 112*c* includes a resistive heating filament that is coiled around the central region of the wick 111*c*. The wick 111*c*, the heater 112*c* and the e-liquid storage tank 110*c* together act as an active aerosol generator (i.e., an aerosol generator which uses heat to form the aerosol, referred to as a "second aerosol generator" in this example).

As described above, the first and second aerosol generators are both at least partially located within the airflow passage 108*c*, with the first aerosol generator downstream (with respect to air flow in use) of the second aerosol generator.

So that the consumable 103*c* may be supplied with electrical power for activation of the heater 112*c*, the consumable 103*c* includes a pair of consumable electrical contacts 113*c*. The consumable electrical contacts 113*c* are configured for electrical connection to a corresponding pair of electrical supply contacts in the base unit 100*c*. The consumable electrical contacts 113*c* are electrically connected to the electrical supply contacts 114*c* when the consumable 103*c* is engaged with the base unit 100*c*. The base unit 100*c* includes an electrical power source (not shown), for example a battery.

Figure 35:
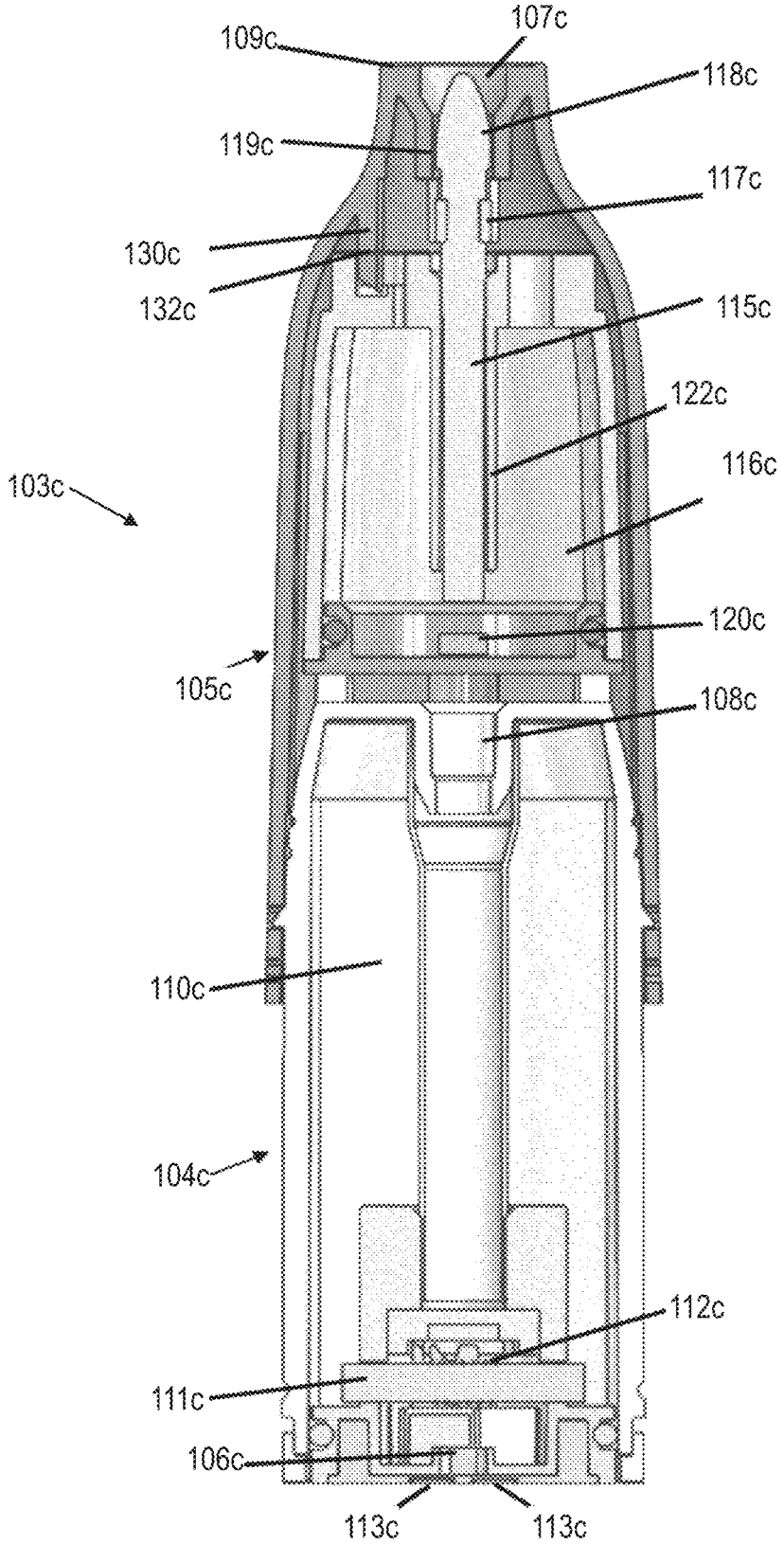
FIG. 35 shows a cross-sectional view of the consumable of FIG. 34 in an activated state of the third mode.

FIG. 35 shows the consumable 103*c* of FIG. 34 in an activated state, like features are indicated by like reference numerals. To transition from the deactivated state to the activated state, mouthpiece 109*c* is moved along a central axis 150*c* towards cartomizer portion 104*c* (e.g., one along which the consumable extends, and along which member 115*c* extends). The mouthpiece 109*c*, via supporting portion 117*c*, is fixed to the member 115*c* and therefore member 115*c* moves with the mouthpiece 109*c*. The mouthpiece 109*c*, and member 115*c*, is moved relative to the tank 116*c*. Piercing member 130*c* therefore contacts, and pierces, pressure relief opening 132*c* thereby fluidly connecting the airflow passage 108*c* to an interior of the first storage 116*c*. Further, member 115*c* pushes on, and moves, plug 120*c* out of the conduit 122*c* which then allows member 115*c* to fluidly connect with the first aerosol precursor stored in the first storage 116*c*. The plug 120*c* may then be unconstrained within the first storage, or may be pushed by member 115*c* into a holding location.

Once activated, and in use, a user draws (or "sucks", "pulls", or "puffs") on the mouthpiece 109*c* of the consumable 103*c*, which causes a drop in air pressure at the outlet 107*c*, thereby generating air flow through the inlet 106*c*, along the airflow passage 108*c*, out of the outlet 107*c* and into the user's mouth.

When the heater 112*c* is activated (by passing an electric current through the heating filament in response to the user drawing on the mouthpiece 109*c*, the drawing of air may be detected by a pressure transducer) the e-liquid located in the wick 111*c* adjacent to the heating filament is heated and vaporized to form a vapor. The vapor condenses to form the second aerosol within the airflow passage 108*c*. Accordingly, the second aerosol is entrained in an airflow along the airflow flow passage 108*c* to the outlet 107*c* and ultimately out from the mouthpiece 109*c* for inhalation by the user when the user draws on the mouthpiece 109*c*.

The base unit 100*c* supplies electrical current to the consumable electrical contacts 113*c*. This causes an electric current flow through the heating filament of the heater 112*c* and the heating filament heats up. As described, the heating of the heating filament causes vaporization of the e-liquid in the wick 111*c* to form the second aerosol. As the air flows up through the airflow passage 108*c*, it encounters the aerosol generator portion 118*c*. The constriction of the airflow passage 108*c* caused by the aerosol generator portion 118*c* results in an increase in air velocity and corresponding decrease in air pressure in the airflow in the vicinity of the porous surface 118*c* of the aerosol generator portion 115*c*. The corresponding low pressure and high air velocity region causes the generation of the first (flavor) aerosol from the porous surface 118*c* of the aerosol generator portion 118*c*. The first (flavor) aerosol is entrained into the airflow and ultimately is output from the outlet 107*c* of the consumable 103*c* and thus from the mouthpiece 109*c* into the user's mouth.

The first aerosol is sized to inhibit pulmonary penetration. The first aerosol is formed of particles with a mass median aerodynamic diameter that is greater than or equal to 15 microns, in particular, greater than 30 microns, more particularly greater than 50 microns, yet more particularly greater than 60 microns, and even more particularly greater than 70 microns.

The first aerosol is sized for transmission within at least one of a mammalian oral cavity and a mammalian nasal cavity. The first aerosol is formed by particles having a maximum mass median aerodynamic diameter that is less than 300 microns, in particular less than 200 microns, yet more particularly less than 100 microns. Such a range of mass median aerodynamic diameter will produce aerosols which are sufficiently small to be entrained in an airflow caused by a user drawing air through the flavor element and to enter and extend through the oral and or nasal cavity to activate the taste and/or olfactory receptors.

The second aerosol generated is sized for pulmonary penetration (i.e., to deliver an active ingredient such as nicotine to the user's lungs). The second aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapor.

The size of aerosol formed without heating is typically smaller than that formed by condensation of a vapor. As a brief aside, it will be appreciated that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol.

Figure 36:
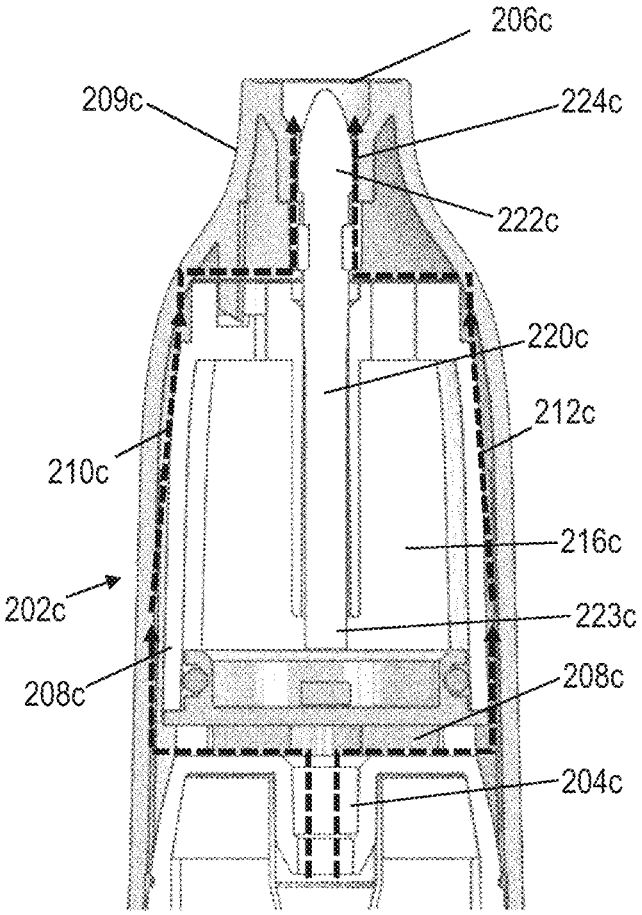
FIG. 36 a cross-sectional view of a flavor pod portion of a consumable of the third mode.

Referring to FIG. 36, there is shown a flavor pod portion 202*c* of a consumable in an activated state, the features of which may be provided in an aerosol delivery device in accordance with the invention. The consumable further comprises a cartomiser portion (not shown in FIG. 36) having all of the features of the cartomiser portion 104*c* described above with respect to FIGS. 34 and 35. However, in other examples, the consumable does not comprise the cartomiser portion, and provides only flavor to the user.

The flavor pod portion 202*c* comprises an upstream (i.e., upstream with respect to flow of air in use) inlet 204*c* and a downstream (i.e., downstream with respect to flow of air in use) outlet 206*c*. Between and fluidly connecting the inlet 204*c* and the outlet 206*c* the flavor pod portion 204*c* comprises an airflow passage 208*c*. The airflow passage 208*c* comprises a first airflow branch 210*c* and a second airflow branch 212*c*, each of the first airflow branch 210*c* and the second airflow branch 212*c* fluidly connecting the inlet 204*c* and the outlet 206*c*. In other examples the airflow passage 208*c* may have an annular shape. The outlet 206*c* is located at the mouthpiece 209*c* of the consumable 103*c*, and is also referred to as a mouthpiece aperture 206*c*. The flavor pod portion 202*c* comprises a storage 214*c*, which stores a first aerosol precursor. The storage 214*c* comprises a reservoir 216*c* located within a chamber 218*c*. The reservoir 216*c* is formed of a first porous material.

The flavor pod portion 202*c* comprises a member 220*c*, which comprises an aerosol generator portion 222*c* and a supporting portion 223*c*. The aerosol generator portion 222*c* is located at a downstream end (an upper end in FIG. 35) of the member 220*c*, while the supporting portion 223*c* makes up the rest of the member 220*c*. The supporting portion 223*c* is elongate and substantially cylindrical. The aerosol generator portion 222*c* is bulb-shaped, and comprises a portion which is wider than the supporting portion 223*c*. The aerosol generator portion 222*c* tapers to a tip at a downstream end of the aerosol generator portion 222*c*.

The member 220*c* extends into and through the storage 214*c*. The member 220*c* is in contact with the reservoir 216*c*. More specifically, the supporting portion 223*c* extends into and through the storage 204*c* and is in contact with the reservoir 216*c*. The member 220*c* is located in a substantially central position within the reservoir 216*c* and is substantially parallel to a central axis of the consumable. The member 220*c* is formed of a second porous material.

The first and second airflow branches 210*c*, 212*c* are located on opposite sides of the member 220*c*. Additionally, the first and second airflow branches 210*c*, 212*c* are located on opposite sides of the reservoir 216*c*. The first and second airflow branches 210*c*, 212*c* branch in a radial outward direction (with respect to the central axis of the consumable 200*c*) downstream of the inlet 204*c* to reach the opposite sides of the reservoir 216*c*.

The aerosol generator portion 222*c* is located in the airflow passage 208*c* downstream of the first and second airflow branches 210*c*, 212*c*. The first and second airflow branches 210*c*, 212*c* turn in a radially inward direction to merge at the member 220*c*, at a point upstream of the aerosol generator portion 222*c*.

The aerosol generator portion 222*c* is located in a narrowing section 224*c* of the airflow passage 208*c*. The narrowing section 224*c* is downstream of the point at which the first and second airflow branches 210*c*, 212*c* merge, but upstream of the mouthpiece aperture 207*c*. The mouthpiece aperture 207*c* flares outwardly in the downstream direction, such that a width of the mouthpiece aperture 207*c* increases in the downstream direction.

In use, when a user draws on the mouthpiece 209*c*, air flow is generated through the air flow passage 208*c*. Air (comprising the second aerosol from the cartomiser portion as explained above with respect to FIG. 34) flows through the inlet 204*c* before the air flow splits to flow through the first and second airflow branches 210*c*, 212*c*. Further downstream, the first and second airflow branches 210*c*, 212*c* provide inward airflow towards the member 220*c* and the aerosol generator portion 222*c*.

As air flows past the aerosol generator portion in the narrowing section 224*c*, the velocity of the air increases, resulting in a drop in air pressure. This means that the air picks up the first aerosol precursor from the aerosol generator portion 222*c* to form the first aerosol. The first aerosol has the particle size and other properties described above with respect to FIG. 34. As the first aerosol precursor is picked up by the air, the member 220*c* transfers further first aerosol precursor from the storage 214*c* to the aerosol generator portion 222*c*. More specifically, the member 220*c* wicks the first aerosol precursor from the storage 214*c* to the aerosol generator portion 224*c*.

In other examples, the storage 214*c* comprises a tank containing the first aerosol precursor as free liquid, rather than the reservoir 216*c* and the chamber 218*c*. In such examples, the member 220*c* still extends into the tank to transfer first aerosol precursor from the tank to the aerosol generator portion 224*c*.

Figure 37A:
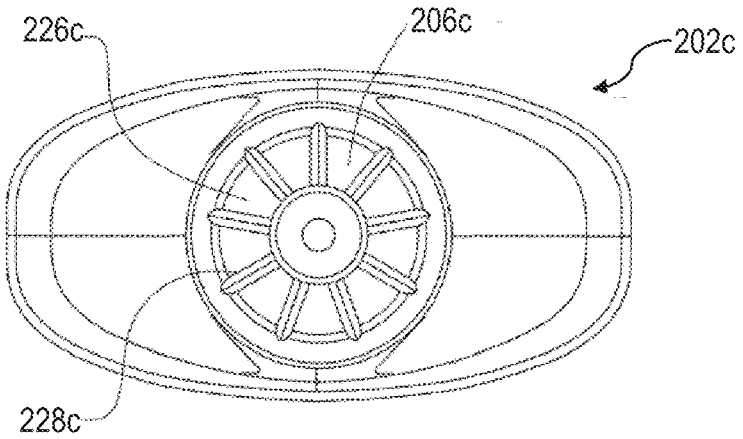
FIG. 37*a* shows a top view of a flavor pod portion of a consumable of the third mode.
Figure 37B:
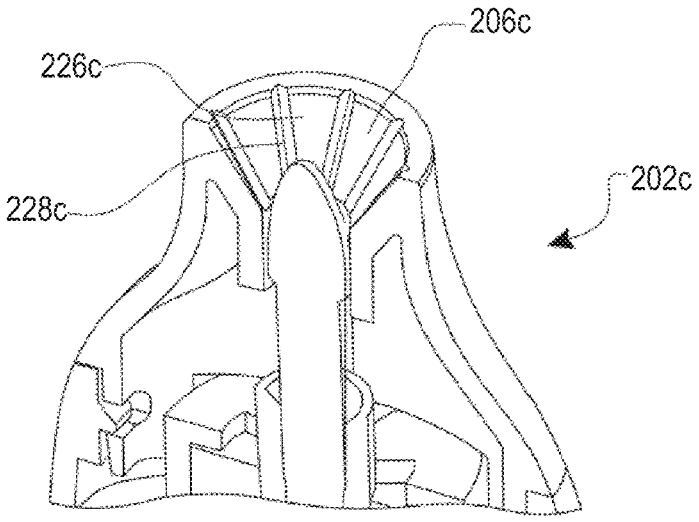
FIG. 37*b* shows a cut away perspective view of a flavor pod portion of a consumable of the third mode.

FIGS. 37A and 37B show further views of the flavor pod portion 202*c* which highlight features of the mouthpiece 209*c*. Many of the reference numerals of FIG. 36 are omitted from FIGS. 37A and 37B for clarity.

The mouthpiece aperture 206*c* comprises an inner surface 226*c*, which is uneven. In the present example, the inner surface 226*c* has the form of a substantially frustoconical surface, but includes grooves or channels 228*c* to make the inner surface 226*c* somewhat uneven. In other examples, the inner surface 226*c* may have another form (for example, the form a substantially cylindrical surface), and may include any type of protrusion or groove to make the inner surface uneven.

The inner surface 226*c* is angled with respect to an axial direction (i.e., relative to a central axis extending from a base of the consumable to the mouthpiece) such that the width of the mouthpiece aperture 209*c* increases in the downstream direction. The inner surface 226*c* is immediately downstream of the narrowing section 224*c* of the airflow passage 108*c*.

The grooves 228*c* are generally v-shaped in cross-sectional profile, and extend in the axial direction for the full length of the inner surface 226*c*. Each groove 228*c* is formed from a pair of surfaces angled at between 30 and 90 degrees relative to each other. More specifically, each groove 228*c* is formed from a pair of surfaces angled at 60 degrees relative to each other.

The grooves 228*c* have a depth (measured normal to the inner surface 226*c*) of at least 0.2 mm. More specifically, the grooves 228*c* have a depth of at least 0.3 mm. More specifically, the grooves 228*c* have a depth of at least 0.4 mm.

The grooves 228*c* have a depth of less than 0.8 mm. More specifically, the grooves have a depth of less than 0.7 mm. More specifically, the grooves have a depth of less than 0.6 mm.

More specifically, the grooves have a depth of substantially 0.5 mm.

The grooves 228*c* are substantially equi-spaced in a circumferential manner around the inner surface 226*c*. The inner surface 226*c* comprises at least 6 grooves. More specifically, the inner surface comprises at least 7 grooves. More specifically, the inner surface 226*c* comprises at least 8 grooves.

The inner surface 226*c* comprises at most 12 grooves 228*c*. More specifically, the inner surface 226*c* comprises at most 11 grooves 228*c*. More specifically, the inner surface 226*c* comprises at most 10 grooves 228*c*.

More specifically, the inner surface 226*c* comprises 9 grooves 228*c*.

The grooves 228*c* are spaced apart from each other by substantially 1 mm at the downstream end of the inner surface 226*c*. In other examples, the spacing at the downstream end of grooves or protrusions may be selected such that it is equal to or less than the mass median diameter (as described above) of particles in the first aerosol.

The inner surface 226*c* comprises a smooth polished surface between the grooves 228*c*. Polishing the surface in this way provides improved aerodynamic properties. However, in other examples, the inner surface 226*c* may be textured. In such examples, the texture of the surface may provide the uneven surface, and no grooves are required, In use, the uneven nature of the inner surface 226*c* makes it easier for droplets to form on the inner surface 226*c*, preventing large droplets from entering the user's mouth. The grooves 228*c* help to channel the large droplets back into the consumable.

Figure 38:
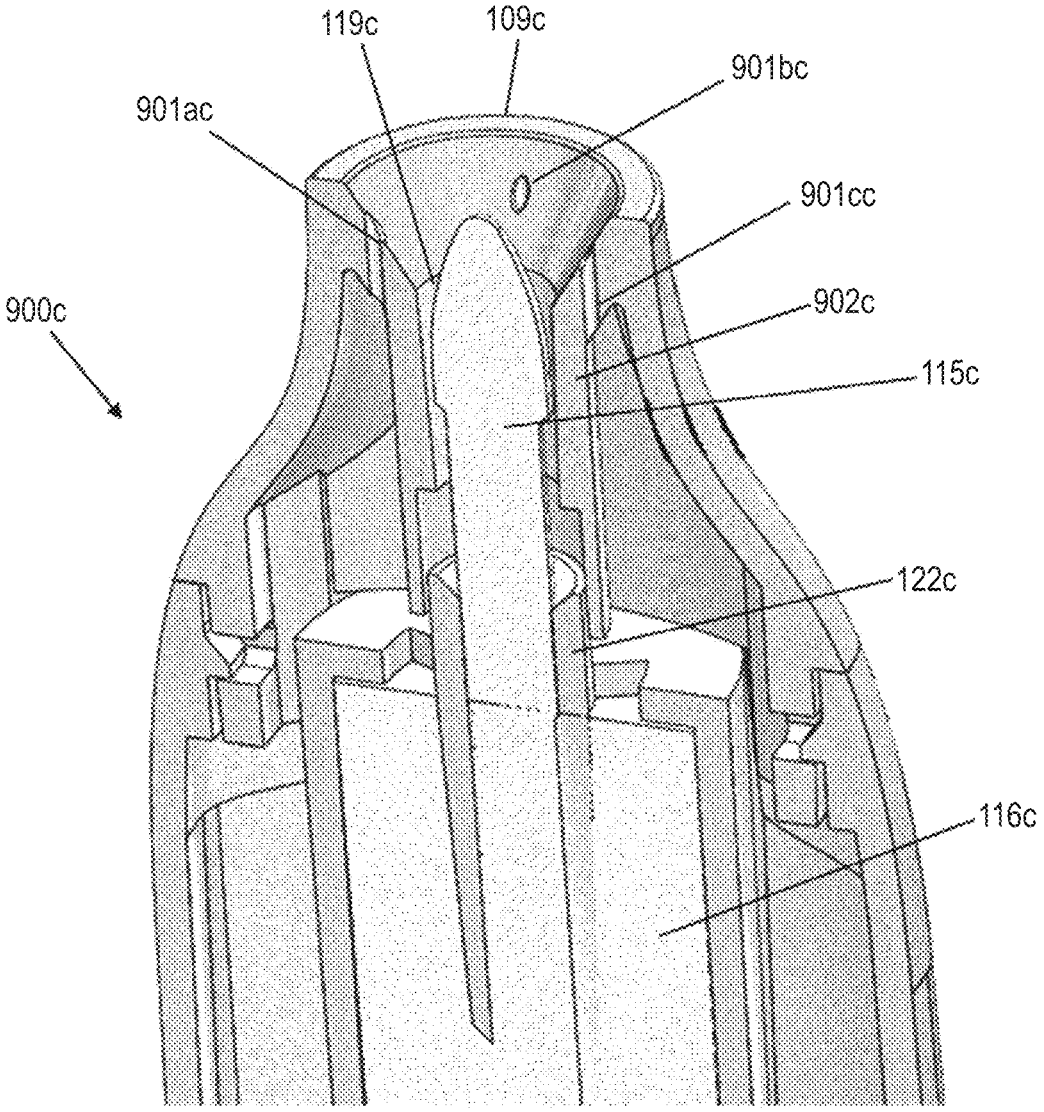
FIG. 38 shows a cut away perspective view of a flavor pod according to the present invention of the third mode.

Referring to FIG. 38, there is shown a flavor pod portion 900*c* of a consumable in an activated state. The consumable further comprises a cartomiser portion (not shown in FIG. 38) having all of the features of the cartomiser portion 104*c* described above with reference to FIG. 34 and FIG. 35. The flavor pod portion 900*c* shares features with the flavor pod portion 202*c* shown in FIG. 36, notably including the plug 120*c* forming an activation mechanism as described above.

In contrast to the flavor pod portion shown in FIG. 36 however, the airflow path for the vapor generated by cartomiser portion 104*c* does not interact with porous member 115*c*. Instead, the airflow path passes through air outlet holes 901*ac*-901*cc* formed in the mouthpiece 109*c*. A cylindrical retaining wall 902*c* is provided between the porous member 115*c* and the airflow paths for the vapor thereby separating the two. The cylindrical retaining wall 902*c* includes conduit 122*c*, which forms an interference fit with the porous member 115*c*. The airflow path therefore bypasses the porous member 118*c*. The interference fit is sufficient to cause imped or halt the flow of air between the porous member 115*c* and the conduit 122*c*, but is loose enough that the user can slide the porous member 115*c* relative to the conduit in order to dislodge plug 120*c* and thereby activate the flavor pod portion. Asides from this, the porous member 118*c* functions in the manner described previously. Airflow, in this case not containing vapor from the cartomiser, passes over the porous member 118*c* and picks up aerosol precursor stored in the first storage 116*c*. The aerosol containing airflow and the vapor containing airflow mix within the mouthpiece 109*c* for delivery to the user.

Figure 39:
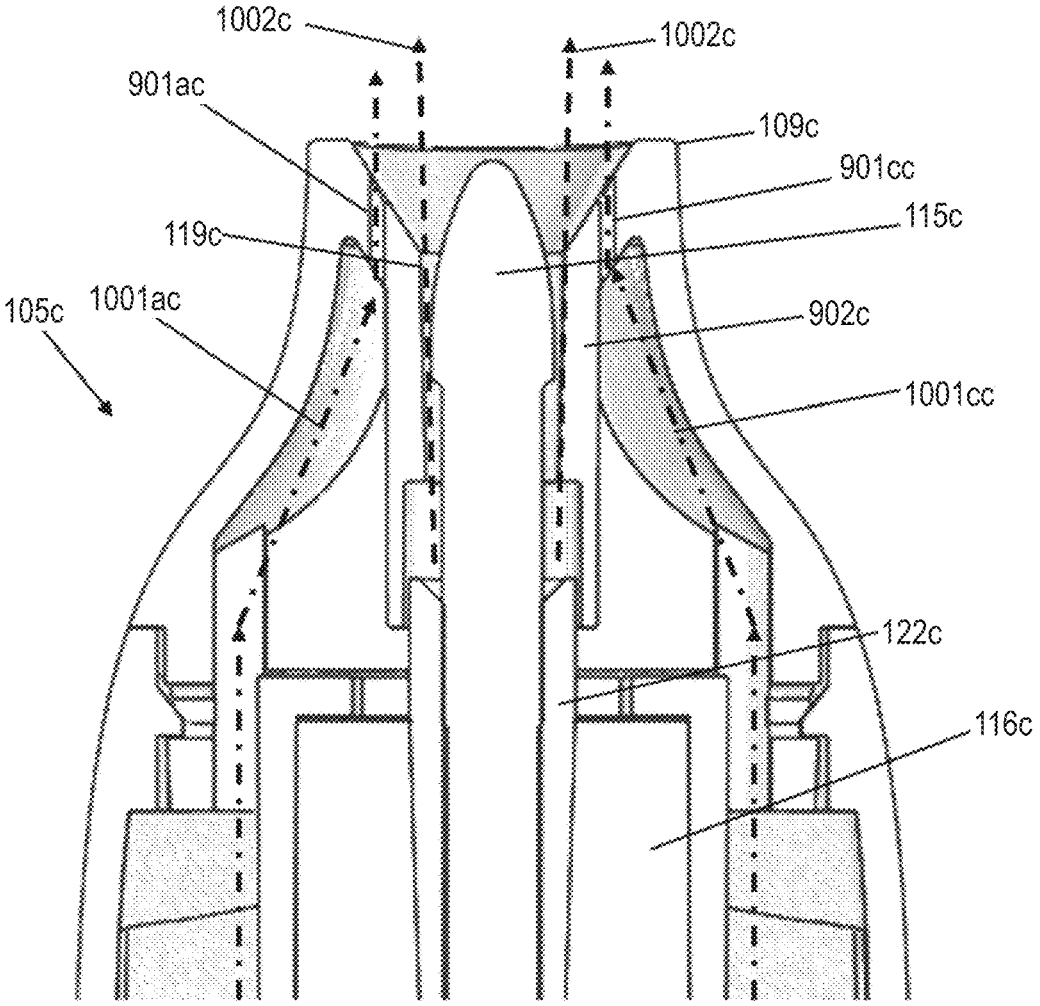
FIG. 39 shows a cross-sectional view of the flavor pod of FIG. 38.

These airflow paths are shown more clearly in FIG. 39, which is a cross-sectional view of the flavor pod portion 900*c* shown in FIG. 38. The first airflow path 1002*c* starts at a point within the cylindrical retaining wall 902*c*, distal to the mouthpiece 109*c*, and passes between an inner surface of the cylindrical retaining wall and the porous member 115*c* before exiting into the mouthpiece 109*c*. The first airflow has a substantially ring-shaped cross-sectional profile when viewed from the mouthpiece.

In contrast, the second airflow path, comprising portions 1001*ac*-1001*cc* pass around an outer portion of the first storage 116*c* (originating from the cartomiser or vapor generator located below first storage 116*c*). It then passes through each of the air outlet holes 901*ac*-901*cc*, before mixing with the first airflow path in the mouthpiece 109*c*. Airflow portion 1001*bc*, not shown, passes through air outlet hole 901*bc* shown in FIG. 38.

Therefore, the airflow providing the nicotine containing vapor is separated from the airflow providing the flavor containing aerosol until such a time as the two meet within mouthpiece 109*c*.

Figure 40:
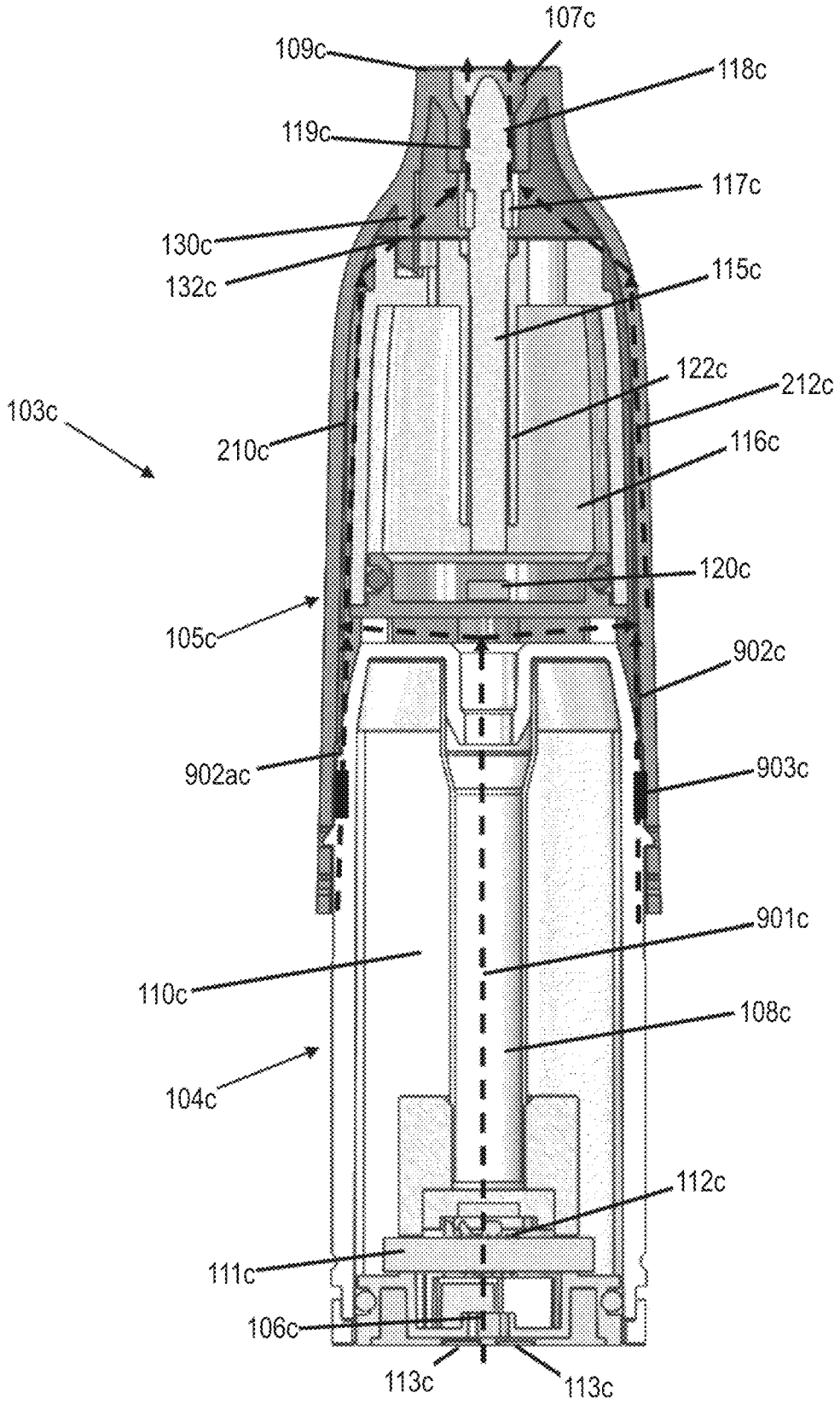
FIG. 40 shows a cross-section of the consumable of FIG. 35.

FIG. 40 is a further view of the consumable of FIG. 35, in the activated state. In this figure, a first airflow path 901*cc* is shown, which extends from an inlet of the cartomiser portion 104*c*, through coil 112*c* and wick 111*c* assembly and up through airflow passage 108*c* as described previously with reference to FIG. 35. However, in addition to this airflow path, one or more bypass or supplementary airflow paths 902*ac*, 902*bc* are shown. This bypass airflow path extends between an outer region of the cartomiser portion 104*c* and an inner surface of the housing of the flavor pod portion 105*c* as shown. The bypass airflow passes through a truncated O-ring 903*c* as discussed in more detail below, and blends with vapor containing air following the first airflow path 901*c*. Subsequently, the bypass air and vapor containing air both follow the first airflow branch 210*c* or second airflow branch 212*c* discussed previously. The truncated O-ring seals the cartomiser portion 104*c* to the housing of the flavor pod portion 105*c*, asides from the regions which provide the bypass channel. As can be seen in FIG. 40, a portion of the housing of the flavor pod portion 105*c* extends around an outer surface of the cartomiser portion 104*c*. The O-ring is located then between the extending portion of the flavor pod portion and the cartomiser portion.

Figure 41:
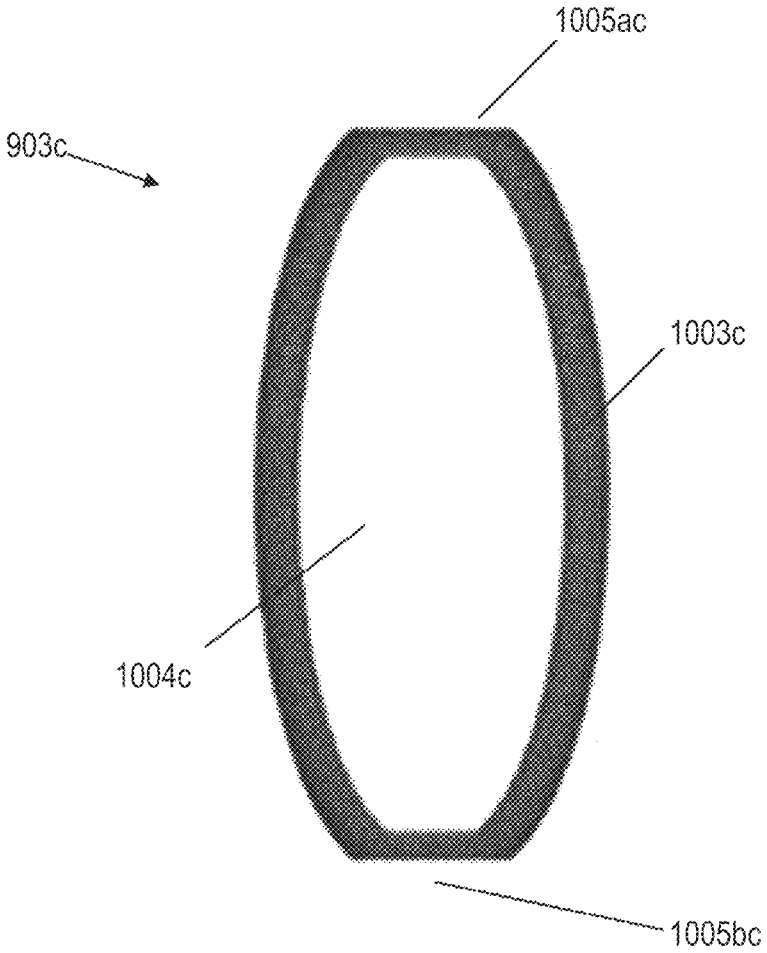
FIG. 41 shows a top view of a truncated O-ring used in the consumable of FIG. 34, FIG. 35, and FIG. 38.

The truncated O-ring 903*c* is shown in more detail in FIG. 41. The truncated O-ring is located between the flavor pod portion and the cartomizer portion, and is formed by ring

1003*c* providing aperture 1004*c* in which the cartomiser sits. The ring is generally ovoid in shape, but truncated at either end as shown. The result is a truncated O-ring which follows the curvature of the cartomizer portion on two sides, but has two flat regions on two other opposing sides. These flat regions provide bypass channels 1005*ac* and 1005*bc* through the truncated O-ring. This structure of O-ring can allow a 50/50 split in airflow between the bypass/supplementary flow path(s) 902*ac*, 902*bc* and the first airflow path 901*c* for a given draw pressure at the mouthpiece.

Fourth Mode: An Aerosol Delivery Device Comprising a Deformable Container

Figure 42:
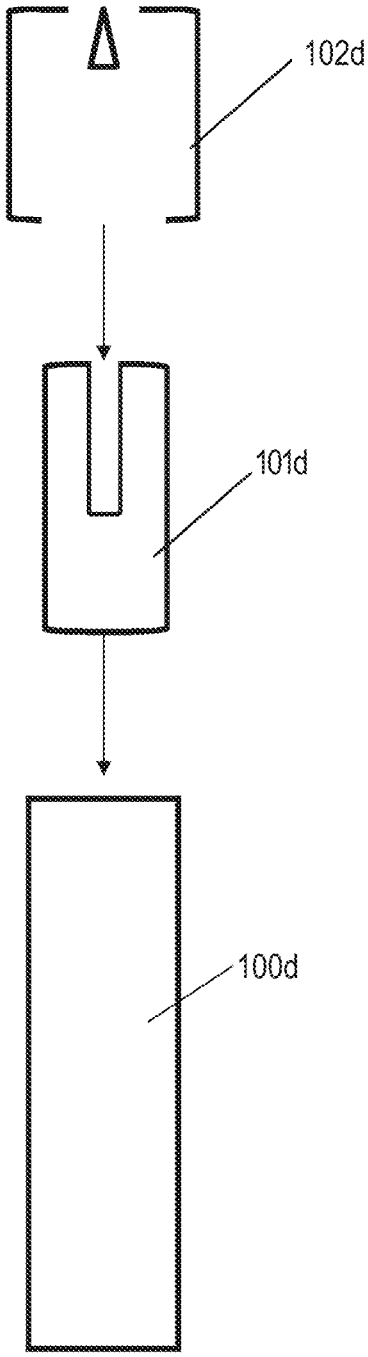
FIG. 42 shows a schematic drawing of a smoking substitute device of the fourth mode.
Figure 43:
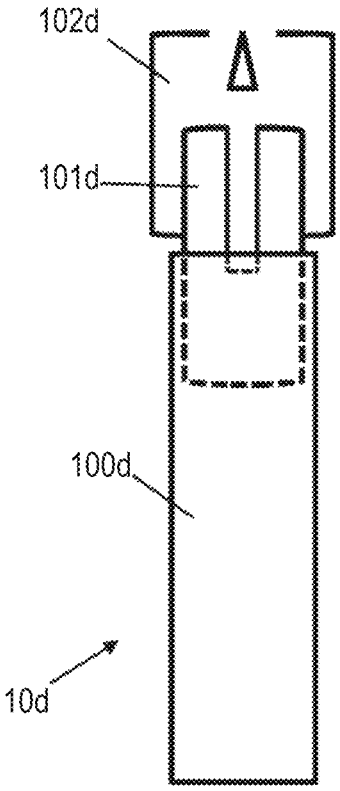
FIG. 43 shows a schematic drawing of a smoking substitute device of the fourth mode.

Aspects and embodiments of the fourth mode will now be discussed with reference to the accompanying figures. Further aspects and embodiments will be apparent to those skilled in the art. All documents mentioned in this text are incorporated herein by reference. Referring to FIG. 42 and FIG. 43, there is shown a smoking substitute device 10*d*. In this example, the smoking substitute device comprises a cartomiser 101*d* and a flavor pod 102*d* connected to a base unit 100*d*. In this example, the base unit 100*d* includes elements of the smoking substitute device such as a battery, an electronic controller, and a pressure transducer. The cartomiser 101*d* may engage with the base unit 100*d* via a push-fit engagement, a screw-thread engagement, or a bayonet fit, for example. A cartomiser may also be referred to as a "pod". The smoking substitute device can include an aerosol delivery device according to the present disclosure.

The flavor pod 102*d* is configured to engage with the cartomiser 101*d* and thus with the base unit 100*d*. The flavor pod 102*d* may engage with the cartomiser 101*d* via a push-fit engagement, a screw-thread engagement, or a bayonet fit, for example. FIG. 43 illustrates the cartomiser 101*d* engaged with the base unit 100*d*, and the flavor pod 102*d* engaged with the cartomiser 101*d*. As will be appreciated, in this example, the cartomiser 101*d* and the flavor pod 102*d* are distinct elements. Each of the cartomiser 101*d* and the flavor pod may be an aerosol delivery device according to the present disclosure.

As will be appreciated from the following description, the cartomiser 101*d* and the flavor pod 102*d* may alternatively be combined into a single component that implements the functionality of the cartomiser 101*d* and flavor pod 102*d*. Such a single component may also be an aerosol delivery device according to the present disclosure. In other examples, the cartomiser may be absent, with only a flavor pod 102*d* present.

A "consumable" component may mean that the component is intended to be used once until exhausted, and then disposed of as waste or returned to a manufacturer for reprocessing.

Figure 44:
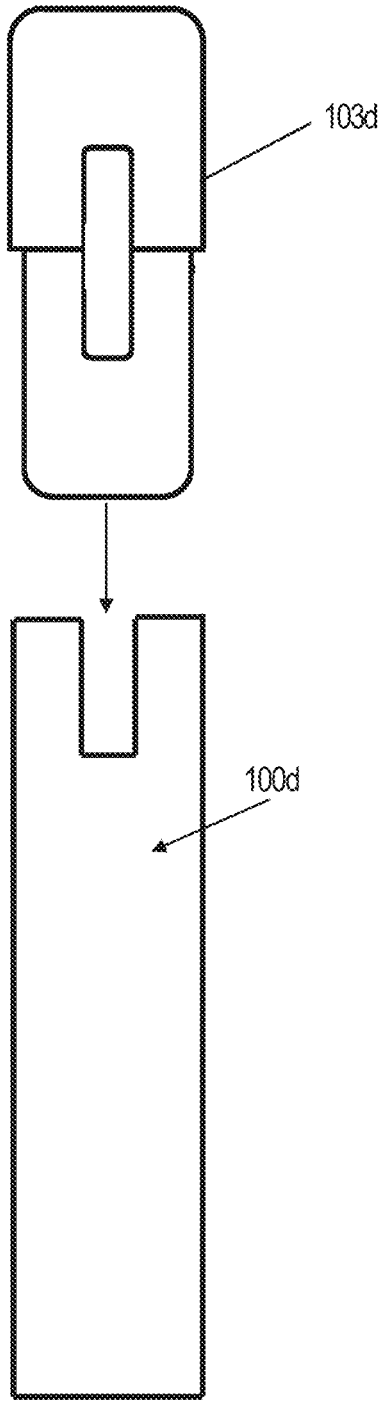
FIG. 44 shows a schematic drawing of a smoking substitute device of the fourth mode.
Figure 45:
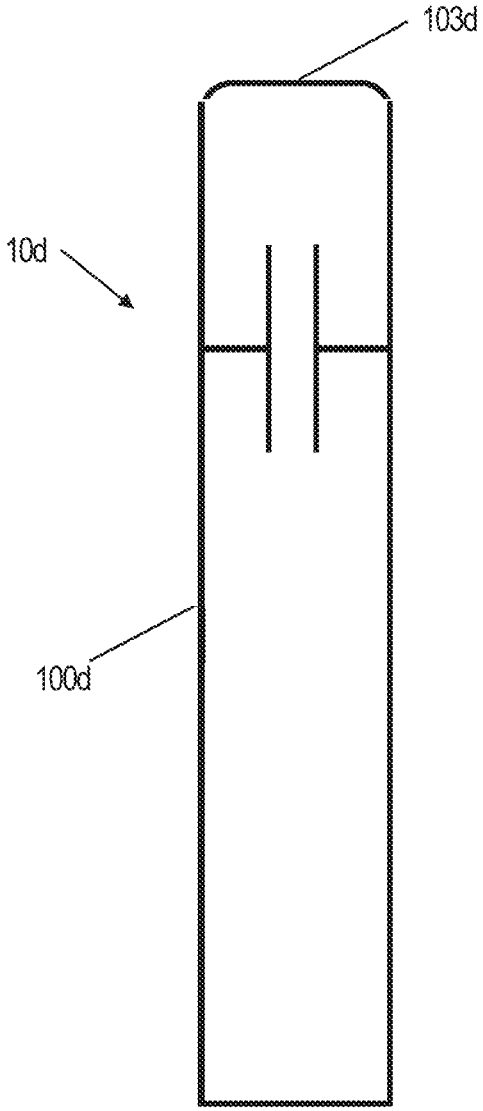
FIG. 45 shows a schematic drawing of a smoking substitute device of the fourth mode.

Referring to FIG. 44 and FIG. 45, there is shown a smoking substitute device comprising a base unit 100*d* and a consumable 103*d*. The consumable 103*d* combines the functionality of the cartomiser 101*d* and the flavor pod 102*d*. In FIG. 44, the consumable 103*d* and the base unit 100*d* are shown separated from one another. In FIG. 45, the consumable 103*d* and the base unit 100*d* are engaged with each other to form the smoking substitute device 10*d*.

Figure 46:
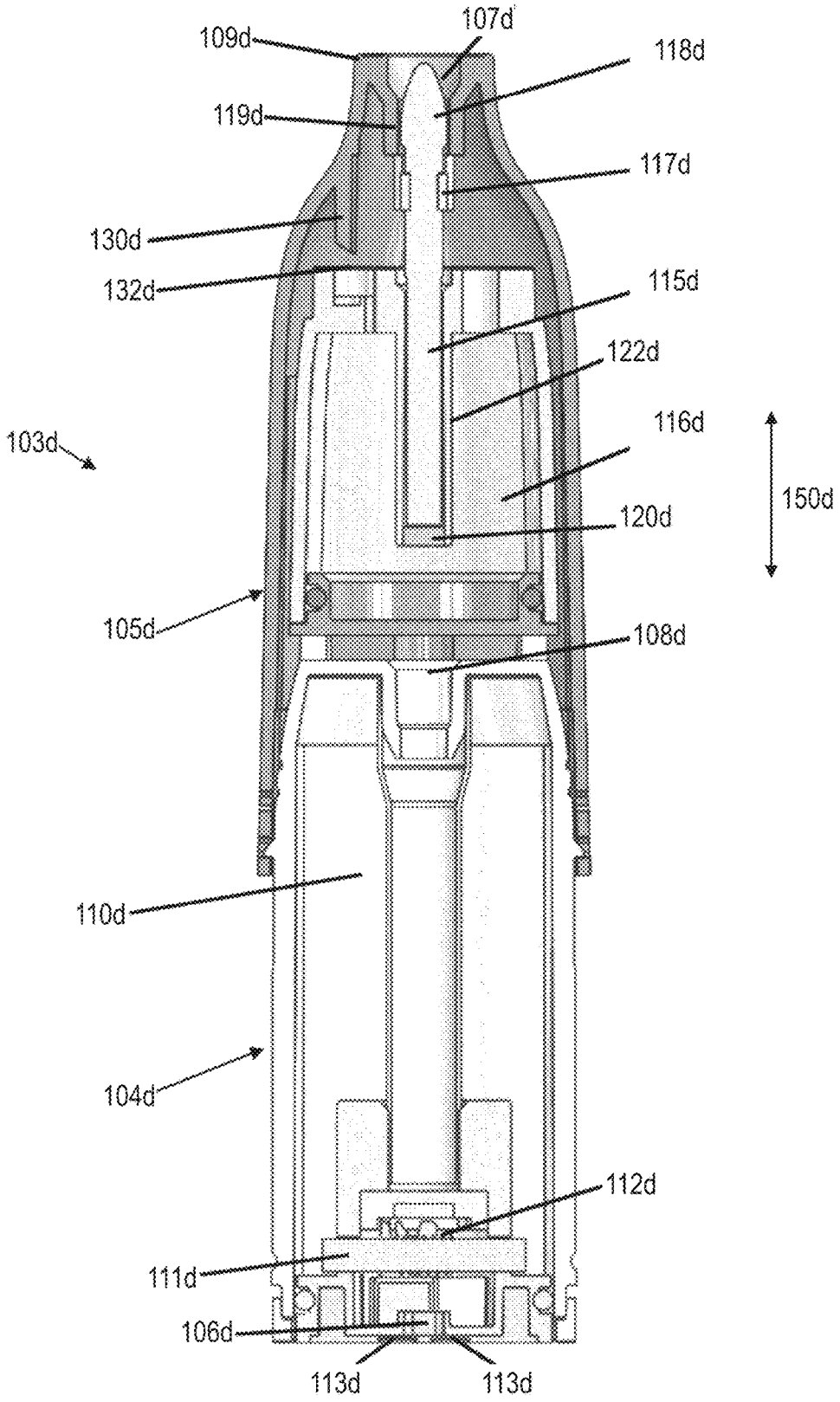
FIG. 46 shows a cross-sectional view of a consumable of the fourth mode in a deactivated state.

Referring to FIG. 46, there is shown a consumable 103*d* engageable with a base unit via a push-fit engagement in a deactivated state. The consumable 103*d* may be considered to have two portions—a cartomiser portion 104*d* and a flavor pod portion 105*d*, both of which are located within a single component (as in FIG. 44 and FIG. 45). The consumable 103*d* includes an upstream airflow inlet 106*d* and a downstream airflow outlet 107*d*. In other examples a plurality of inlets and/or outlets are included. Between and fluidly connecting the inlet 106*d* and the outlet 107*d* there is an airflow passage 108*d*. The outlet 107*d* is located at the mouthpiece 109*d* of the consumable 103*d*, and is formed by a mouthpiece aperture.

As above, the consumable 103*d* includes a flavor pod portion 105*d*. The flavor pod portion 105*d* is configured to generate a first (flavor) aerosol for output from the outlet 107*d* of the mouthpiece 109*d* of the consumable 103*d*. The flavor pod portion 105*d* of the consumable 103*d* includes a member 115*d*. The member 115*d* acts as a passive aerosol generator (e.g., an aerosol generator which does not use heat to form the aerosol, also referred to as a "first aerosol generator" in this example), and is formed of a porous material. The member 115*d* comprises a supporting portion 117*d*, which is located inside a housing, and an aerosol generator portion 118*d*, which is located in the airflow passage 108*d*. In this example, the aerosol generator portion 118*d* is a porous nib.

When activated, as discussed in more detail below, a first storage 116*d* (in this example a tank) for storing a first aerosol precursor (i.e., a flavor liquid) is fluidly connected to the member 115*d*. The porous nature of the member 115*d* means that flavor liquid from the first storage 116*d* is drawn into the member 115*d*. As the first aerosol precursor in the member 115*d* is depleted in use, further flavor liquid is drawn from the first storage 116*d* into the member 115*d* via a wicking action. Before activation, the first storage 116*d* is fluidly isolated from the member 115*d*. In this example, the isolation is achieved via plug 120*d* (preferably formed from silicon) located at one end of a conduit 122*d* containing the member 115*d*.

In other examples, the plug may be replaced by any one of: a duck bill valve; a split valve or diaphragm; or a sheet of foil. The first storage 116*d* further includes a pressure relief opening 132*d*, which in the deactivated state is sealed by a pierceable cover (preferably made from foil). Piercing member 130*d*, which is formed as a part of the mouthpiece 109*d* and may take the form of a blade, pierces the pierceable cover and opens the pressure relief opening 132*d* when the consumable is moved to the activated state (as is discussed in more detail below). As described above, the aerosol generator portion 118*d* is located within the airflow passage 108*d* through the consumable 103*d*. The aerosol generator portion 118*d* therefore constricts or narrows the airflow passage 108*d*. The aerosol generator portion 118*d* occupies some of the area of the airflow passage, resulting in constriction of the airflow passage 108*d*. The airflow passage 108*d* is narrowest adjacent to the aerosol generator portion 118*d*. Since the constriction results in increased air velocity and corresponding reduction in air pressure at the aerosol generator portion 118*d*, the constriction is a Venturi aperture 119*d*. The constriction is generally toroidal in shape, and may include one or more intersections where supports contact the aerosol generator portion 118*d*.

The cartomiser portion 104*d* of the consumable 103*d* includes a second storage 110*d* (in this example a tank) for storing a second aerosol precursor (i.e., e-liquid, which may contain nicotine). Extending into the second storage 110*d* is a wick 111*d*. The wick 111*d* is formed from a porous wicking material (e.g., a polymer) that draws second aerosol precursor from the second storage 110*d* into a central region of the wick 111*d* that is located outside the e-liquid storage tank 110*d*.

A heater 112*d* is a configured to heat the central region of the wick 111*d*. The heater 112*d* includes a resistive heating filament that is coiled around the central region of the wick

111*d*. The wick 111*d*, the heater 112*d* and the e-liquid storage tank 110*d* together act as an active aerosol generator (i.e., an aerosol generator which uses heat to form the aerosol, referred to as a "second aerosol generator" in this example).

As described above, the first and second aerosol generators are both at least partially located within the airflow passage 108*d*, with the first aerosol generator downstream (with respect to air flow in use) of the second aerosol generator.

Figure 47:
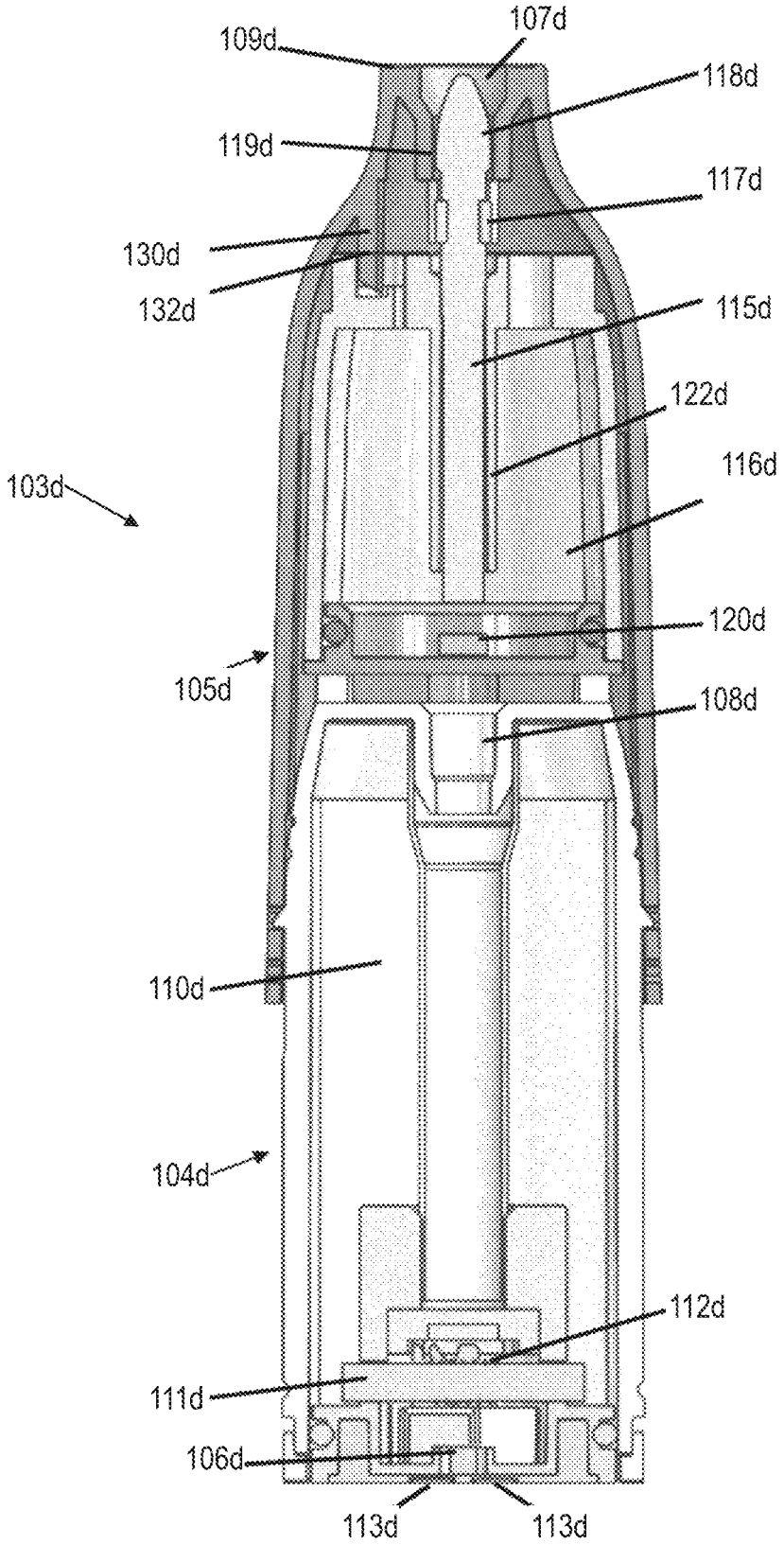
FIG. 47 shows a cross-sectional view of the consumable of FIG. 46 in an activated state.

So that the consumable 103*d* may be supplied with electrical power for activation of the heater 112*d*, the consumable 103*d* includes a pair of consumable electrical contacts 113*d*. The consumable electrical contacts 113*d* are configured for electrical connection to a corresponding pair of electrical supply contacts in the base unit 100*d*. The consumable electrical contacts 113*d* are electrically connected to the electrical supply contacts 114*d* when the consumable 103*d* is engaged with the base unit 100*d*. The base unit 100*d* includes an electrical power source (not shown), for example a battery. FIG. 47 shows the consumable 103*d* of FIG. 46 in an activated state, like features are indicated by like reference numerals. To transition from the deactivated state to the activated state, mouthpiece 109*d* is moved along a central axis 150*d* towards cartomizer portion 104*d* (e.g., one along which the consumable extends, and along which member 115*d* extends). The mouthpiece 109*d*, via supporting portion 117*d*, is fixed to the member 115*d* and therefore member 115*d* moves with the mouthpiece 109*d*. The mouthpiece 109*d*, and member 115*d*, is moved relative to the tank 116*d*. Piercing member 130*d* therefore contacts, and pierces, pressure relief opening 132*d* thereby fluidly connecting the airflow passage 108*d* to an interior of the first storage 116*d*. Further, member 115*d* pushes on, and moves, plug 120*d* out of the conduit 122*d* which then allows member 115*d* to fluidly connect with the first aerosol precursor stored in the first storage 116*d*. The plug 120*d* may then be unconstrained within the first storage, or may be pushed by member 115*d* into a holding location.

Once activated, and in use, a user draws (or "sucks", "pulls", or "puffs") on the mouthpiece 109*d* of the consumable 103*d*, which causes a drop in air pressure at the outlet 107*d*, thereby generating air flow through the inlet 106*d*, along the airflow passage 108*d*, out of the outlet 107*d* and into the user's mouth.

The first storage 116*d* is formed of a deformable material for example a relatively soft high-density polyethylene, so that it may be squeezed by the user and thereby apply a pressure to the first aerosol precursor stored therein. The first storage 116*d* is within an outer housing of the flavor pod portion 105*d*, and this outer housing is also deformable. In a further example, the outer housing includes a button which is arranged to apply any force exerted thereto on to the first storage 116*d*. Therefore, whilst the user draws on the mouthpiece they may also squeeze or by some other means apply a force to the first storage 116*d* so as to cause the provision of or increase the provision of the first aerosol precursor to the member 115*d*. In some examples, a pressure-actuatable seal (not shown) is located between the first storage 116*d* and the member 115*d*. The pressure-actuatable is configured to open when a threshold pressure is applied to the first storage and so allow first aerosol precursor to contact member 115*d*. In such examples, this method of activation may supplant or be in addition to the method described previously (of moving the mouthpiece 109*d*). For example, instead of plug 120*d*, a pressure disc may be located in the same position within conduit 122*d*. Squeezing the device may cause the pressure disc to perforate, and so allow first aerosol precursor located in first storage 116*d* to contact member 115*d*.

In yet further examples, a one-way valve (not shown) is located between the first storage 116*d* and member 115*d*. The one-way valve being configured to allow the first aerosol precursor to flow only from the first storage 116*d* to the member 115*d*. For example, instead of plug 120*d*, a one-way valve may be located in conduit 122*d*. This one-way valve may be in addition to or in replacement of the pressure actuatable seal.

When the heater 112*d* is activated (by passing an electric current through the heating filament in response to the user drawing on the mouthpiece 109*d*, the drawing of air may be detected by a pressure transducer) the e-liquid located in the wick 111*d* adjacent to the heating filament is heated and vaporized to form a vapor. The vapor condenses to form the second aerosol within the airflow passage 108*d*. Accordingly, the second aerosol is entrained in an airflow along the airflow flow passage 108*d* to the outlet 107*d* and ultimately out from the mouthpiece 109*d* for inhalation by the user when the user draws on the mouthpiece 109*d*.

The base unit 100*d* supplies electrical current to the consumable electrical contacts 113*d*. This causes an electric current flow through the heating filament of the heater 112*d* and the heating filament heats up. As described, the heating of the heating filament causes vaporization of the e-liquid in the wick 111*d* to form the second aerosol.

As the air flows up through the airflow passage 108*d*, it encounters the aerosol generator portion 118*d*. The constriction of the airflow passage 108*d* caused by the aerosol generator portion 118*d* results in an increase in air velocity and corresponding decrease in air pressure in the airflow in the vicinity of the porous surface 118*d* of the aerosol generator portion 115*d*. The corresponding low pressure and high air velocity region causes the generation of the first (flavor) aerosol from the porous surface 118*d* of the aerosol generator portion 118*d*. The first (flavor) aerosol is entrained into the airflow and ultimately is output from the outlet 107*d* of the consumable 103*d* and thus from the mouthpiece 109*d* into the user's mouth. The first aerosol is sized to inhibit pulmonary penetration. The first aerosol is formed of particles with a mass median aerodynamic diameter that is greater than or equal to 15 microns, in particular, greater than 30 microns, more particularly greater than 50 microns, yet more particularly greater than 60 microns, and even more particularly greater than 70 microns.

The first aerosol is sized for transmission within at least one of a mammalian oral cavity and a mammalian nasal cavity. The first aerosol is formed by particles having a maximum mass median aerodynamic diameter that is less than 300 microns, in particular less than 200 microns, yet more particularly less than 100 microns. Such a range of mass median aerodynamic diameter will produce aerosols which are sufficiently small to be entrained in an airflow caused by a user drawing air through the flavor element and to enter and extend through the oral and or nasal cavity to activate the taste and/or olfactory receptors. The second aerosol generated is sized for pulmonary penetration (i.e., to deliver an active ingredient such as nicotine to the user's lungs). The second aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapor.

The size of aerosol formed without heating is typically smaller than that formed by condensation of a vapor.

Figure 48:
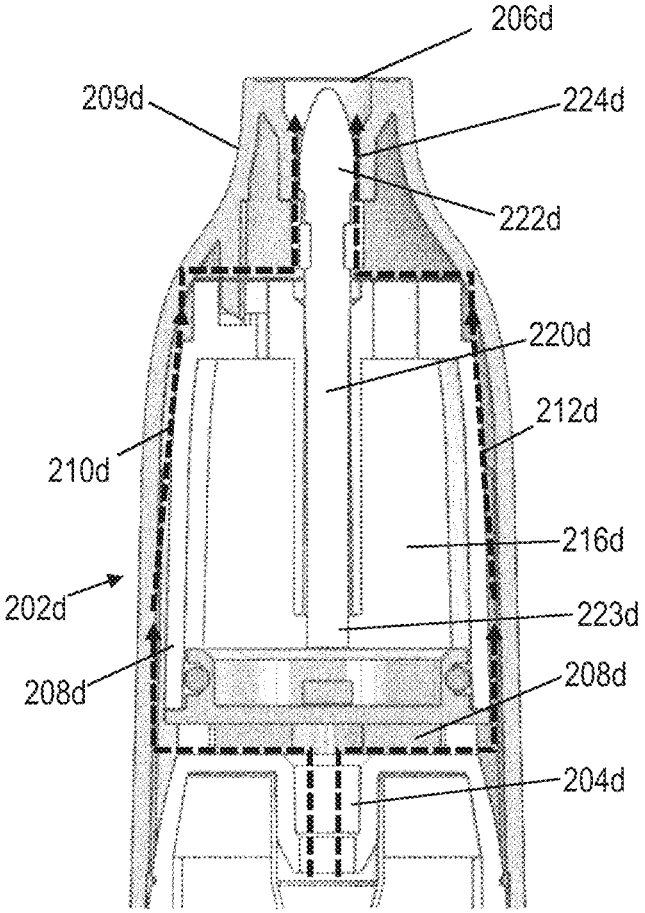
FIG. 48 a cross-sectional view of a flavor pod portion of a consumable of the fourth mode.

As a brief aside, it will be appreciated that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol. Referring to FIG. 48, there is shown a flavor pod portion 202*d* of a consumable in an activated state, the consumable providing an aerosol delivery device. The consumable further comprises a cartomiser portion (not shown in FIG. 48) having all of the features of the cartomiser portion 104*d* described above with respect to FIG. 46 and FIG. 47. However, in other examples, the consumable does not comprise the cartomiser portion, and provides only flavor to the user. The flavor pod portion 202*d* comprises an upstream (i.e., upstream with respect to flow of air in use) inlet 204*d* and a downstream (i.e., downstream with respect to flow of air in use) outlet 206*d*. Between and fluidly connecting the inlet 204*d* and the outlet 206*d* the flavor pod portion 204*d* comprises an airflow passage 208*d*. The airflow passage 208*d* comprises a first airflow branch 210*d* and a second airflow branch 212*d*, each of the first airflow branch 210*d* and the second airflow branch 212*d* fluidly connecting the inlet 204*d* and the outlet 206*d*. In other examples the airflow passage 208*d* may have an annular shape. The outlet 206*d* is located at the mouthpiece 209*d* of the consumable 103*d*, and is also referred to as a mouthpiece aperture 206*d*.

The flavor pod portion 202*d* comprises a storage 214*d*, which stores a first aerosol precursor. The storage 214*d* comprises a reservoir 216*d* located within a chamber 218*d*. The reservoir 216*d* is formed of a first porous material.

The flavor pod portion 202*d* comprises a member 220*d*, which comprises an aerosol generator portion 222*d* and a supporting portion 223*d*. The aerosol generator portion 222*d* is located at a downstream end (an upper end in FIG. 47) of the member 220*d*, while the supporting portion 223*d* makes up the rest of the member 220*d*. The supporting portion 223*d* is elongate and substantially cylindrical. The aerosol generator portion 222*d* is bulb-shaped, and comprises a portion which is wider than the supporting portion 223*d*. The aerosol generator portion 222*d* tapers to a tip at a downstream end of the aerosol generator portion 222*d*. The member 220*d* extends into and through the storage 214*d*. The member 220*d* is in contact with the reservoir 216*d*. More specifically, the supporting portion 223*d* extends into and through the storage 204*d* and is in contact with the reservoir 216*d*. The member 220*d* is located in a substantially central position within the reservoir 216*d* and is substantially parallel to a central axis of the consumable. The member 220*d* is formed of a second porous material. The first and second airflow branches 210*d*, 212*d* are located on opposite sides of the member 220*d*. Additionally, the first and second airflow branches 210*d*, 212*d* are located on opposite sides of the reservoir 216*d*. The first and second airflow branches 210*d*, 212*d* branch in a radial outward direction (with respect to the central axis of the consumable 200*d*) downstream of the inlet 204*d* to reach the opposite sides of the reservoir 216*d*. The aerosol generator portion 222*d* is located in the airflow passage 208*d* downstream of the first and second airflow branches 210*d*, 212*d*. The first and second airflow branches 210*d*, 212*d* turn in a radially inward direction to merge at the member 220*d*, at a point upstream of the aerosol generator portion 222*d*.

The aerosol generator portion 222*d* is located in a narrowing section 224*d* of the airflow passage 208*d*. The narrowing section 224*d* is downstream of the point at which the first and second airflow branches 210*d*, 212*d* merge, but upstream of the mouthpiece aperture 207*d*. The mouthpiece aperture 207*d* flares outwardly in the downstream direction, such that a width of the mouthpiece aperture 207*d* increases in the downstream direction.

In use, when a user draws on the mouthpiece 209*d*, air flow is generated through the air flow passage 208*d*. Air (comprising the second aerosol from the cartomiser portion as explained above with respect to FIG. 46) flows through the inlet 204*d* before the air flow splits to flow through the first and second airflow branches 210*d*, 212*d*. Further downstream, the first and second airflow branches 210*d*, 212*d* provide inward airflow towards the member 220*d* and the aerosol generator portion 222*d*.

As air flows past the aerosol generator portion in the narrowing section 224*d*, the velocity of the air increases, resulting in a drop in air pressure. This means that the air picks up the first aerosol precursor from the aerosol generator portion 222*d* to form the first aerosol. The first aerosol has the particle size and other properties described above with respect to FIG. 46.

As the first aerosol precursor is picked up by the air, the member 220*d* transfers further first aerosol precursor from the storage 214*d* to the aerosol generator portion 222*d*. More specifically, the member 220*d* wicks the first aerosol precursor from the storage 214*d* to the aerosol generator portion 224*d*.

In other examples, the storage 214*d* comprises a tank containing the first aerosol precursor as free liquid, rather than the reservoir 216*d* and the chamber 218*d*. In such examples, the member 220*d* still extends into the tank to transfer first aerosol precursor from the tank to the aerosol generator portion 224*d*.

Figure 49A:
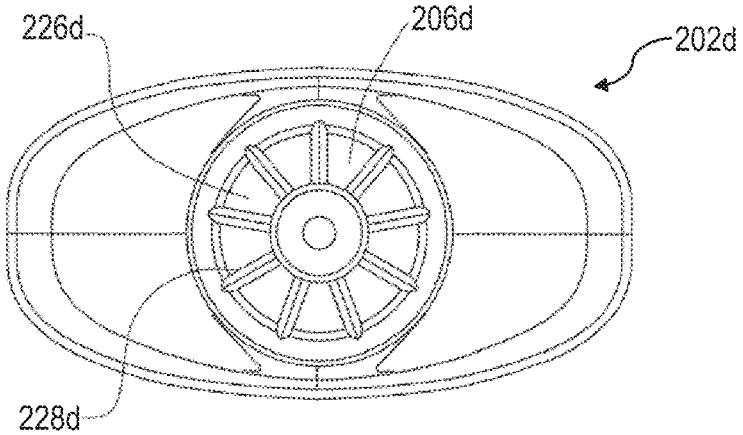
FIG. 49A shows a top view of a flavor pod portion of a consumable of the fourth mode.
Figure 49B:
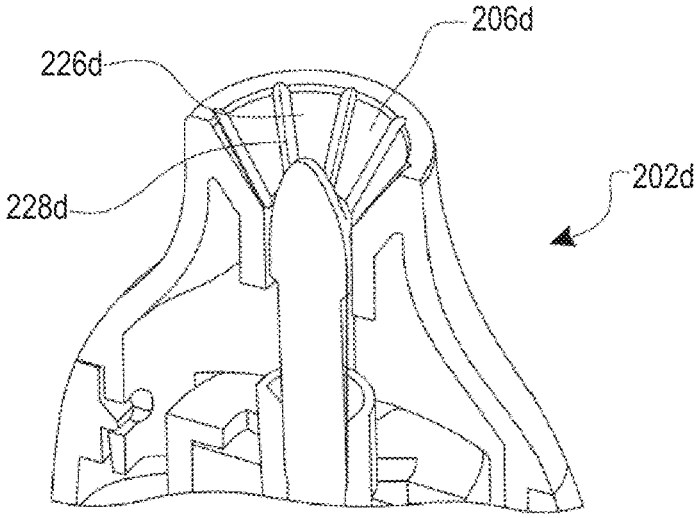
FIG. 49B shows a cut away perspective view of a flavor pod portion of a consumable of the fourth mode.

FIGS. 49A and 49B show further views of the flavor pod portion 202*d* which highlight features of the mouthpiece 209*d*. Many of the reference numerals of FIG. 48 are omitted from FIGS. 49A and 49B for clarity.

The mouthpiece aperture 206*d* comprises an inner surface 226*d*, which is uneven. In the present example, the inner surface 226*d* has the form of a substantially frustoconical surface, but includes grooves or channels 228*d* to make the inner surface 226*d* somewhat uneven. In other examples, the inner surface 226*d* may have another form (for example, the form a substantially cylindrical surface), and may include any type of protrusion or groove to make the inner surface uneven.

The inner surface 226*d* is angled with respect to an axial direction (i.e., relative to a central axis extending from a base of the consumable to the mouthpiece) such that the width of the mouthpiece aperture 209*d* increases in the downstream direction. The inner surface 226*d* is immediately downstream of the narrowing section 224*d* of the airflow passage 108*d*.

The grooves 228*d* are generally v-shaped in cross-sectional profile, and extend in the axial direction for the full length of the inner surface 226*d*. Each groove 228*d* is formed from a pair of surfaces angled at between 30 and 90 degrees relative to each other. More specifically, each groove 228*d* is formed from a pair of surfaces angled at 60 degrees relative to each other.

The grooves 228*d* have a depth (measured normal to the inner surface 226*d*) of at least 0.2 mm. More specifically, the grooves 228*d* have a depth of at least 0.3 mm. More specifically, the grooves 228*d* have a depth of at least 0.4 mm. The grooves 228*d* have a depth of less than 0.8 mm. More specifically, the grooves have a depth of less than 0.7 mm. More specifically, the grooves have a depth of less than 0.6 mm.

More specifically, the grooves have a depth of substantially 0.5 mm.

The grooves 228*d* are substantially equi-spaced in a circumferential manner around the inner surface 226*d*. The inner surface 226*d* comprises at least 6 grooves. More specifically, the inner surface comprises at least 7 grooves. More specifically, the inner surface 226*d* comprises at least 8 grooves.

The inner surface 226*d* comprises at most 12 grooves 228*d*. More specifically, the inner surface 226*d* comprises at most 11 grooves 228*d*. More specifically, the inner surface 226*d* comprises at most 10 grooves 228*d*.

More specifically, the inner surface 226*d* comprises 9 grooves 228*d*.

The grooves 228*d* are spaced apart from each other by substantially 1 mm at the downstream end of the inner surface 226*d*. In other examples, the spacing at the downstream end of grooves or protrusions may be selected such that it is equal to or less than the mass median diameter (as described above) of particles in the first aerosol. The inner surface 226*d* comprises a smooth polished surface between the grooves 228*d*. Polishing the surface in this way provides improved aerodynamic properties. However, in other examples, the inner surface 226*d* may be textured. In such examples, the texture of the surface may provide the uneven surface, and no grooves are required, In use, the uneven nature of the inner surface 226*d* makes it easier for droplets to form on the inner surface 226*d*, preventing large droplets from entering the user's mouth. The grooves 228*d* help to channel the large droplets back into the consumable.

Figure 50A:
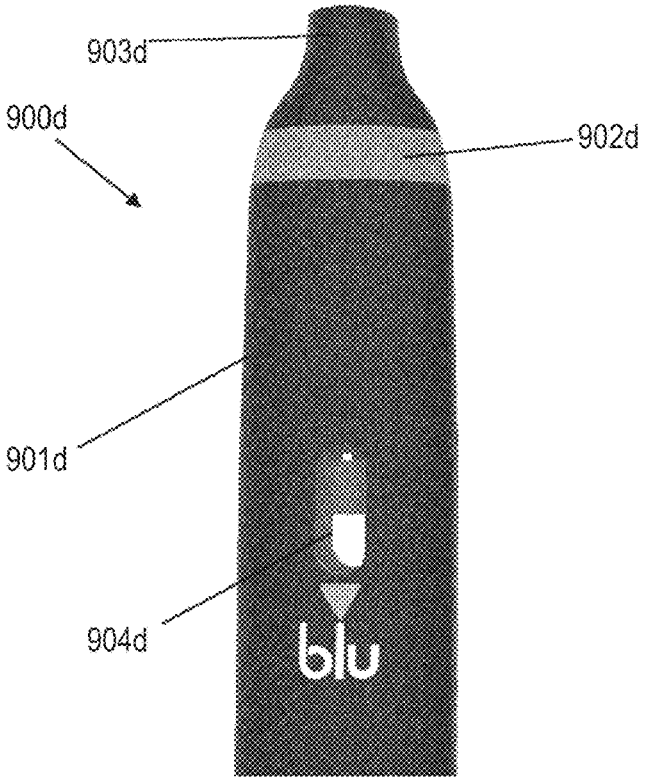
FIG. 50A shows a front-on view of a consumable of the fourth mode in a non-actuated state.
Figure 50B:
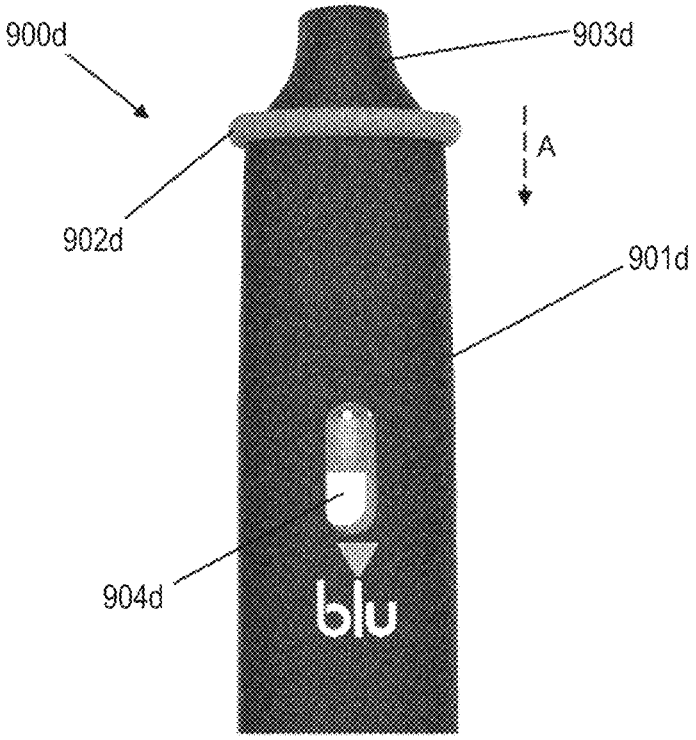
FIG. 50B shows a front-on view of the consumable of FIG. 50*a* in an actuated state.

FIG. 50A shows an exterior view of a flavor portion of a consumable 900*d*. Broadly, the flavor portion includes an outer housing 901*d*, a mechanically actuatable pump 902*d*, a mouthpiece 903*d*, and a window 904*d*. The outer housing houses the components shown in FIGS. 46-48, and is held by the user during operation of the flavor portion. The pump 902*d* is an elastomeric region of the outer housing, and is compressible so as to actuate the pump. The mouthpiece 903*d* is located at one end of the device, and in use is placed in or near the user's mouth to enable them to draw on or puff from the consumable 900*d*. Window 904*d* is provided so the user can visually inspect an amount of first aerosol precursor left within first storage 116*d*. By moving the mouthpiece 903*d* in direction A towards the window 904*d* as shown in FIG. 50A, the elastomeric portion 902*d* is compressed and actuated. This actuation causes the pump to dispense a predefined volume of first aerosol precursor from the first storage 116*d* to the aerosol generator (in this example, a region of member 115*d*).

When released, the elastomeric nature of the pump returns the mouthpiece to the original position shown in FIG. 50A.

Figure 51A:
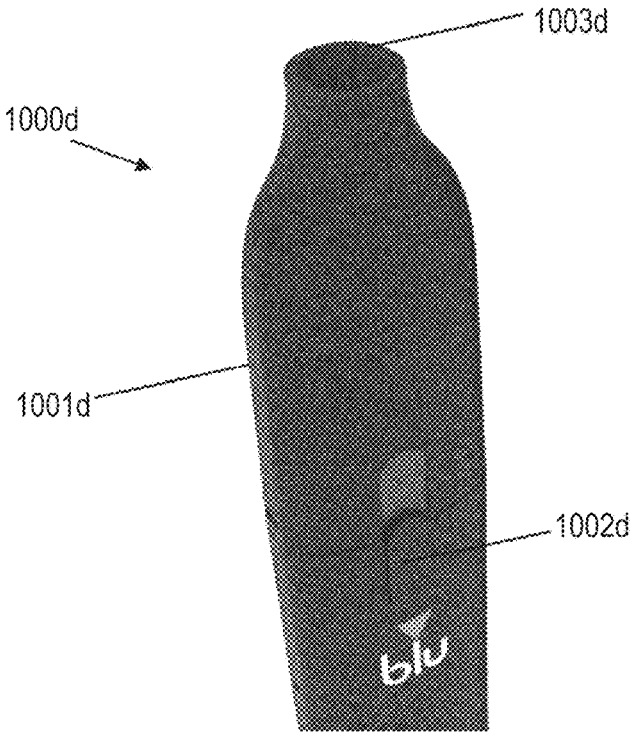
FIG. 51A shows a front-on view of a variant consumable of the fourth mode in a non-actuated state.

FIG. 51A shows an exterior view of a variant flavor portion of a consumable 1000*d*. Broadly, the flavor portion includes an outer housing 1001*d*, a mechanically actuatable pump 1002*d*, and a mouthpiece 1003*d*. In contrast to the flavor portion shown in FIG. 50A, the outer housing 1001*d* and mouthpiece 1003*d* of consumable 1000*d* are a single integrally molded unit. The mechanically actuatable pump 1002*d* includes a slidable button, located on the outer surface of the consumable 1000*d*.

Figure 51B:
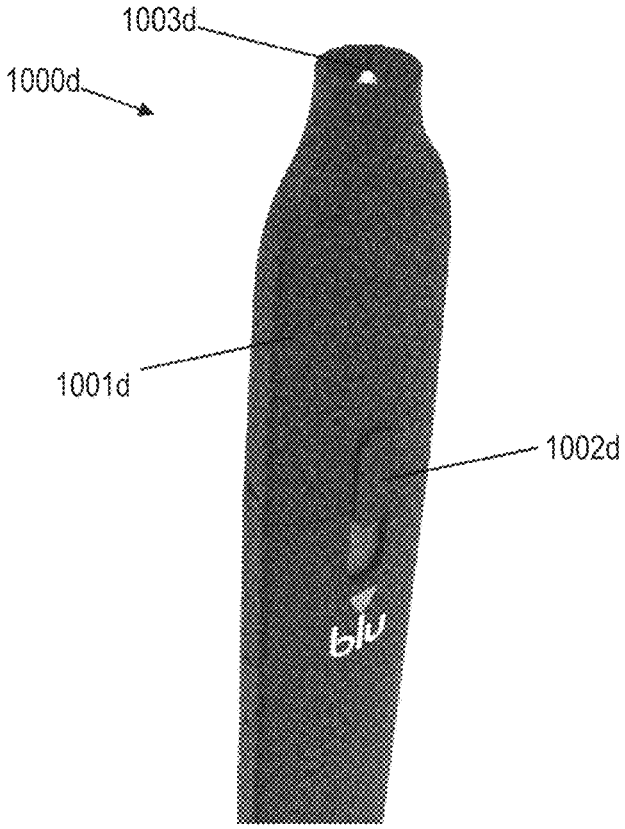
FIG. 51B shows a front-on view of the variant consumable of FIG. 51*a* in an actuated state.

In use, as shown in FIG. 51B, the slidable button is moved from its initial position towards the mouthpiece 1003*d* thereby actuating the pump and dispensing the predetermined quantity of first aerosol precursor.

In the previous examples, the aerosol generator has been provided as an aerosol generator portion 118*d* of member 115*d*. However, in other examples (not shown) the aerosol generator is a spray nozzle of the type known per se in the art. The mechanically actuatable pump provides first aerosol precursor to, and through, the spray nozzle to generate an aerosol. For example, the member 115*d* may be entirely replaced with a spray nozzle located within the airflow outlet 107*d* and is fed with first aerosol precursor by the mechanically actuated pump which may be located between the airflow outlet 107*d* and the first storage 116*d*. In a further alternative (not shown) the aerosol generator is a spray nozzle of the type known per se in the art. In contrast to the previous example, the mechanically actuated pump may be at least partially formed by the spray nozzle. In such an example, the user may depress the spray nozzle and thereby actuate the pump causing first aerosol precursor to be aerosolized by the spray nozzle.

Fifth Mode: A Refill Device or Cap for an Aerosol Delivery Device

Aspects and embodiments of the fifth mode of the disclosure will now be discussed with reference to the accompanying figures. Further aspects and embodiments of the fifth mode will be apparent to those skilled in the art. All documents mentioned in this text are incorporated herein by reference.

Figure 52:
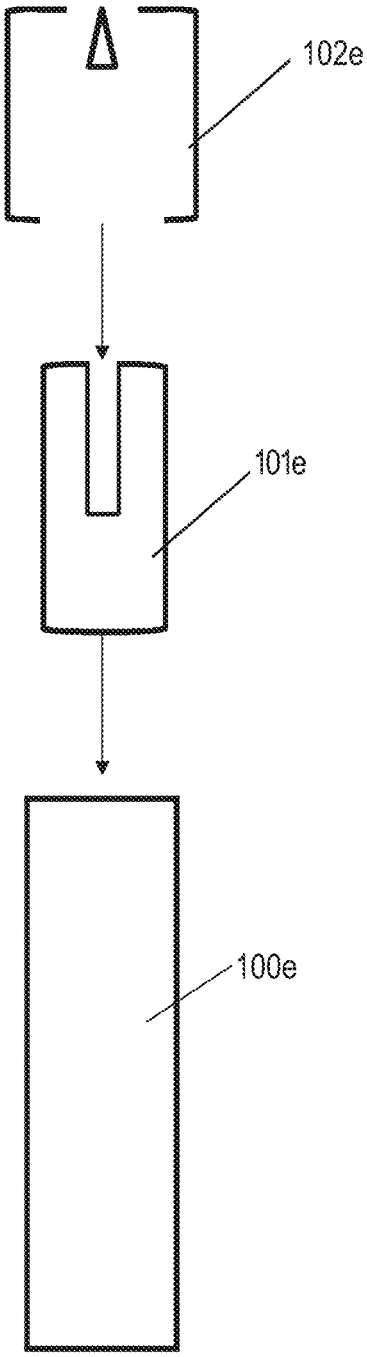
FIG. 52 shows a schematic drawing of a smoking substitute device of the fifth mode.
Figure 53:
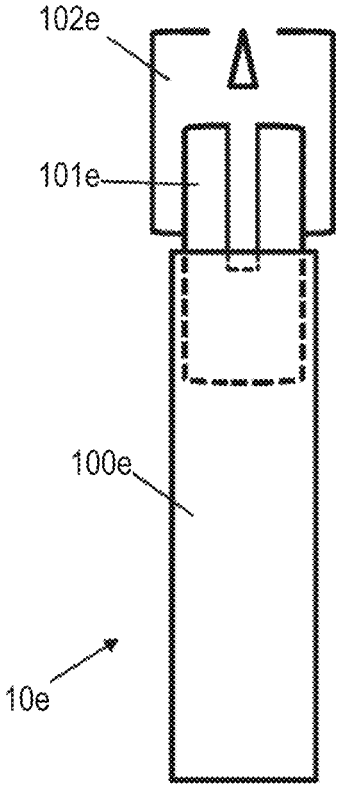
FIG. 53 shows a schematic drawing of a smoking substitute device of the fifth mode.

Referring to FIG. 52 and FIG. 53, there is shown a smoking substitute device 10*e*. In this example, the smoking substitute device comprises a cartomiser 101*e* and a flavor pod 102*e* connected to a base unit 100*e*. In this example, the base unit 100*e* includes elements of the smoking substitute device such as a battery, an electronic controller, and a pressure transducer. The cartomiser 101*e* may engage with the base unit 100*e* via a push-fit engagement, a screw-thread engagement, or a bayonet fit, for example. A cartomiser may also be referred to as a "pod". The smoking substitute device can include an aerosol delivery device according to the disclosure.

The flavor pod 102*e* is configured to engage with the cartomiser 101*e* and thus with the base unit 100*e*. The flavor pod 102*e* may engage with the cartomiser 101*e* via a push-fit engagement, a screw-thread engagement, or a bayonet fit, for example. FIG. 53 illustrates the cartomiser 101*e* engaged with the base unit 100*e*, and the flavor pod 102*e* engaged with the cartomiser 101*e*. As will be appreciated, in this example, the cartomiser 101*e* and the flavor pod 102*e* are distinct elements. Each of the cartomiser 101*e* and the flavor pod may be an aerosol delivery device according to the disclosure.

As will be appreciated from the following description, the cartomiser 101*e* and the flavor pod 102*e* may alternatively be combined into a single component that implements the functionality of the cartomiser 101*e* and flavor pod 102*e*. Such a single component may also be an aerosol delivery device according to the disclosure. In other examples, the cartomiser may be absent, with only a flavor pod 102*e* present.

A "consumable" component may mean that the component is intended to be used once until exhausted, and then disposed of as waste or returned to a manufacturer for reprocessing.

Figure 54:
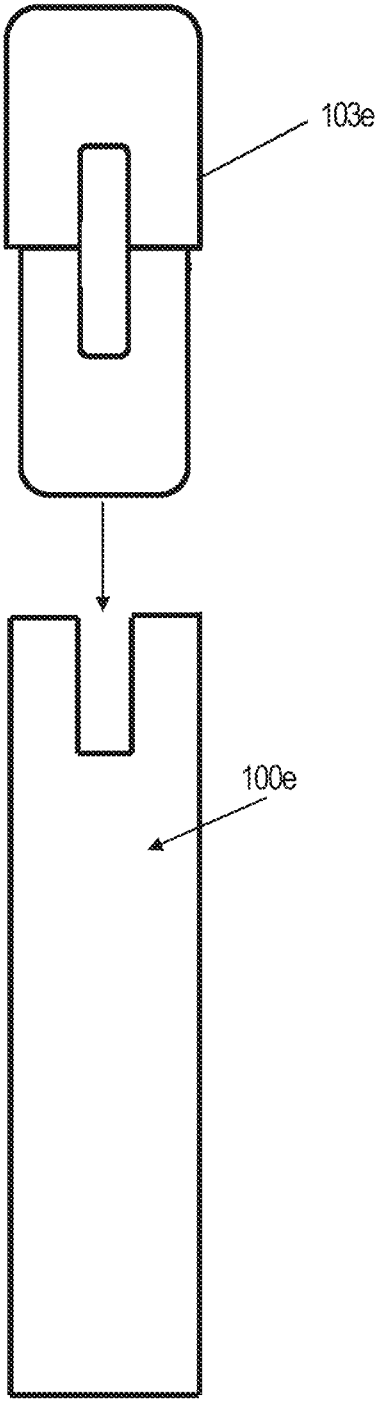
FIG. 54 shows a schematic drawing of a smoking substitute device of the fifth mode.
Figure 55:
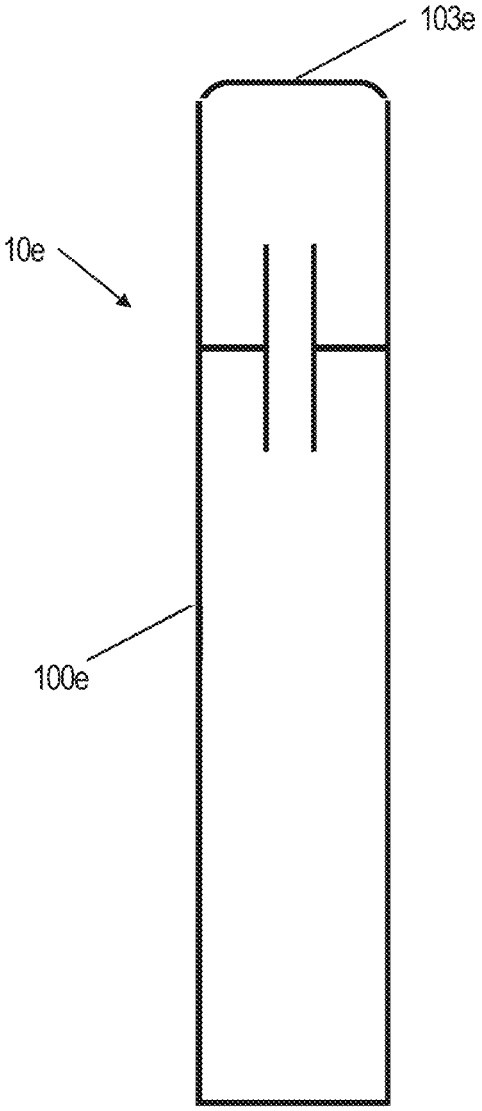
FIG. 55 shows a schematic drawing of a smoking substitute device of the fifth mode.
Figure 56:
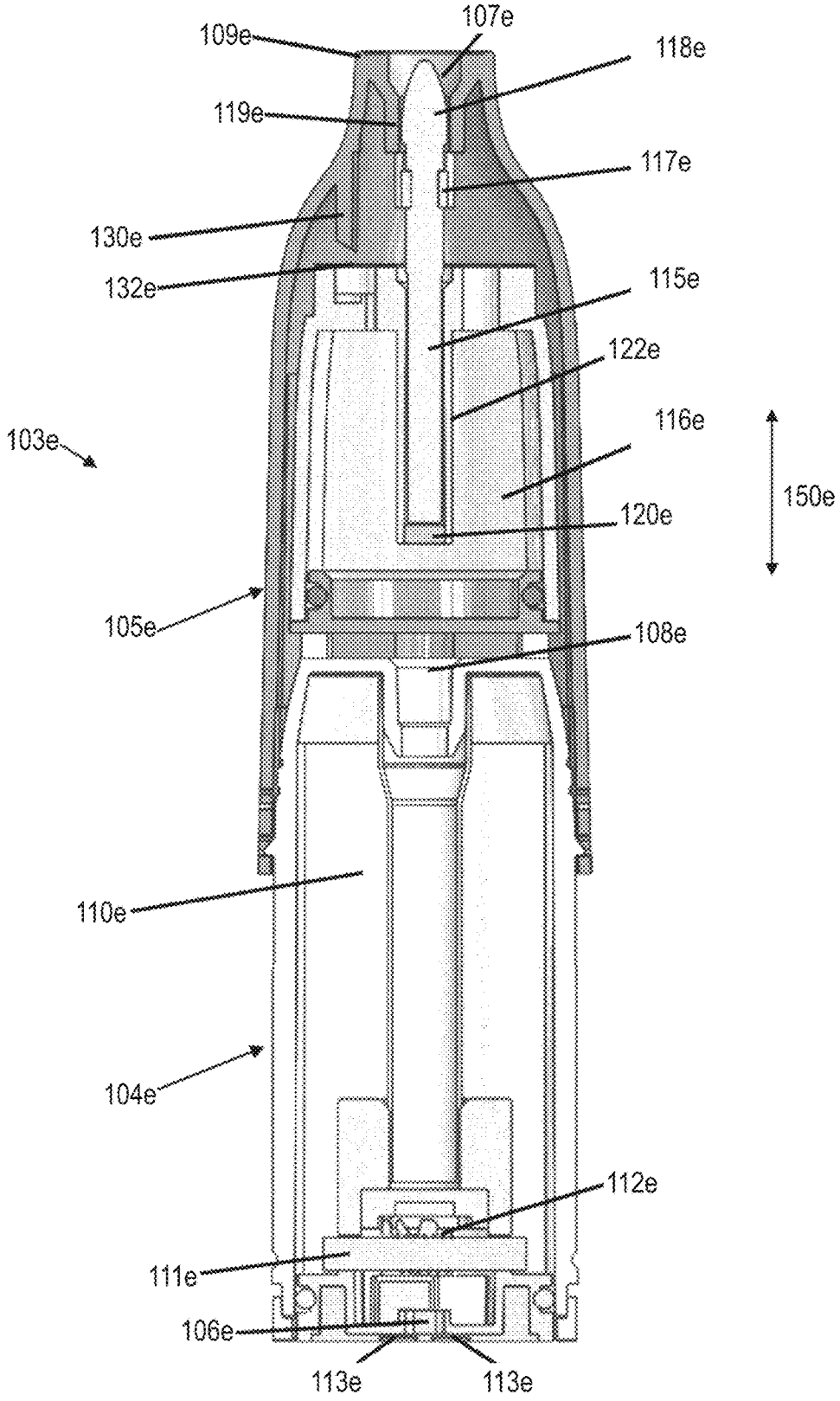
FIG. 56 shows a cross-sectional view of a consumable of the fifth mode in a deactivated state.

Referring to FIG. 54 and FIG. 55, there is shown a smoking substitute device comprising a base unit 100*e* and a consumable 103*e*. The consumable 103*e* combines the functionality of the cartomiser 101*e* and the flavor pod 102*e*. In FIG. 54, the consumable 103*e* and the base unit 100*e* are shown separated from one another. In FIG. 55, the consumable 103*e* and the base unit 100*e* are engaged with each other to form the smoking substitute device 10*e*. Referring to FIG. 56, there is shown a consumable 103*e* engageable with a base unit via a push-fit engagement in a deactivated state. The consumable 103*e* may be considered to have two portions—a cartomiser portion 104*e* and a flavor pod portion 105*e*, both of which are located within a single component (as in FIG. 54 and FIG. 55).

The consumable 103*e* includes an upstream airflow inlet 106*e* and a downstream airflow outlet 107*e*. In other examples a plurality of inlets and/or outlets are included. Between and fluidly connecting the inlet 106*e* and the outlet 107*e* there is an airflow passage 108*e*. The outlet 107*e* is located at the mouthpiece 109*e* of the consumable 103*e*, and is formed by a mouthpiece aperture.

As above, the consumable 103*e* includes a flavor pod portion 105*e*. The flavor pod portion 105*e* is configured to generate a first (flavor) aerosol for output from the outlet 107*e* of the mouthpiece 109*e* of the consumable 103*e*. The flavor pod portion 105*e* of the consumable 103*e* includes a member 115*e*. The member 115*e* acts as a passive aerosol generator (e.g., an aerosol generator which does not use heat to form the aerosol, also referred to as a "first aerosol generator" in this example), and is formed of a porous material. The member 115*e* comprises a supporting portion 117*e*, which is located inside a housing, and an aerosol generator portion 118*e*, which is located in the airflow passage 108*e*. In this example, the aerosol generator portion 118*e* is a porous nib.

When activated, as discussed in more detail below, a first storage 116*e* (in this example a tank) for storing a first aerosol precursor (i.e., a flavor liquid) is fluidly connected to the member 115*e*. The porous nature of the member 115*e* means that flavor liquid from the first storage 116*e* is drawn into the member 115*e*. As the first aerosol precursor in the member 115*e* is depleted in use, further flavor liquid is drawn from the first storage 116*e* into the member 115*e* via a wicking action. Before activation, the first storage 116*e* is fluidly isolated from the member 115*e*. In this example, the isolation is achieved via plug 120*e* (preferably formed from silicon) located at one end of a conduit 122*e* containing the member 115*e*. In other examples, the plug may be replaced by any one of: a duck bill valve; a split valve or diaphragm; or a sheet of foil. The first storage 116*e* further includes a pressure relief opening 132*e*, which in the deactivated state is sealed by a pierceable cover (preferably made from foil). Piercing member 130*e*, which is formed as a part of the mouthpiece 109*e* and may take the form of a blade, pierces the pierceable cover and opens the pressure relief opening 132*e* when the consumable is moved to the activated state (as is discussed in more detail below).

In some embodiments, in addition to moving the mouthpiece 109*e*, it is also possible to move the member 115*e* relative to the mouthpiece 109*e* so as to use member 115*e* to open a valve of a refill device as discussed in more detail below. The movement of member 115*e* may be achieved by, for example, attaching a mechanical slider to the member 115*e* which can be utilized by a user of the device. Alternatively, the mouthpiece 109*e* may be movable relative to the member 115*e* so as to cause the member 115*e* to protrude therefrom. The mouthpiece 109*e* may be biased to return to a position in which the member 115*e* does not protrude from the mouthpiece.

As described above, the aerosol generator portion 118*e* is located within the airflow passage 108*e* through the consumable 103*e*. The aerosol generator portion 118*e* therefore constricts or narrows the airflow passage 108*e*. The aerosol generator portion 118*e* occupies some of the area of the airflow passage, resulting in constriction of the airflow passage 108*e*. The airflow passage 108*e* is narrowest adjacent to the aerosol generator portion 118*e*. Since the constriction results in increased air velocity and corresponding reduction in air pressure at the aerosol generator portion 118*e*, the constriction is a Venturi aperture 119*e*. The constriction is generally toroidal in shape, and may include one or more intersections where supports contact the aerosol generator portion 118*e*.

The cartomiser portion 104*e* of the consumable 103*e* includes a second storage 110*e* (in this example a tank) for storing a second aerosol precursor (i.e., e-liquid, which may contain nicotine). Extending into the second storage 110*e* is a wick 111*e*. The wick 111*e* is formed from a porous wicking material (e.g., a polymer) that draws second aerosol precursor from the second storage 110*e* into a central region of the wick 111*e* that is located outside the e-liquid storage tank 110*e*.

A heater 112*e* is a configured to heat the central region of the wick 111*e*. The heater 112*e* includes a resistive heating filament that is coiled around the central region of the wick 111*e*. The wick 111*e*, the heater 112*e* and the e-liquid storage tank 110*e* together act as an active aerosol generator (i.e., an aerosol generator which uses heat to form the aerosol, referred to as a "second aerosol generator" in this example).

As described above, the first and second aerosol generators are both at least partially located within the airflow passage 108*e*, with the first aerosol generator downstream (with respect to air flow in use) of the second aerosol generator.

So that the consumable 103*e* may be supplied with electrical power for activation of the heater 112*e*, the consumable 103*e* includes a pair of consumable electrical contacts 113*e*. The consumable electrical contacts 113*e* are configured for electrical connection to a corresponding pair of electrical supply contacts in the base unit 100*e*. The consumable electrical contacts 113*e* are electrically connected to the electrical supply contacts 114*e* when the consumable 103*e* is engaged with the base unit 100*e*. The base unit 100*e* includes an electrical power source (not shown), for example a battery.

Figure 57:
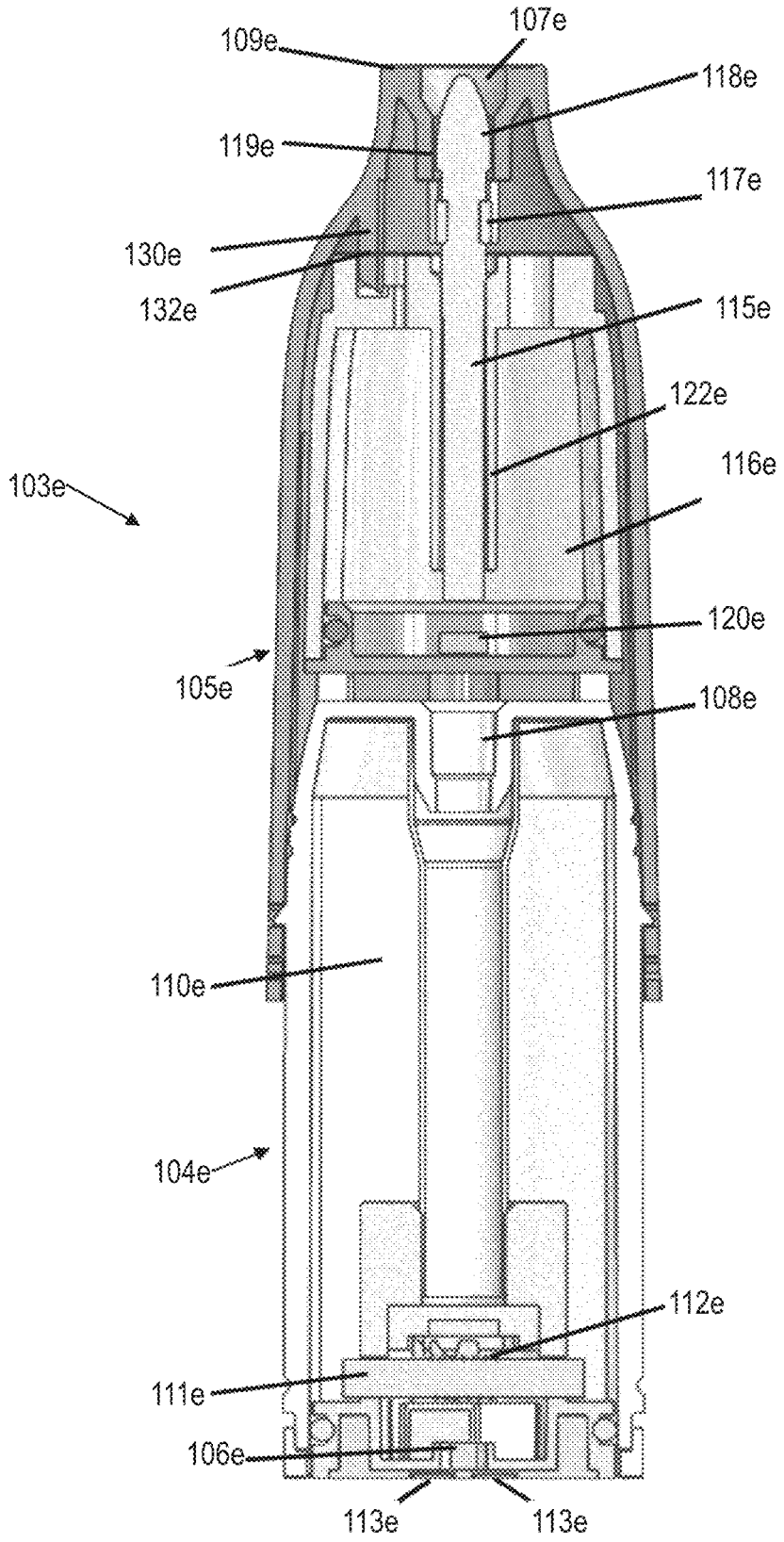
FIG. 57 shows a cross-sectional view of the consumable of FIG. 5 in an activated state.

FIG. 57 shows the consumable 103*e* of FIG. 56 in an activated state, like features are indicated by like reference numerals. To transition from the deactivated state to the activated state, mouthpiece 109*e* is moved along a central axis 150*e* towards cartomizer portion 104*e* (e.g., one along which the consumable extends, and along which member 115*e* extends). The mouthpiece 109*e*, via supporting portion 117*e*, is fixed to the member 115*e* and therefore member 115*e* moves with the mouthpiece 109*e*. The mouthpiece 109*e*, and member 115*e*, is moved relative to the tank 116*e*. Piercing member 130*e* therefore contacts, and pierces, pressure relief opening 132*e* thereby fluidly connecting the airflow passage 108*e* to an interior of the first storage 116*e*. Further, member 115*e* pushes on, and moves, plug 120*e* out of the conduit 122*e* which then allows member 115*e* to fluidly connect with the first aerosol precursor stored in the first storage 116*e*. The plug 120*e* may then be unconstrained within the first storage, or may be pushed by member 115*e* into a holding location.

Once activated, and in use, a user draws (or "sucks", "pulls", or "puffs") on the mouthpiece 109*e* of the consumable 103*e*, which causes a drop in air pressure at the outlet 107*e*, thereby generating air flow through the inlet 106*e*, along the airflow passage 108*e*, out of the outlet 107*e* and into the user's mouth.

When the heater 112*e* is activated (by passing an electric current through the heating filament in response to the user drawing on the mouthpiece 109*e*, the drawing of air may be detected by a pressure transducer) the e-liquid located in the wick 111*e* adjacent to the heating filament is heated and vaporized to form a vapor. The vapor condenses to form the second aerosol within the airflow passage 108*e*. Accordingly, the second aerosol is entrained in an airflow along the airflow flow passage 108*e* to the outlet 107*e* and ultimately out from the mouthpiece 109*e* for inhalation by the user when the user draws on the mouthpiece 109*e*.

The base unit 100*e* supplies electrical current to the consumable electrical contacts 113*e*. This causes an electric current flow through the heating filament of the heater 112*e* and the heating filament heats up. As described, the heating of the heating filament causes vaporization of the e-liquid in the wick 111*e* to form the second aerosol.

As the air flows up through the airflow passage 108*e*, it encounters the aerosol generator portion 118*e*. The constriction of the airflow passage 108*e* caused by the aerosol generator portion 118*e* results in an increase in air velocity and corresponding decrease in air pressure in the airflow in the vicinity of the porous surface 118*e* of the aerosol generator portion 115*e*. The corresponding low pressure and high air velocity region causes the generation of the first (flavor) aerosol from the porous surface 118*e* of the aerosol generator portion 118*e*. The first (flavor) aerosol is entrained into the airflow and ultimately is output from the outlet 107*e* of the consumable 103*e* and thus from the mouthpiece 109*e* into the user's mouth.

The first aerosol is sized to inhibit pulmonary penetration. The first aerosol is formed of particles with a mass median aerodynamic diameter that is greater than or equal to 15 microns, in particular, greater than 30 microns, more particularly greater than 50 microns, yet more particularly greater than 60 microns, and even more particularly greater than 70 microns.

The first aerosol is sized for transmission within at least one of a mammalian oral cavity and a mammalian nasal cavity. The first aerosol is formed by particles having a maximum mass median aerodynamic diameter that is less than 300 microns, in particular less than 200 microns, yet more particularly less than 100 microns. Such a range of mass median aerodynamic diameter will produce aerosols which are sufficiently small to be entrained in an airflow caused by a user drawing air through the flavor element and to enter and extend through the oral and or nasal cavity to activate the taste and/or olfactory receptors.

The second aerosol generated is sized for pulmonary penetration (i.e., to deliver an active ingredient such as nicotine to the user's lungs). The second aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapor. The size of aerosol formed without heating is typically smaller than that formed by condensation of a vapor.

As a brief aside, it will be appreciated that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol.

Figure 58:
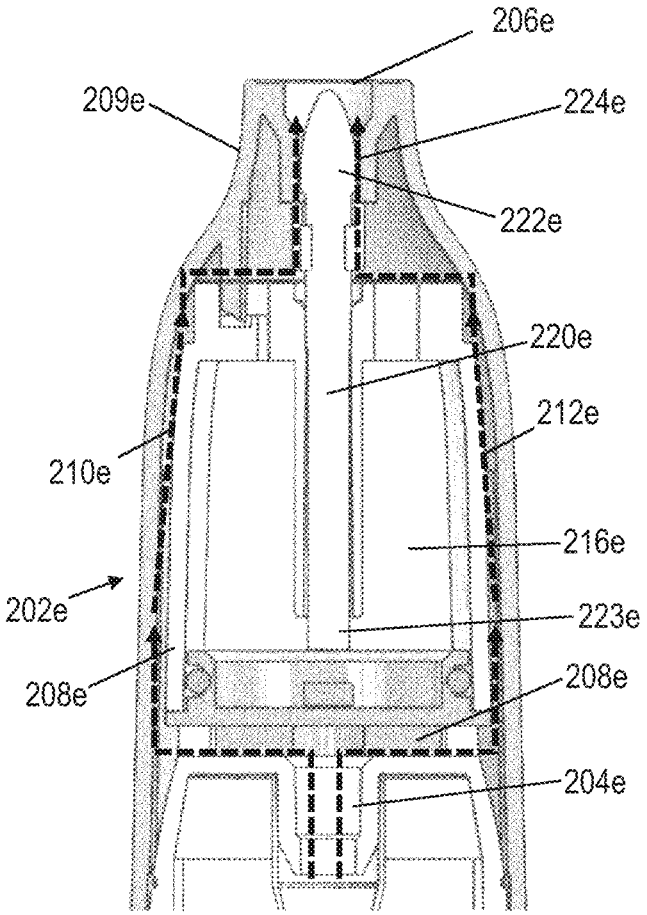
FIG. 58 a cross-sectional view of a flavor pod portion of a consumable of the fifth mode.

Referring to FIG. 58, there is shown a flavor pod portion 202*e* of a consumable in an activated state, the consumable providing an aerosol delivery device in accordance with the disclosure. The consumable further comprises a cartomiser portion (not shown in FIG. 58) having all of the features of the cartomiser portion 104*e* described above with respect to FIGS. 56 and 57. However, in other examples, the consumable does not comprise the cartomiser portion, and provides only flavor to the user.

The flavor pod portion 202*e* comprises an upstream (i.e., upstream with respect to flow of air in use) inlet 204*e* and a downstream (i.e., downstream with respect to flow of air in use) outlet 206*e*. Between and fluidly connecting the inlet 204*e* and the outlet 206*e* the flavor pod portion 204*e* comprises an airflow passage 208*e*. The airflow passage 208*e* comprises a first airflow branch 210*e* and a second airflow branch 212*e*, each of the first airflow branch 210*e* and the second airflow branch 212*e* fluidly connecting the inlet 204*e* and the outlet 206*e*. In other examples the airflow passage 208*e* may have an annular shape. The outlet 206*e* is located at the mouthpiece 209*e* of the consumable 103*e*, and is also referred to as a mouthpiece aperture 206*e*.

The flavor pod portion 202*e* comprises a storage 214*e*, which stores a first aerosol precursor. The storage 214*e* comprises a reservoir 216*e* located within a chamber 218*e*. The reservoir 216*e* is formed of a first porous material.

The flavor pod portion 202*e* comprises a member 220*e*, which comprises an aerosol generator portion 222*e* and a supporting portion 223*e*. The aerosol generator portion 222*e* is located at a downstream end (an upper end in FIG. 57) of the member 220*e*, while the supporting portion 223*e* makes up the rest of the member 220*e*. The supporting portion 223*e* is elongate and substantially cylindrical. The aerosol generator portion 222*e* is bulb-shaped, and comprises a portion which is wider than the supporting portion 223*e*. The aerosol generator portion 222*e* tapers to a tip at a downstream end of the aerosol generator portion 222*e*. The member 220*e* extends into and through the storage 214*e*. The member 220*e* is in contact with the reservoir 216*e*. More specifically, the supporting portion 223*e* extends into and through the storage 204*e* and is in contact with the reservoir 216*e*. The member 220*e* is located in a substantially central position within the reservoir 216*e* and is substantially parallel to a central axis of the consumable. The member 220*e* is formed of a second porous material. The first and second airflow branches 210*e*, 212*e* are located on opposite sides of the member 220*e*. Additionally, the first and second airflow branches 210*e*, 212*e* are located on opposite sides of the reservoir 216*e*. The first and second airflow branches 210*e*, 212*e* branch in a radial outward direction (with respect to the central axis of the consumable 200*e*) downstream of the inlet

204*e* to reach the opposite sides of the reservoir 216*e*. The aerosol generator portion 222*e* is located in the airflow passage 208*e* downstream of the first and second airflow branches 210*e*, 212*e*. The first and second airflow branches 210*e*, 212*e* turn in a radially inward direction to merge at the member 220*e*, at a point upstream of the aerosol generator portion 222*e*.

The aerosol generator portion 222*e* is located in a narrowing section 224*e* of the airflow passage 208*e*. The narrowing section 224*e* is downstream of the point at which the first and second airflow branches 210*e*, 212*e* merge, but upstream of the mouthpiece aperture 207*e*. The mouthpiece aperture 207*e* flares outwardly in the downstream direction, such that a width of the mouthpiece aperture 207*e* increases in the downstream direction.

In use, when a user draws on the mouthpiece 209*e*, air flow is generated through the air flow passage 208*e*. Air (comprising the second aerosol from the cartomiser portion as explained above with respect to FIG. 56) flows through the inlet 204*e* before the air flow splits to flow through the first and second airflow branches 210*e*, 212*e*. Further downstream, the first and second airflow branches 210*e*, 212*e* provide inward airflow towards the member 220*e* and the aerosol generator portion 222*e*.

As air flows past the aerosol generator portion in the narrowing section 224*e*, the velocity of the air increases, resulting in a drop in air pressure. This means that the air picks up the first aerosol precursor from the aerosol generator portion 222*e* to form the first aerosol. The first aerosol has the particle size and other properties described above with respect to FIG. 56. As the first aerosol precursor is picked up by the air, the member 220*e* transfers further first aerosol precursor from the storage 214*e* to the aerosol generator portion 222*e*. More specifically, the member 220*e* wicks the first aerosol precursor from the storage 214*e* to the aerosol generator portion 224*e*.

In other examples, the storage 214*e* comprises a tank containing the first aerosol precursor as free liquid, rather than the reservoir 216*e* and the chamber 218*e*. In such examples, the member 220*e* still extends into the tank to transfer first aerosol precursor from the tank to the aerosol generator portion 224*e*.

Figure 59A:
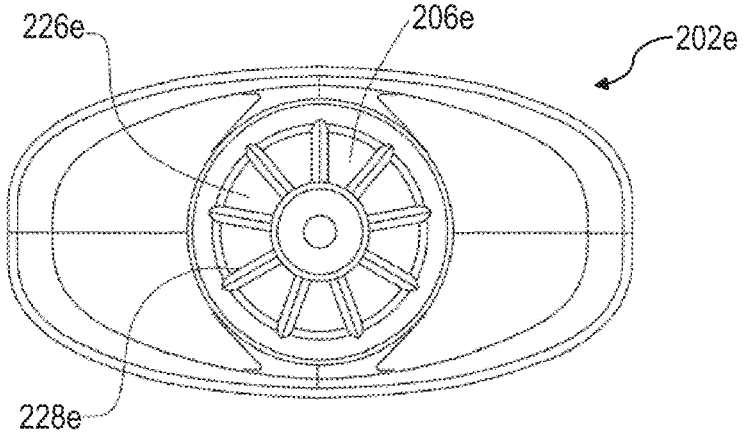
FIG. 59A shows a top view of a flavor pod portion of a consumable of the fifth mode.
Figure 59B:
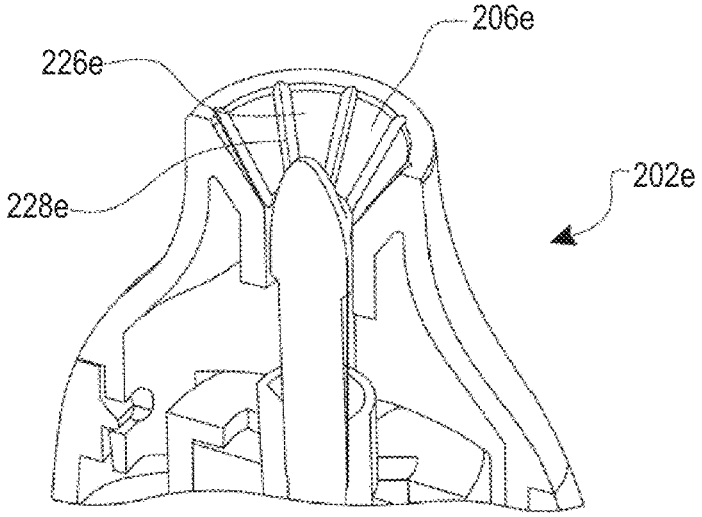
FIG. 59B shows a cut away perspective view of a flavor pod portion of a consumable of the fifth mode.

FIGS. 59A and 59B show further views of the flavor pod portion 202*e* which highlight features of the mouthpiece 209*e*. Many of the reference numerals of FIG. 58 are omitted from FIGS. 59A and 59B for clarity.

The mouthpiece aperture 206*e* comprises an inner surface 226*e*, which is uneven. In the present example, the inner surface 226*e* has the form of a substantially frustoconical surface, but includes grooves or channels 228*e* to make the inner surface 226*e* somewhat uneven. In other examples, the inner surface 226*e* may have another form (for example, the form a substantially cylindrical surface), and may include any type of protrusion or groove to make the inner surface uneven.

The inner surface 226*e* is angled with respect to an axial direction (i.e., relative to a central axis extending from a base of the consumable to the mouthpiece) such that the width of the mouthpiece aperture 209*e* increases in the downstream direction. The inner surface 226*e* is immediately downstream of the narrowing section 224*e* of the airflow passage 108*e*.

The grooves 228*e* are generally v-shaped in cross-sectional profile, and extend in the axial direction for the full length of the inner surface 226*e*. Each groove 228*e* is formed from a pair of surfaces angled at between 30 and 90 degrees relative to each other. More specifically, each groove 228*e* is formed from a pair of surfaces angled at 60 degrees relative to each other.

The grooves 228*e* have a depth (measured normal to the inner surface 226*e*) of at least 0.2 mm. More specifically, the grooves 228*e* have a depth of at least 0.3 mm. More specifically, the grooves 228*e* have a depth of at least 0.4 mm.

The grooves 228*e* have a depth of less than 0.8 mm. More specifically, the grooves have a depth of less than 0.7 mm. More specifically, the grooves have a depth of less than 0.6 mm.

More specifically, the grooves have a depth of substantially 0.5 mm.

The grooves 228*e* are substantially equi-spaced in a circumferential manner around the inner surface 226*e*. The inner surface 226*e* comprises at least 6 grooves. More specifically, the inner surface comprises at least 7 grooves. More specifically, the inner surface 226*e* comprises at least 8 grooves.

The inner surface 226*e* comprises at most 12 grooves 228*e*. More specifically, the inner surface 226*e* comprises at most 11 grooves 228*e*. More specifically, the inner surface 226*e* comprises at most 10 grooves 228*e*.

More specifically, the inner surface 226*e* comprises 9 grooves 228*e*.

The grooves 228*e* are spaced apart from each other by substantially 1 mm at the downstream end of the inner surface 226*e*. In other examples, the spacing at the downstream end of grooves or protrusions may be selected such that it is equal to or less than the mass median diameter (as described above) of particles in the first aerosol.

The inner surface 226*e* comprises a smooth polished surface between the grooves 228*e*. Polishing the surface in this way provides improved aerodynamic properties. However, in other examples, the inner surface 226*e* may be textured. In such examples, the texture of the surface may provide the uneven surface, and no grooves are required, In use, the uneven nature of the inner surface 226*e* makes it easier for droplets to form on the inner surface 226*e*, preventing large droplets from entering the user's mouth. The grooves 228*e* help to channel the large droplets back into the consumable.

Figure 60:
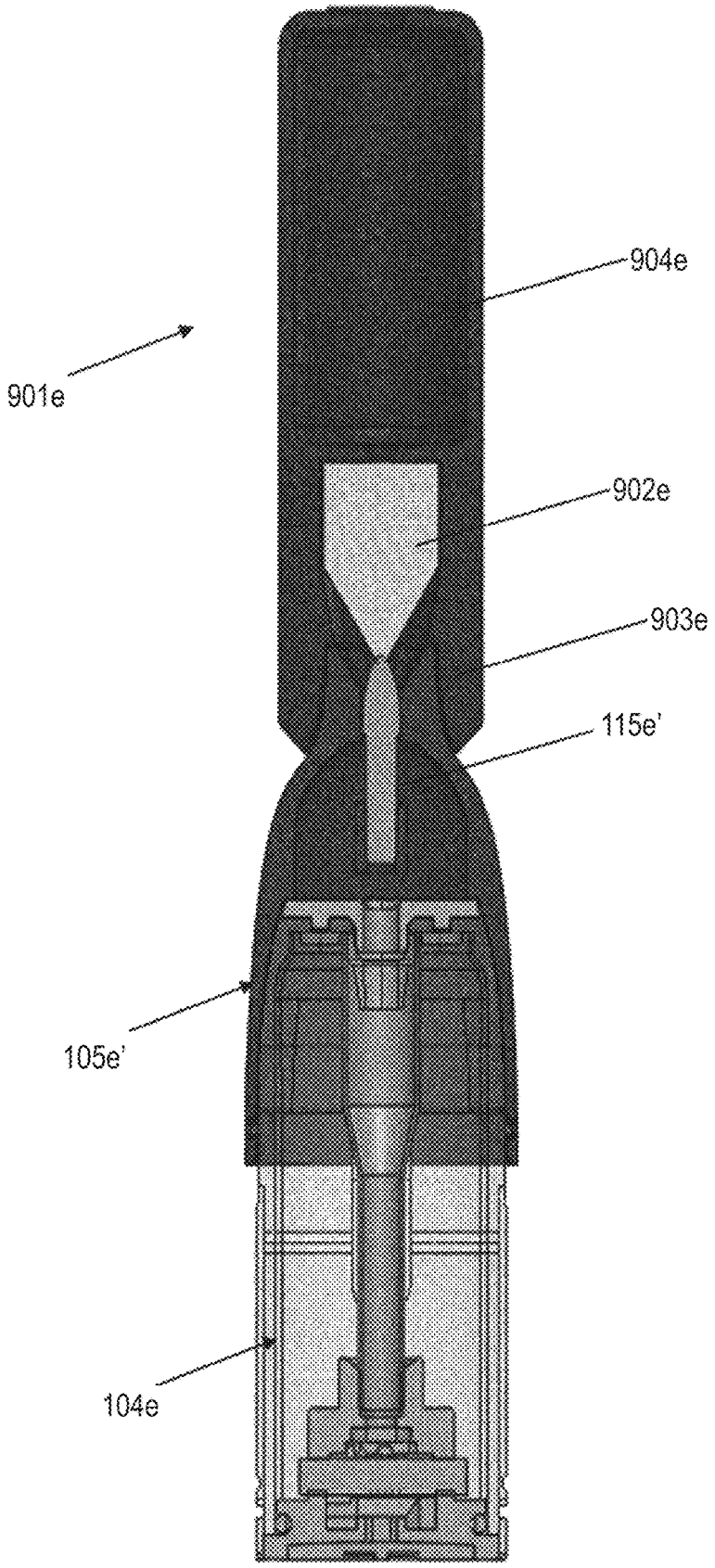
FIG. 60 shows a first embodiment of the fifth mode of a refill device engaged with an aerosol delivery device.

FIG. 60 shows a first embodiment of a refill device 901*e* for use with the consumable discussed previously. The refill device includes: a porous liquid transfer element 902*e* which contains first aerosol precursor, located towards one end of the device; an engagement unit 903*e*, adjacent the porous liquid transfer element; and a liquid store 904*e*, which contains further first aerosol precursor. The liquid store 904*e* and porous liquid transfer element 902*e* are within an outer housing, a portion of which provides the engagement unit 903*e*. The housing, liquid store, and engagement unit in this example are formed from plastic. The porous liquid transfer element 902*e* is formed of a fibrous material.

The engagement unit 903*e* provides a cavity which has a corresponding shape to mouthpiece 109*e* of the flavor pod portion 105*e*. In this example, the cavity is frustoconical in shape, and has a lip which aligns with an uppermost lip of the mouthpiece 109*e*. This can ensure that the refill device is not pressed to far onto the mouthpiece 109*e*, and so the risk of damaging the member 115*e* is minimized. In use, the refill device 901*e* is engaged with the mouthpiece of the flavor pod portion 105*e* discussed above. First aerosol precursor then leaches from the porous liquid transfer element 902*e* into the member 115*e*. This can be useful if, for example, the first store 116*e* is deleted of first aerosol precursor. The refill device can then be used to refill, or charge, the member 115*e* so that it may still function as an aerosol generator.

Alternatively, as shown in FIG. 60, a variant flavor pod portion 105*e*' may be provided. Variant flavor pod portion 105*e*' is attached to the same cartomiser portion 104*e*, but has a shorter variant member 115*e*' than the examples shown previously. Further, the variant flavor pod portion 105*e*' contains no first reservoir. Therefore, the variant member 115*e*' must be charged using the refill device before at least the first use of the flavor pod portion 105*e*'. Advantageously, such a variant flavor pod portion 105*e*' requires fewer parts, has smaller dimensions, and is impervious to leakage during transit (as no first aerosol precursor is present until the first-time refill device 901*e* is used to charge variant member 115*e*'. As before, the variant member 115*e*' includes an aerosol generating portion located with the mouthpiece 109*e* of the flavor pod 105*e*'.

Figure 61:
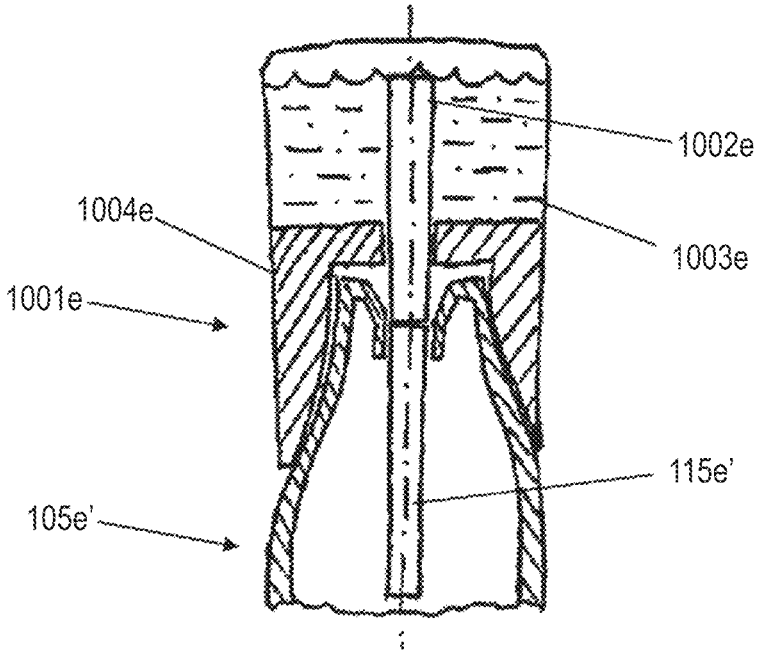
FIG. 61 shows a second embodiment of the fifth mode of a refill device for an aerosol delivery device.

FIG. 61 shows a second embodiment of (i.e., a variant) refill device 1001*e*, engaged to the variant flavor pod 105*e*' discussed previously. The refill device 1001*e* of this second embodiment differs from refill device 901*e* in that the porous liquid transfer element 1002*e* extends into the liquid reservoir 1002*e* (whereas, in refill device 901*e*, the porous liquid transfer element merely abutted an aperture in liquid reservoir 903*e*). Advantageously, this can promote the transfer of first aerosol precursor stored in the liquid reservoir 1002*e* into the porous liquid transfer element 1002*e*. The refill device 1001*e* of the second embodiment also contains an engagement unit 1004*e*, which is configured in a similar manner to engagement unit 104*e* discussed above.

In both refill devices (as shown in FIG. 60 and FIG. 61), the refill device has an engagement portion or unit which is corresponding or complementary in shape to an engagement unit of the flavor pod 105*e*'. In these examples, the engagement unit of the flavor pod 105*e*' is the mouthpiece, and so the engagement portion or unit of the refill device has a cavity corresponding in shape to the mouthpiece. The housing forming the refill device 901*e* or refill device 1001*e* may be deformable. Therefore, when a user squeezes or otherwise applies a force to the housing this force may be communicated to the liquid reservoir so as to impart a pressure to the aerosol precursor stored therein.

Figure 62:
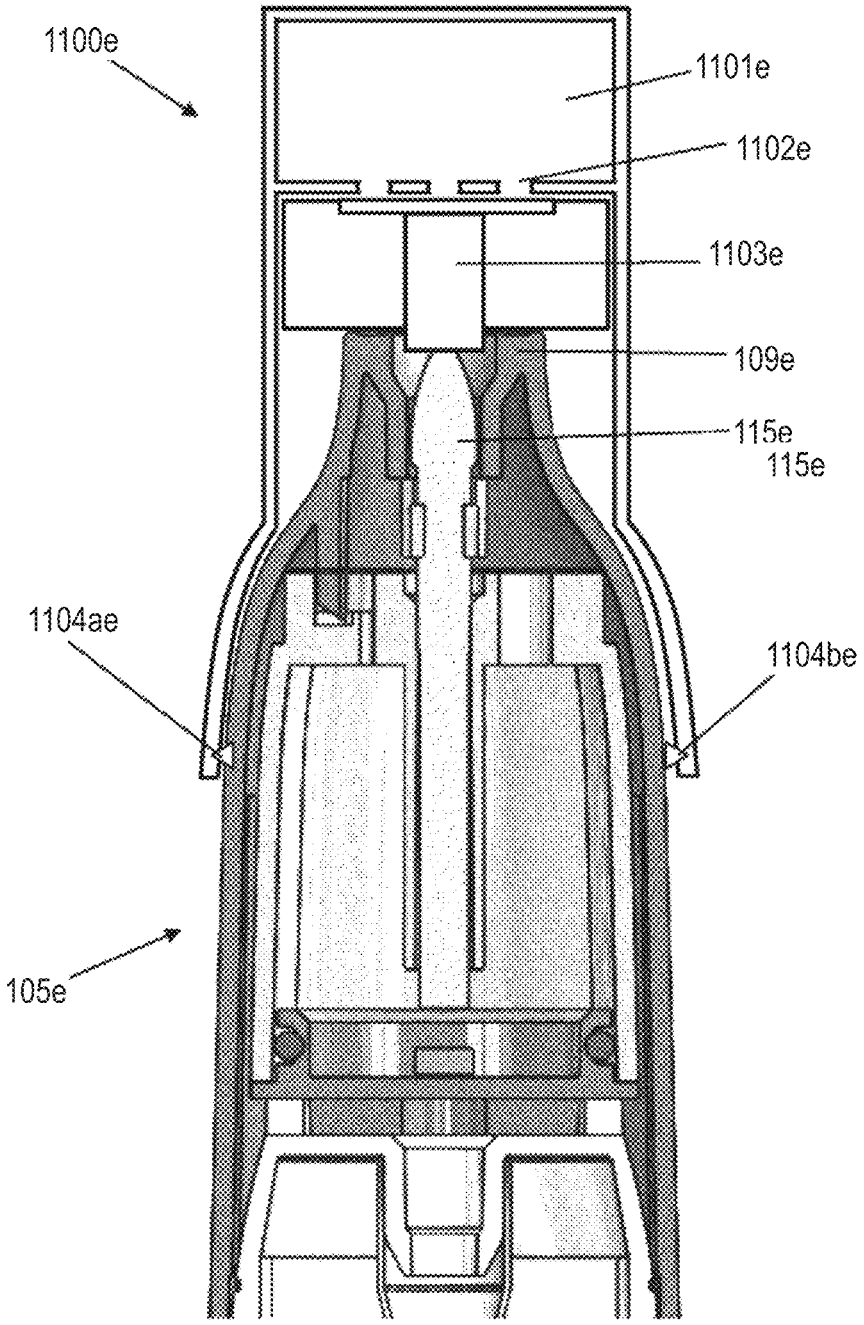
FIG. 62 shows a refill cap engaged with the flavor pod portion shown in FIG. 58.

FIG. 62 shows the flavor pod portion 105*e* of FIG. 58, engaged with a refill cap 1100*e* according to the present disclosure. Broadly, the refill cap 1100*e* includes a reservoir 1101*e* which contains aerosol precursor; outlet paths 1102*e* which fluidly connect the reservoir 1101*e* to a transfer element 1103*e*. The transfer element 1103*e* is, in this example, a porous member which wicks aerosol precursor from reservoir 1101*e* and provides it to member 115*e* when it is in contact with it.

The elements of the refill cap 1100*e* are contained within an outer housing, the outer housing of the refill cap includes engagement elements 1104*ae* and 1104*be*, which together form an adaptor for securing the refill cap to an external part of the flavor pod portion 105*e*. Alternatively, the outer housing may provide an inner surface which engages with the flavor pod portion in an interference fit. Further alternatively, the outer housing may have an inner surface which includes a thread, and the thread engages with a counterpart thread on the flavor pod portion 105*e*.

In use, the refill cap 1100*e* is secured to the flavor pod portion 105*e*. Transfer element 1103*e* then contacts member 115*e*, and aerosol precursor is transferred from reservoir 1101*e* to member 115*e*. This can be in addition to the flow of aerosol precursor from first storage 116*e* as described above.

Figure 63:
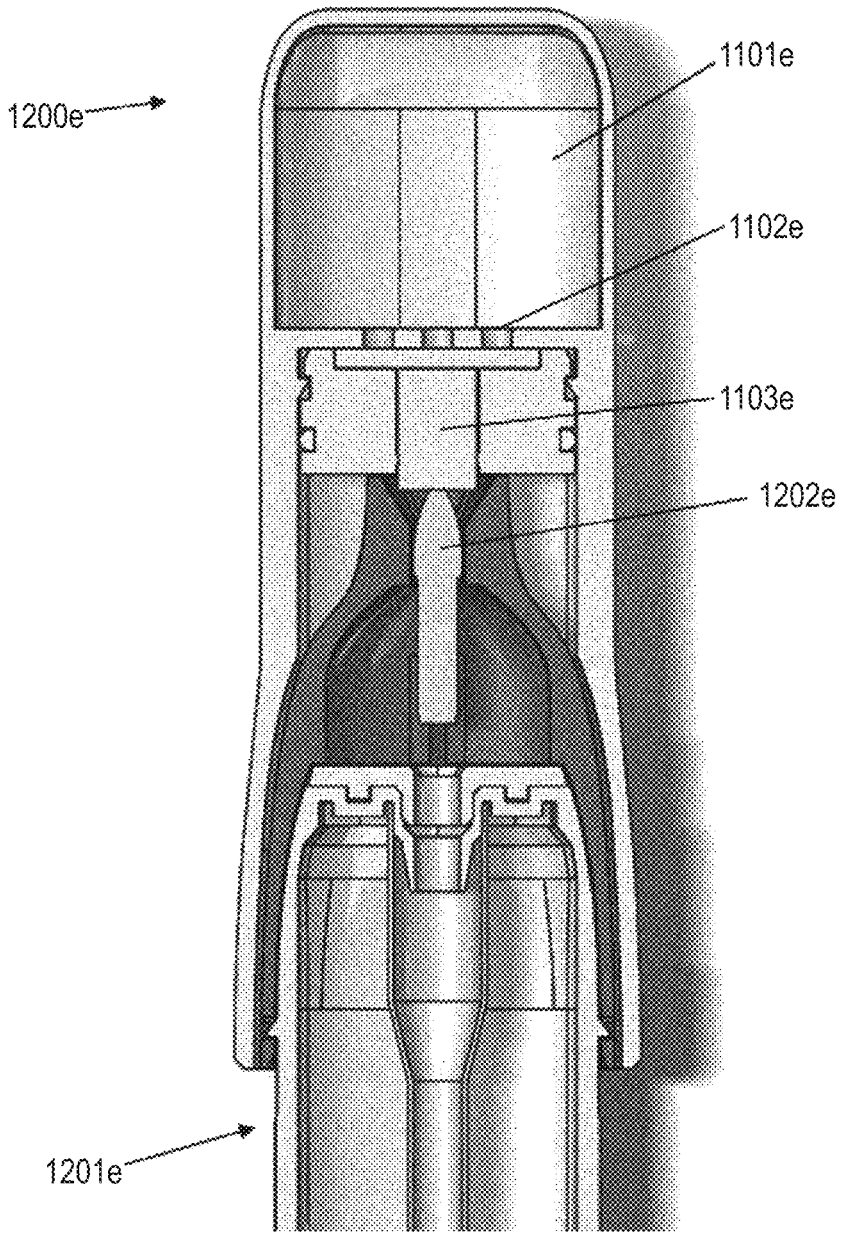
FIG. 63 shows a refill cap engaged with a variant flavor pod portion of the fifth mode.

FIG. 63 shows a variant refill cap 1200*e* connected to a variant flavor pod portion 1201*e*. In contrast to the flavor pod portion 105*e* discussed above, the variant flavor pod portion 1201*e* does not have a first storage 116*e* containing aerosol precursor. Accordingly, the only method of providing aerosol precursor to member 1202*e* is through attachment of the refill cap 1200*e* or refill cap 1100*e*. Refill cap 1200*e* differs from refill cap 1100*e* in that it utilizes an interference fit to be secured to the flavor pod portion 1201*e*.

Figure 64:
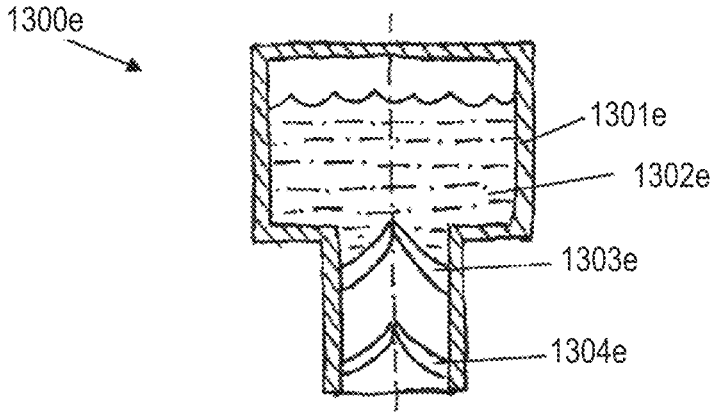
FIG. 64 shows a cross-sectional view of a third embodiment of the fifth mode of a refill device.

FIG. 64 shows a cross-sectional view of a third embodiment of a refill device 1300*e*. Broadly, the refill device comprises a refill reservoir 1301*e* containing aerosol precursor 1302*e*, and a valve 1303*e* connected to the refill reservoir 1301*e* and openable by contact with the member 115*e* of the consumable 103*e* discussed previously. In this example, the refill device 1300*e* includes two valves, a first 1303*e* and a second 1304*e* both of which are embodied as duckbill valves and which are opened by inserting member 115*e* therethrough. When the member 115*e* opens the upper of the two duckbill valves, it will be in fluid contact with the aerosol precursor stored in the refill reservoir 1301*e*. The refill device 1300*e* may be dimensioned such that at least lower portion of the outer housing fits within the mouthpiece aperture of the consumable 103*e* discussed previously. In such an example, the refill device 1300*e* can be engaged directly with a consumable without the need to move member 115*e* relative to any other parts of the consumable.

Figure 65:
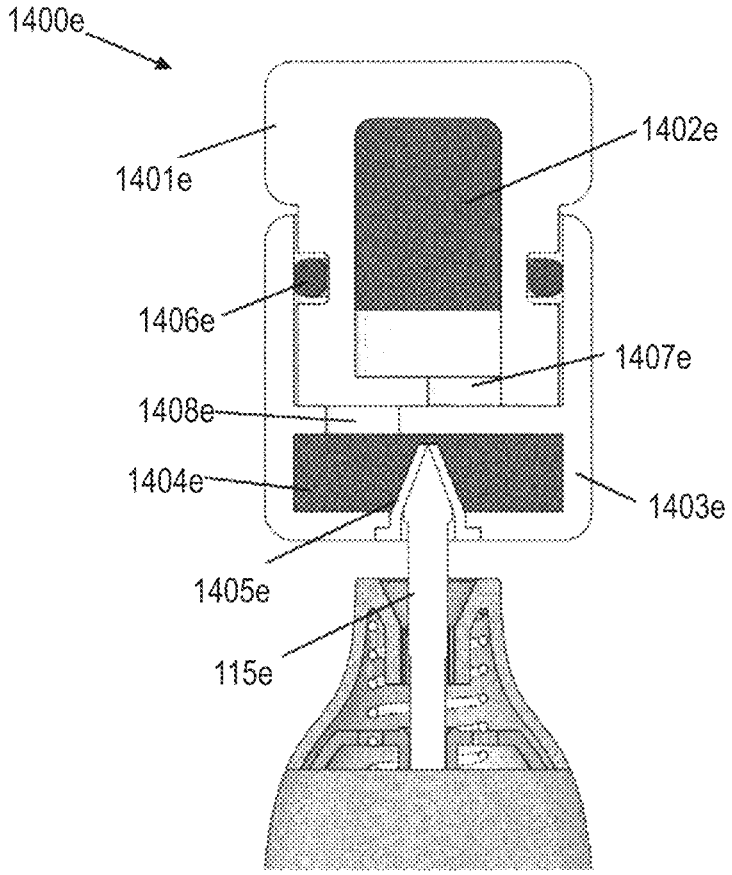
FIG. 65 shows a cross-sectional view of a fourth embodiment of the fifth mode of a refill device engaged with a flavor pod portion.

FIG. 65 shows a cross-sectional view of a fourth embodiment of a refill device 1400*e*, as engaged with the member 115*e* of the consumable 103*e*. Broadly, this refill device 1400*e* (of the fourth embodiment) is formed of two units: first unit 1401*e* and second unit 1403*e*. The first unit 1401*e* includes a refill reservoir 1402*e*, and is fluidly connectable to a dosing chamber 1404*e* included in the second unit 1403*e*. The dosing chamber 1404*e* includes a duckbill valve 1405*e* which is openable by provision of the member 115*e* discussed previously. The refill reservoir 1402*e* and the dosing chamber 1404*e* are connectable by first conduit 1407*e* and second conduit 1408*e*, each contained in a respective unit of first unit 1401*e* and second unit 1403*e*. The first unit 1401*e* is rotatable relative to the first by use of bearing 1406*e*. This allows the first conduit 1407*e* to be aligned with the second conduit 1408*e*, and to allow aerosol precursor stored in the refill reservoir 1402*e* to enter the dosing chamber 1404*e*.

Either or both of the refill devices 1300*e*, 1400*e* shown in FIG. 64 and FIG. 65 may include a lock, which seals the valve such that it cannot be opened by introduction of the member 115*e*. Further, either or both of the refill devices 1300*e*, 1400*e* may include a pump which is operable to pump aerosol precursor into the member 115*e* when it is introduced through the respective valves. The operation of the pump may be triggered by introduction of the member 115*e*, or may be triggered through a user action e.g., pressing a button.

In further examples of the refill devices 1300*e*, 1400*e* shown in FIG. 64 and FIG. 65, a portion of each refill device may provide an engagement mechanism located at an end of the refill device proximal to the valve. This can allow the refill device to be engaged and secured to a corresponding mechanism on the consumable. For example, the engagement mechanism may be provided by a number of interlocking teeth which engage with the grooves or channels 228*e* of the mouthpiece. This can ensure that whilst aerosol precursor is transferred to the member 115*e*, the risk of shearing or damaging the member 115*e* is reduced.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the scope of the invention as defined in the appended claims.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps. It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the invention that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

Illustrative Embodiments

First Mode: An Aerosol Delivery Device in which a Barrier Arrangement Inhibits Evaporation of Aerosol Precursor The following numbered Illustrative Embodiments may be useful in understanding the various aspects of the first mode previously described herein:

Illustrative Embodiment 1. An aerosol delivery device comprising: a storage for storing an aerosol precursor; a transfer element; and a barrier arrangement for inhibiting flow of aerosol precursor from the storage to the transfer element when the barrier arrangement is in a closed position, wherein the barrier arrangement is selectively actuatable between the closed position and an open position, and when the barrier arrangement is in the open position the transfer element can transfer aerosol precursor from the storage.

Illustrative Embodiment 2. An aerosol delivery device according to Illustrative Embodiment 1, wherein the transfer element is selectively exposable to the storage to selectively open and close the barrier arrangement.

Illustrative Embodiment 3. An aerosol delivery device according to Illustrative Embodiment 2, wherein the transfer element is movable with respect to the barrier arrangement to selectively expose the transfer element to the storage.

Illustrative Embodiment 4. An aerosol delivery device according to Illustrative Embodiment 3, wherein the barrier arrangement comprises a barrier element configured to move with the transfer element, the barrier element configured to inhibit flow of aerosol precursor from the storage to the transfer element when the barrier arrangement is in the closed position.

Illustrative Embodiment 5. An aerosol delivery device according to Illustrative Embodiment 4, wherein the barrier arrangement further comprises a tube, the transfer element received in the tube and the barrier element configured to block the tube when the barrier arrangement is in the closed position.

Illustrative Embodiment 6. An aerosol delivery device according to Illustrative Embodiment 5, wherein the barrier element is fixed to an end portion of the transfer element, and the barrier element is configured to be out of the tube such that aside portion of the transfer element is exposed to the storage when the barrier arrangement is in the open position.

Illustrative Embodiment 7. An aerosol delivery device according to any one of the preceding Illustrative Embodiments, and further comprising an aerosol generator configured to receive aerosol precursor from the additional storage and form an aerosol from the aerosol precursor.

Illustrative Embodiment 8. An aerosol delivery device according to Illustrative Embodiment 7, wherein the aerosol generator comprises an aerosol generator portion configured to receive the aerosol precursor from the additional storage, and the aerosol delivery device comprises an air flow passage configured to direct air past the aerosol generator portion to pick up the aerosol precursor from the aerosol generator portion to form an aerosol.

Illustrative Embodiment 9. An aerosol delivery device according to Illustrative Embodiment 8, and further comprising a member, the member comprising the transfer element and the aerosol generator portion.

Illustrative Embodiment 10. An aerosol delivery device according to Illustrative Embodiment 9 when dependent on Illustrative Embodiment 3, wherein the member is movable with respect to the barrier arrangement to selectively expose the transfer element to the storage.

Illustrative Embodiment 11. An aerosol delivery device according to any one of the preceding Illustrative Embodiments, and further comprising a mouthpiece and a body, wherein the barrier arrangement is configured to open in response to sliding of the mouthpiece relative to the body.

Illustrative Embodiment 12. An aerosol delivery device according to any one of the preceding Illustrative Embodiments, wherein the transfer element is porous.

Illustrative Embodiment 13. An aerosol delivery device according to any one of the preceding Illustrative Embodiments, wherein the aerosol delivery device is a consumable for a vaping device.

Illustrative Embodiment 14. An aerosol delivery device according to any one of the preceding Illustrative Embodiments, and further comprising an additional aerosol generator, the additional aerosol generator configured to produce an additional aerosol from an additional aerosol precursor.

Illustrative Embodiment 15. An aerosol delivery device according to Illustrative Embodiment 14, wherein the additional aerosol generator is configured to heat the additional aerosol precursor to form the additional aerosol.

Illustrative Embodiment 16. An aerosol delivery device comprising: a storage for storing an aerosol precursor; an additional storage; and a barrier arrangement for inhibiting flow of aerosol precursor from the storage to the additional storage, the barrier arrangement openable to permit flow of aerosol precursor from the storage to the additional storage.

Illustrative Embodiment 17. An aerosol delivery device according to Illustrative Embodiment 16, and further comprising an aerosol generator configured to receive aerosol precursor from the additional storage and form an aerosol from the aerosol precursor.

Illustrative Embodiment 18. An aerosol delivery device according to Illustrative Embodiment 17, wherein the aerosol generator comprises an aerosol generator portion configured to receive the aerosol precursor from the additional storage, and the aerosol delivery device comprises an air flow passage configured to direct air past the aerosol generator portion to pick up the aerosol precursor from the aerosol generator portion to form an aerosol.

Illustrative Embodiment 19. An aerosol delivery device according to Illustrative Embodiment 17 or Illustrative Embodiment 18, and further comprising a transfer element for transferring aerosol precursor from the additional storage to the aerosol generator portion.

Illustrative Embodiment 20. An aerosol delivery device according to Illustrative Embodiment 19 and further comprising a member, the member comprising the transfer element and the aerosol generator portion.

Illustrative Embodiment 21. An aerosol delivery device according to Illustrative Embodiment 19 or 20, wherein the transfer element is porous.

Illustrative Embodiment 22. An aerosol delivery device according to any one of Illustrative Embodiments 19 to 21, wherein the barrier arrangement comprises a barrier component between the storage and the additional storage, and the transfer element is movable to pierce the barrier component to open the barrier arrangement.

Illustrative Embodiment 23. An aerosol delivery device according to Illustrative Embodiment 22, wherein the barrier component is a foil membrane.

Illustrative Embodiment 24. An aerosol delivery device according to any one Illustrative Embodiments 16 to 23, and further comprising a mouthpiece and a body, wherein the barrier arrangement is configured to open in response to sliding of the mouthpiece relative to the body.

Illustrative Embodiment 25. An aerosol delivery device according to Illustrative Embodiment 24 when dependent on Illustrative Embodiment 22, and further comprising a supporting portion for maintaining a position of the transfer element with respect to the mouthpiece during sliding of the mouthpiece.

Illustrative Embodiment 26. An aerosol delivery device according to any one of Illustrative Embodiments 16 to 25, wherein the storage comprises a free liquid tank and the additional storage comprises a porous reservoir.

Illustrative Embodiment 27. An aerosol delivery device according to any one of Illustrative Embodiments 16 to 26, wherein the additional storage is located closer to a mouthpiece opening than the storage.

Illustrative Embodiment 28. An aerosol delivery device according to any one of Illustrative Embodiments 16 to 27, wherein the aerosol delivery device is a consumable for a vaping device.

Illustrative Embodiment 29. An aerosol delivery device according to any one of Illustrative Embodiments 16 to 28 and further comprising an additional aerosol generator, the additional aerosol generator configured to produce an additional aerosol from an additional aerosol precursor.

Illustrative Embodiment 30. An aerosol delivery device according to Illustrative Embodiment 29, wherein the additional aerosol generator is configured to heat the additional aerosol precursor to form the additional aerosol.

Illustrative Embodiment 31. An aerosol delivery device comprising: a storage for storing an aerosol precursor; a transfer element; and a barrier arrangement comprising a plug, the plug configured to inhibit flow of aerosol precursor from the storage to the transfer element when the plug is in a closed position, wherein the plug is displaceable to open the barrier arrangement so that the transfer element can transfer aerosol precursor from the storage.

Illustrative Embodiment 32. An aerosol delivery device according to Illustrative Embodiment 31, wherein the transfer element is movable to displace the plug to open the transfer element.

Illustrative Embodiment 33. An aerosol delivery device according to Illustrative Embodiment 32 and further comprising a tube, wherein the transfer element and the plug are received in the tube, and the plug is displaceable from the tube to open the barrier arrangement.

Illustrative Embodiment 34. An aerosol delivery device according to any one of Illustrative Embodiments 31 to 33, and further comprising: an aerosol generator comprising an aerosol generator portion configured to receive the aerosol precursor from the transfer element; and an air flow passage configured to direct air past the aerosol generator portion to pick up the aerosol precursor from the aerosol generator portion to form an aerosol.

Illustrative Embodiment 35. An aerosol delivery device according to Illustrative Embodiment 34 and further comprising a member, the member comprising the transfer element and the aerosol generator portion, wherein the member is movable from a first position to a second position to open the barrier arrangement.

Illustrative Embodiment 36. An aerosol delivery device according to any one of Illustrative Embodiments 30 to 35, and further comprising a guide for inhibiting return of the plug to the closed position after displacement of the plug.

Illustrative Embodiment 37. An aerosol delivery device according to Illustrative Embodiment 36, wherein the guide comprises a recess for receiving the plug.

Illustrative Embodiment 38. An aerosol delivery device according to any one of Illustrative Embodiments 30 to 37, wherein the plug is formed of silicone.

Illustrative Embodiment 39. An aerosol delivery device according to any one of Illustrative Embodiments 30 to 38, and further comprising a mouthpiece and a body, wherein the barrier arrangement is configured to open in response to sliding of the mouthpiece relative to the body.

Illustrative Embodiment 40. An aerosol delivery device according to Illustrative Embodiment 39 when dependent on Illustrative Embodiment 35, and further comprising a supporting portion for maintaining a position of the member with respect to the mouthpiece during sliding of the mouthpiece.

Illustrative Embodiment 41. An aerosol delivery device according to any one of Illustrative Embodiments 30 to 40, and further comprising: a pressure relief opening in the storage; and a blocking arrangement for inhibiting flow through the pressure relief opening, wherein the blocking arrangement is openable to permit air to flow through the pressure relief opening and into the storage as the storage empties of aerosol precursor.

Illustrative Embodiment 42. An aerosol delivery device according to any one of Illustrative Embodiments 30 to 41, wherein the transfer element is porous.

Illustrative Embodiment 43. An aerosol delivery device according to any one of Illustrative Embodiments 30 to 42, wherein the aerosol delivery device is a consumable for a vaping device.

Illustrative Embodiment 44. An aerosol delivery device according to any one of Illustrative Embodiments 30 to 43 and further comprising an additional aerosol generator, the additional aerosol generator configured to produce an additional aerosol from an additional aerosol precursor.

Illustrative Embodiment 45. An aerosol delivery device according to Illustrative Embodiment 44, wherein the additional aerosol generator is configured to heat the additional aerosol precursor to form the additional aerosol.

Illustrative Embodiment 46. An aerosol delivery device comprising: a storage for storing an aerosol precursor; a transfer element; and a barrier arrangement for inhibiting flow of aerosol precursor from the storage to the transfer element, wherein the storage is movable with respect to the barrier arrangement to open the barrier arrangement so that the transfer element can transfer aerosol precursor from the storage.

Illustrative Embodiment 47. An aerosol delivery device according to Illustrative Embodiment 46, wherein the storage is movable relative to the transfer element to open the barrier arrangement.

Illustrative Embodiment 48. An aerosol delivery device according to Illustrative Embodiment 46 or Illustrative Embodiment 47, wherein the barrier arrangement comprises a plug received in a tube, the plug configured to inhibit flow of aerosol precursor from the storage to the transfer element, wherein the tube is configured to move with the storage, and the plug is displaceable from the tube on movement of the storage so that the transfer element can transfer aerosol precursor from the storage.

Illustrative Embodiment 49. An aerosol delivery device according to Illustrative Embodiment 48, wherein movement of the storage causes the transfer element to contact the plug to displace the plug from the tube.

Illustrative Embodiment 50. An aerosol delivery device according to Illustrative Embodiment 46 or Illustrative Embodiment 47, wherein the barrier arrangement comprises a deformable barrier component, the barrier component configured to deform to open the barrier arrangement on movement of the storage.

Illustrative Embodiment 51. An aerosol delivery device according to Illustrative Embodiment 50, wherein movement of the storage causes the transfer element to pierce the barrier component to open the barrier arrangement.

Illustrative Embodiment 52. An aerosol delivery device according to any one of Illustrative Embodiments 46 to 51, and further comprising a slidable switch for moving the storage.

Illustrative Embodiment 53. An aerosol delivery device according to Illustrative Embodiment 52 and further comprising a connector for connecting the switch to the storage.

Illustrative Embodiment 54. An aerosol delivery device according to any one of Illustrative Embodiments 46 to 53, and further comprising a pressure relief opening in the storage; and a blocking arrangement for inhibiting flow through the pressure relief opening, wherein the blocking arrangement is openable to permit air to flow through the pressure relief opening and into the storage as the storage empties of aerosol precursor.

Illustrative Embodiment 55. An aerosol delivery device according to Illustrative Embodiment 54 when dependent on Illustrative Embodiment 52, wherein the moving the switch causes the blocking arrangement to open.

Illustrative Embodiment 56. An aerosol delivery device according to Illustrative Embodiment 55 when dependent on Illustrative Embodiment 53, wherein the connector provides the blocking arrangement, and the aerosol delivery device further comprises a stop, the stop configured to inhibit movement of the storage after the barrier arrangement is open, such that further movement of the switch causes the connector to disconnect from the storage to open the blocking arrangement.

Illustrative Embodiment 57. An aerosol delivery device according to any one of Illustrative Embodiments 46 to 56, and further comprising: an aerosol generator comprising an aerosol generator portion configured to receive the aerosol precursor from the transfer element; and an air flow passage configured to direct air past the aerosol generator portion to pick up the aerosol precursor from the aerosol generator portion to form an aerosol.

Illustrative Embodiment 58. An aerosol delivery device according to Illustrative Embodiment 57 and further comprising a member, the member comprising the transfer element and the aerosol generator portion, wherein the member is movable from a first position to a second position to open the barrier arrangement.

Illustrative Embodiment 59. An aerosol delivery device according to Illustrative Embodiment 58, and further comprising a mouthpiece and a supporting portion for maintaining a position of the member with respect to the mouthpiece during movement of the storage.

Illustrative Embodiment 60. An aerosol delivery device according to any one of Illustrative Embodiments 46 to 59, wherein the aerosol delivery device is a consumable for a vaping device.

Illustrative Embodiment 61. An aerosol delivery device comprising: a storage for storing an aerosol precursor; a pressure relief opening in the storage; and a blocking arrangement for inhibiting flow through the pressure relief opening, wherein the blocking arrangement is openable to permit air to flow through the pressure relief opening and into the storage as the storage empties of aerosol precursor.

Illustrative Embodiment 62. An aerosol delivery device according to Illustrative Embodiment 61, and further comprising a mouthpiece and a body, the mouthpiece movable relative to the body to open the blocking arrangement.

Illustrative Embodiment 63. An aerosol delivery device according to Illustrative Embodiment 62, wherein twisting of the mouthpiece relative to the body causes opening of the blocking arrangement.

Illustrative Embodiment 64. An aerosol delivery device according to Illustrative Embodiment 62, wherein sliding of the mouthpiece relative to body causes opening of the blocking arrangement.

Illustrative Embodiment 65. An aerosol delivery device according to any one of Illustrative Embodiments 60 to 64, wherein the blocking arrangement comprises a blocking component for inhibiting flow through the pressure relief opening, the blocking component defining an aperture, the aperture alignable with the pressure relief opening to open the blocking arrangement.

Illustrative Embodiment 66. An aerosol delivery device according to any one of Illustrative Embodiments 61 to 64, wherein the blocking arrangement comprises a blocking component for inhibiting flow through the pressure relief opening and a piercing component movable relative to the blocking component, wherein the blocking component is pierceable by the piercing component to open the blocking arrangement.

Illustrative Embodiment 67. An aerosol delivery device according to any one of Illustrative Embodiments 60 to 66 and further comprising: a transfer element; and a barrier arrangement for inhibiting flow of aerosol precursor from the storage to the transfer element, the barrier arrangement openable to permit flow of aerosol precursor from the storage to the transfer element.

Illustrative Embodiment 68. An aerosol delivery device according Illustrative Embodiment 67, and further comprising: an aerosol generator comprising an aerosol generator portion configured to receive the aerosol precursor from the transfer element; and an air flow passage configured to direct air past the aerosol generator portion to pick up the aerosol precursor from the aerosol generator portion to form an aerosol.

Illustrative Embodiment 69. An aerosol delivery device according to Illustrative Embodiment 68 and further comprising a member, the member comprising the transfer element and the aerosol generator portion, wherein the member is movable from a first position to a second position to open the barrier arrangement.

Illustrative Embodiment 70. An aerosol delivery device according to Illustrative Embodiment 69, and further comprising a supporting portion for maintaining a position of the member with respect to the mouthpiece during sliding of the mouthpiece.

Illustrative Embodiment 71. An aerosol delivery device any one of Illustrative Embodiments 67 to 70, wherein opening of the barrier arrangement causes open of the blocking arrangement.

Illustrative Embodiment 72. An aerosol delivery device according to any one of Illustrative Embodiments 60 to 71, wherein the member is slidable from the first position to the second position to open the barrier arrangement.

Illustrative Embodiment 73. An aerosol delivery device according to any one of Illustrative Embodiments 60 to 72, wherein the aerosol delivery device is a consumable for a vaping device.

Illustrative Embodiment 74. An aerosol delivery device according to any one of Illustrative Embodiments 60 to 73 and further comprising an additional aerosol generator, the additional aerosol generator configured to produce an additional aerosol from an additional aerosol precursor.

Illustrative Embodiment 75. An aerosol delivery device according to Illustrative Embodiment 74, wherein the additional aerosol generator is configured to heat the additional aerosol precursor to form the additional aerosol.

Illustrative Embodiment 76. An aerosol delivery device comprising: a storage for storing an aerosol precursor; a transfer element; and a barrier arrangement for inhibiting flow of aerosol precursor from the storage to the transfer element, wherein the transfer element is movable with respect to the barrier arrangement to open the barrier arrangement so that the transfer element can transfer aerosol precursor from the storage.

Illustrative Embodiment 77. An aerosol delivery device according to Illustrative Embodiment 76, and further comprising: an aerosol generator comprising an aerosol generator portion configured to receive the aerosol precursor from the transfer element; and an air flow passage configured to direct air past the aerosol generator portion to pick up the aerosol precursor from the aerosol generator portion to form an aerosol.

Illustrative Embodiment 78. An aerosol delivery device according to Illustrative Embodiment 77 and further comprising a member, the member comprising the transfer element and the aerosol generator portion, wherein the member is movable from a first position to a second position to open the barrier arrangement.

Illustrative Embodiment 79. An aerosol delivery device according to any one of Illustrative Embodiments 76 to 78, wherein the member is slidable from the first position to the second position to open the barrier arrangement.

Illustrative Embodiment 80. An aerosol delivery device according to any one of Illustrative Embodiments 76 to 79, and further comprising a mouthpiece and a body, wherein the barrier arrangement is configured to open in response to sliding of the mouthpiece relative to the body.

Illustrative Embodiment 81. An aerosol delivery device according to Illustrative Embodiment 80 when dependent on Illustrative Embodiment 4, and further comprising a supporting portion for maintaining a position of the member with respect to the mouthpiece during sliding of the mouthpiece.

Illustrative Embodiment 82. An aerosol delivery device according to any one of Illustrative Embodiments 76 to 81, wherein the barrier arrangement is configured to remain permanently open after opening.

Illustrative Embodiment 83. An aerosol delivery device according to any one of Illustrative Embodiments 76 to 82, wherein the barrier arrangement comprises a plug received in a tube, the plug configured to inhibit flow of aerosol precursor from the storage to the transfer element, wherein the plug is displaceable from the tube on movement of the transfer element so that the transfer element can transfer aerosol precursor from the storage.

Illustrative Embodiment 84. An aerosol delivery device according to Illustrative Embodiment 83, and further comprising a guide for inhibiting return of the plug to the tube after the plug is displaced from the tube.

Illustrative Embodiment 85. An aerosol delivery device according to any one of Illustrative Embodiments 76 to 81, wherein the barrier arrangement comprises a deformable barrier component, and the transfer element is configured to deform the barrier component to open the barrier arrangement.

Illustrative Embodiment 86. An aerosol delivery device according to any one of Illustrative Embodiments 76 to 85, and further comprising: a pressure relief opening in the storage; and a blocking arrangement for inhibiting flow through the pressure relief opening, wherein the blocking arrangement is openable to permit air to flow through the pressure relief opening and into the storage as the storage empties of aerosol precursor.

Illustrative Embodiment 87. An aerosol delivery device according to any one of Illustrative Embodiments 76 to 86, wherein the transfer element is porous.

Illustrative Embodiment 88. An aerosol delivery device according to any one of Illustrative Embodiments 76 to 87, wherein the aerosol delivery device is a consumable for a vaping device.

Illustrative Embodiment 89. An aerosol delivery device according to any one of Illustrative Embodiments 76 to 88 and further comprising an additional aerosol generator, the additional aerosol generator configured to produce an additional aerosol from an additional aerosol precursor.

Illustrative Embodiment 90. An aerosol delivery device according to Illustrative Embodiment 89, wherein the additional aerosol generator is configured to heat the additional aerosol precursor to form the additional aerosol.

Illustrative Embodiment 91. An aerosol delivery device comprising: a reservoir containing an aerosol precursor; an aerosol generator, operable to aerosolize the aerosol precursor and provide it to a user; and a frangible seal, which is located between the reservoir and the aerosol generator, and which, when unbroken, fluidly seals the aerosol generator from the reservoir and which, when broken, allows the aerosol precursor to fluidly contact the aerosol generator.

Illustrative Embodiment 92. The aerosol delivery device of Illustrative Embodiment 91, further comprising: an aerosol generator portion configured to receive the aerosol precursor when the frangible seal is broken, and an airflow passage, configured to direct air past the aerosol generator portion to pick up the aerosol precursor from the aerosol generator portion to form an aerosol.

Illustrative Embodiment 93. The aerosol delivery device of Illustrative Embodiment 92, wherein the aerosol generator portion includes a Venturi aperture and a porous member located within the Venturi aperture and fluidly connectable to the reservoir.

Illustrative Embodiment 94. The aerosol delivery device of any one of Illustrative Embodiments 91 to 93, further comprising a housing of the reservoir configured to deform and break the frangible seal.

Illustrative Embodiment 95. The aerosol delivery device of Illustrative Embodiment 94, further comprising an outer housing, adjacent to the housing of the reservoir and configured to deform upon application of a force and impact the housing of the reservoir.

Illustrative Embodiment 96. The aerosol delivery device of any one of Illustrative Embodiments 91 to 95, wherein the frangible seal is a cylindrical glass seal encapsulating a region of the aerosol generator.

Illustrative Embodiment 97. The aerosol delivery device of Illustrative Embodiment 96, wherein the aerosol generator comprises a nib and a shaft, wherein the shaft is disposed within the cylindrical glass seal.

Illustrative Embodiment 98. The aerosol delivery device of any one of Illustrative Embodiments 91 to 97, further comprising a button which, when pressed, breaks the frangible seal.

Illustrative Embodiment 99. The aerosol delivery device of any one of Illustrative Embodiments 91 to 98, further comprising a vapor generator, for vaporizing a vapor precursor, and wherein the aerosol generated by the aerosol generator is mixed with the vapor downstream of the vapor generator.

Illustrative Embodiment 100. The aerosol delivery device of any one of Illustrative Embodiments 91 to 99, wherein the aerosol precursor is a flavor aerosol precursor and is substantially nicotine free.

Illustrative Embodiment 101. The aerosol delivery device of any one of Illustrative Embodiments 91 to 100, wherein the aerosol generator is made of a material having a different color to the aerosol precursor.

Illustrative Embodiment 102. The aerosol delivery device of any one of Illustrative Embodiments 91 to 101, wherein the aerosol delivery device has a longitudinal axis, and the frangible seal is configured to break upon application of a force transversal to the longitudinal axis.

Illustrative Embodiment 103. The aerosol delivery device of any one of Illustrative Embodiments 91 to 102, wherein the aerosol delivery device is a consumable for a smoking substitute device Illustrative Embodiment 104. The aerosol delivery device of any one of Illustrative Embodiments 91 to 103, further comprising an additional aerosol generator, the additional aerosol generator being configured to heat an additional aerosol precursor to produce an additional aerosol.

Illustrative Embodiment 105. A substitute smoking device, including the aerosol delivery device according to any of Illustrative Embodiments 91-104.

Second Mode: An Aerosol Delivery Device Comprising a Switching Device

The following numbered Illustrative Embodiments may be useful in understanding the second mode of the disclosure herein:

Illustrative Embodiment 1. An aerosol delivery device comprising: an aerosol generator configured to produce an aerosol from an aerosol precursor during a delivery event, wherein the aerosol comprises a flavor component; and a switching device permitting switching of the aerosol generator between a normal mode and a boost mode, wherein the aerosol generator is configured to: in the normal mode, produce aerosol comprising a first mass of aerosol precursor per delivery event; and in the boost mode, produce aerosol comprising a second mass of aerosol precursor per delivery event, wherein the second mass is greater than the first mass.

Illustrative Embodiment 2. An aerosol delivery device according to Illustrative Embodiment 1, wherein the switching device further permits switching of the aerosol generator into an off mode, wherein in the off mode, the aerosol generator is configured not to produce aerosol during the delivery event.

Illustrative Embodiment 3. An aerosol delivery device according to Illustrative Embodiment 1 or Illustrative Embodiment 2, wherein the switching device permits continuous variation in mass of aerosol precursor per delivery event between the normal mode and the boost mode.

Illustrative Embodiment 4. An aerosol delivery device according to any one of the preceding Illustrative Embodiments, wherein the switching device is configured to bias the aerosol generator from the boost mode towards the normal mode.

Illustrative Embodiment 5. An aerosol delivery device according to any one of the preceding Illustrative Embodiments, wherein the switching device comprises a sliding switching mechanism slidable to switch the aerosol generator between the normal mode and the boost mode.

Illustrative Embodiment 6. An aerosol delivery device according to any one of the preceding Illustrative Embodiments, wherein the aerosol generator comprises: an aerosol generator portion configured to receive the aerosol precursor; and an air flow passage configured to direct air past the aerosol generator portion to pick up the aerosol precursor from the aerosol generator portion to form the aerosol, wherein the switching device is configured to provide relative movement between the aerosol generator portion and the airflow passage to switch the aerosol generator between the normal mode and the boost mode.

Illustrative Embodiment 7. An aerosol delivery device according to Illustrative Embodiment 6, wherein the switching device is configured to provide the relative movement to vary a surface area of the aerosol generator portion located in an aerosol generation region of the airflow passage to switch the aerosol generator between the normal mode and the boost mode.

Illustrative Embodiment 8. An aerosol delivery device according to Illustrative Embodiment 6 or Illustrative Embodiment 7, wherein the switching device is configured to provide the relative movement to vary a velocity of airflow past the aerosol generator portion to switch the aerosol generator between the normal mode and the boost mode.

Illustrative Embodiment 9. An aerosol delivery device according to any one Illustrative Embodiments 6 to 8, wherein the switching device is configured to slide the aerosol generator portion to switch the aerosol generator between the normal mode and the boost mode.

Illustrative Embodiment 10. An aerosol delivery device according to Illustrative Embodiment 9, wherein the aerosol delivery device comprises a storage for storing the aerosol precursor, wherein the switching device is further configured to slide the storage with the aerosol generator portion.

Illustrative Embodiment 11. An aerosol delivery device according to Illustrative Embodiment any one of the preceding Illustrative Embodiments, wherein the aerosol generator comprises a member, the member comprising the aerosol generator portion, wherein the member is configured to transfer the aerosol precursor to the aerosol generator portion.

Illustrative Embodiment 12. An aerosol delivery device according to any preceding Illustrative Embodiment, wherein the aerosol delivery device is a consumable for a smoking substitute device.

Illustrative Embodiment 13. An aerosol delivery device according to any preceding Illustrative Embodiment and further comprising an additional aerosol generator, the additional aerosol generator configured to produce an additional aerosol from an additional aerosol precursor during the delivery event.

Illustrative Embodiment 14. An aerosol delivery device according to Illustrative Embodiment 13, wherein the additional aerosol generator is configured to produce the additional aerosol comprising substantially the same mass of additional aerosol precursor per delivery event in the normal mode and in the boost mode.

Illustrative Embodiment 15. An aerosol delivery device according to Illustrative Embodiment 14, wherein the additional aerosol generator is configured to heat the additional aerosol precursor to form the additional aerosol.

Illustrative Embodiment 16. An aerosol delivery device comprising: a storage for storing an aerosol precursor; a transfer element for transferring aerosol precursor from the storage; a switch; and a supporting portion connecting the transfer element to the switch such that movement of the switch causes movement of the transfer element.

Illustrative Embodiment 17. An aerosol delivery device according to Illustrative Embodiment 16, and further comprising a barrier arrangement for inhibiting flow of aerosol precursor from the storage, wherein the transfer element is movable with respect to the barrier arrangement to open the barrier arrangement so that the transfer element can transfer aerosol precursor from the storage on movement of the switch.

Illustrative Embodiment 18. An aerosol delivery device according to Illustrative Embodiment 17, and further comprising: an aerosol generator comprising an aerosol generator portion configured to receive the aerosol precursor from the transfer element; and an air flow passage configured to direct air past the aerosol generator portion to pick up the aerosol precursor from the aerosol generator portion to form an aerosol.

Illustrative Embodiment 19. An aerosol delivery device according to Illustrative Embodiment 18 and further comprising a member, the member comprising the transfer element and the aerosol generator portion, wherein the member is movable from a first position to a second position to open the barrier arrangement.

Illustrative Embodiment 20. An aerosol delivery device according to any one of Illustrative Embodiments 16 to 19, wherein the member is slidable from the first position to the second position to open the barrier arrangement.

Illustrative Embodiment 21. An aerosol delivery device according to any one of Illustrative Embodiments 16 to 20, and further comprising a mouthpiece and a body, wherein the mouthpiece is slidable relative to the body to provide the switch.

Illustrative Embodiment 22. An aerosol delivery device according to claim 21 wherein the supporting portion is integrally formed with the mouthpiece.

Illustrative Embodiment 23. An aerosol delivery device according to Illustrative Embodiment 21 or 22 when dependent on Illustrative Embodiment 17, wherein the barrier arrangement is configured to open in response to sliding of the mouthpiece relative to the body.

Illustrative Embodiment 24. An aerosol delivery device according to any one of Illustrative Embodiments 16 to 23, wherein the barrier arrangement is configured to remain permanently open after opening.

Illustrative Embodiment 25. An aerosol delivery device according to any one of Illustrative Embodiments 16 to 24, wherein the barrier arrangement comprises a plug received in a tube, the plug configured to inhibit flow of aerosol precursor from the storage to the transfer element, wherein the plug is displaceable from the tube on movement of the transfer element so that the transfer element can transfer aerosol precursor from the storage.

Illustrative Embodiment 26. An aerosol delivery device according to Illustrative Embodiment 25, and further comprising a guide for inhibiting return of the plug to the tube after the plug is displaced from the tube.

Illustrative Embodiment 27. An aerosol delivery device according to any one of Illustrative Embodiments 16 to 23, wherein the barrier arrangement comprises a deformable barrier component, and the transfer element is configured to deform the barrier component to open the barrier arrangement.

Illustrative Embodiment 28. An aerosol delivery device according to any one of Illustrative Embodiments 16 to 27, and further comprising: a pressure relief opening in the storage; and a blocking arrangement for inhibiting flow through the pressure relief opening, wherein the blocking arrangement is openable to permit air to flow through the pressure relief opening and into the storage as the storage empties of aerosol precursor.

Illustrative Embodiment 29. An aerosol delivery device according to any one of Illustrative Embodiments 16 to 28, wherein the aerosol delivery device is a consumable for a vaping device.

Illustrative Embodiment 30. An aerosol delivery device according to any one of Illustrative Embodiments 16 to 29 and further comprising an additional aerosol generator, the additional aerosol generator configured to produce an additional aerosol from an additional aerosol precursor.

Illustrative Embodiment 31. An aerosol delivery device according to Illustrative Embodiment 30, wherein the additional aerosol generator is configured to heat the additional aerosol precursor to form the additional aerosol.

Third Mode: An Aerosol Delivery Device Comprising an Aerosol Airflow Stream and a Separate Airflow Stream The following number Illustrative Embodiments may be useful in understanding the disclosure herein:

Illustrative Embodiment 1. An aerosol delivery device comprising: a passive aerosol generator, configured to generate an aerosol from an aerosol precursor; a vapor generator, configured to generate a vapor from a vapor precursor; a first airflow path, which extends from a first inlet of the aerosol delivery device through the vapor generator and the passive aerosol generator to an outlet of the aerosol delivery device; and a second airflow path, which extends from a second inlet of the aerosol delivery device through the passive aerosol generator to the outlet.

Illustrative Embodiment 2. The aerosol delivery device of Illustrative Embodiment 1, wherein the aerosol delivery device is configured such that a total airflow through the aerosol delivery device from both the first inlet and second inlet is split such that at least 40% of the airflow passes along the first airflow path.

Illustrative Embodiment 3. The aerosol delivery device of either of Illustrative Embodiment 1 or Illustrative Embodiment 2, wherein the aerosol delivery device is configured such that a total airflow through the aerosol delivery device from both the first inlet and the second inlet is split such that 50% of the airflow passes along the first airflow path and 50% of the airflow passes along the second airflow path.

Illustrative Embodiment 4. The aerosol delivery device of any preceding Illustrative Embodiment, wherein the vapor generator is configured to generate vapor from a vapor precursor when a threshold airflow rate is achieved, and the aerosol delivery device may be configured such that the total airflow through the aerosol delivery device is split such that the airflow rate through the vapor generator exceeds the threshold airflow rate.

Illustrative Embodiment 5. The aerosol delivery device of any preceding Illustrative Embodiment, further comprising a truncated O-ring located between the passive aerosol generator and the vapor generator, the truncated O-ring partially defining the second airflow path.

Illustrative Embodiment 6. The aerosol delivery device of Illustrative Embodiment 5, wherein the truncated O-ring functions as a liquid seal for an aerosol precursor storage.

Illustrative Embodiment 7. The aerosol delivery device of any preceding Illustrative Embodiment, wherein the first airflow path and the second airflow path converge at a point downstream of the vapor generator.

Illustrative Embodiment 8. The aerosol delivery device of any preceding Illustrative Embodiment, wherein the first airflow path and the second airflow path converge at a point upstream of the passive aerosol generator.

Illustrative Embodiment 9. The aerosol delivery device of any preceding Illustrative Embodiment, wherein the aerosol delivery device includes a mouthpiece, and a portion of the aerosol generator is provided within the mouthpiece.

Illustrative Embodiment 10. The aerosol delivery device of any preceding Illustrative Embodiment, wherein the passive aerosol generator includes a Venturi aperture and a porous member is located within the Venturi aperture and fluidly connected to a reservoir of aerosol precursor.

Illustrative Embodiment 11. The aerosol delivery device of any preceding Illustrative Embodiment, wherein the aerosol precursor is a flavor aerosol precursor, and is substantially nicotine free.

Illustrative Embodiment 12. The aerosol delivery device of any preceding Illustrative Embodiment wherein the vapor precursor contains nicotine.

Illustrative Embodiment 13. The aerosol delivery device of any preceding Illustrative Embodiment, wherein the vapor generator includes a coil and wick assembly, and the vapor generator is configured to heat vapor precursor contained within the wick by passing an electrical current through the coil.

Illustrative Embodiment 14. The aerosol delivery device of any preceding Illustrative Embodiment, wherein the aerosol delivery device is a consumable for a smoking substitute device.

Illustrative Embodiment 15. A substitute smoking device, including the aerosol delivery device according to any of Illustrative Embodiment 1-14.

Fourth Mode: An Aerosol Delivery Device Comprising a Deformable Container

The following numbered Illustrative Embodiments may be useful in understanding the disclosure herein:

Illustrative Embodiment 1. An aerosol delivery device comprising: a reservoir of aerosol precursor; an aerosol generator, operable to generate an aerosol from the aerosol precursor; and a mechanically actuatable pump, actuatable to dispense a predetermined quantity of aerosol precursor to the aerosol generator.

Illustrative Embodiment 2. The aerosol delivery device of Illustrative Embodiment 1, wherein the mechanically actuatable pump is actuated by deforming an elastomeric portion of the aerosol delivery device.

Illustrative Embodiment 3. The aerosol delivery device of Illustrative Embodiment 2, wherein the elastomeric portion is configured to actuate the pump and dispense the predetermined quantity of aerosol precursor when compressed.

Illustrative Embodiment 4. The aerosol delivery device of any preceding Illustrative Embodiment, wherein the mechanically actuatable pump is formed as a portion of an outer housing of the device.

Illustrative Embodiment 5. The aerosol delivery device of Illustrative Embodiment 1, wherein the mechanically actuatable pump includes a slidable actuator located on an external surface of the device.

Illustrative Embodiment 6. The aerosol delivery device of any preceding Illustrative Embodiment, further comprising a vapor generator, for vaporizing a vapor precursor, and wherein the aerosol generated by the aerosol generator is mixed with the vapor downstream of the vapor generator.

Illustrative Embodiment 7. The aerosol delivery device of any preceding Illustrative Embodiment, wherein the aerosol precursor is a flavor aerosol precursor and is substantially nicotine free.

Illustrative Embodiment 8. The aerosol delivery device of any preceding Illustrative Embodiment, wherein the reservoir of aerosol precursor is held at ambient pressure.

Illustrative Embodiment 9. The aerosol delivery device of any preceding Illustrative Embodiment, wherein the aerosol generator is an aerosolizing spray nozzle coupled to or forming a part of the mechanically actuatable pump, and configured to generate an aerosol from the aerosol precursor when the mechanically actuatable pump is actuated.

Illustrative Embodiment 10. The aerosol delivery device of any preceding Illustrative Embodiment, further comprising: an aerosol generator portion configured to receive the aerosol precursor; and an airflow passage, configured to direct air past the aerosol generator portion to pick up the aerosol precursor from the aerosol generator portion to form an aerosol when the mechanically actuatable pump is actuated.

Illustrative Embodiment 11. The aerosol delivery device of Illustrative Embodiment 10, wherein the aerosol generator portion includes a Venturi aperture and a porous member located within the Venturi aperture and fluidly connected to the reservoir.

Illustrative Embodiment 12. The aerosol delivery device of any preceding Illustrative Embodiment, further comprising an additional aerosol generator, the additional aerosol generator being configured to heat an additional aerosol precursor to produce an additional aerosol.

Illustrative Embodiment 13. The aerosol delivery device of any preceding Illustrative Embodiment, further comprising a puff sensor, configured to sense when a user is drawing on a mouthpiece of the aerosol delivery device, and wherein the mechanically actuatable pump is configured to actuate when the puff sensor senses a user is drawing on the mouthpiece.

Illustrative Embodiment 14. The aerosol delivery device of any preceding Illustrative Embodiment, wherein the aerosol delivery device is a consumable for a smoking substitute device.

Illustrative Embodiment 15. A substitute smoking device, including the aerosol delivery device according to any of Illustrative Embodiments 1-14.

Fifth Mode: A Refill Device or Cap for an Aerosol Delivery Device

The following numbered Illustrative Embodiments may be useful in understanding the disclosure herein:

Illustrative Embodiment 1. A refill cap for an aerosol delivery device, the aerosol delivery device including an aerosol generator, and the refill cap comprising: an adaptor, for securing the refill cap to an external portion of the aerosol delivery device; a reservoir for storing an aerosol precursor; and a transfer member, which is configured to transfer aerosol precursor from the reservoir to the aerosol generator of the aerosol delivery device when the adaptor secures the refill cap to the aerosol delivery device.

Illustrative Embodiment 2. The refill cap of Illustrative Embodiment 1, wherein the refill cap is configured to cover a mouthpiece aperture of the aerosol delivery device.

Illustrative Embodiment 3. The refill cap of Illustrative Embodiment 1 or 2, wherein the refill cap includes an aperture, into which a mouthpiece of the aerosol delivery device is introduced when the adaptor secures the refill cap to the aerosol delivery device.

Illustrative Embodiment 4. The refill cap of any preceding Illustrative Embodiment, wherein the reservoir has a capacity of no more than 5 ml.

Illustrative Embodiment 5. The refill cap of any preceding Illustrative Embodiment, wherein the transfer member is porous, and wicks aerosol precursor from the reservoir to the aerosol generator when the adaptor secures the refill cap to the aerosol delivery device.

Illustrative Embodiment 6. The refill cap of any preceding Illustrative Embodiment, wherein a housing of the refill cap is deformable, so as to exert a pressure on aerosol precursor stored within the reservoir when a force is applied to the housing.

Illustrative Embodiment 7. The refill cap of any preceding Illustrative Embodiment, wherein the adaptor is a push-fit adaptor, and is securable to the aerosol delivery device by pushing the adaptor onto the external portion of the aerosol delivery device.

Illustrative Embodiment 8. The refill cap of any of Illustrative Embodiments 1-6, wherein the adaptor is a screw-fit adaptor, and is securable to the aerosol delivery device by screwing the adaptor onto the external portion of the aerosol delivery device.

Illustrative Embodiment 9. A reservoir-less aerosol delivery device usable with the refill cap of any preceding Illustrative Embodiment, the reservoir-less aerosol delivery device comprising: an aerosol generator, configured to generate an aerosol from an aerosol precursor; and a mouthpiece, in which a portion of the aerosol generator is provided; wherein the aerosol generator is not provided with a reservoir of aerosol precursor, and the aerosol generator is charged with aerosol precursor solely through use with the refill device.

Illustrative Embodiment 10. The reservoir-less aerosol delivery device of Illustrative Embodiment 9, including the refill device of any of Illustrative Embodiments 1-8 secured to an external portion thereof.

Illustrative Embodiment 11. The aerosol delivery device of Illustrative Embodiment 10, wherein the cap covers a mouthpiece aperture of the aerosol generator when it is secured to the external portion of the aerosol delivery device Illustrative Embodiment 12. The aerosol delivery device of any of Illustrative Embodiments 10-11, wherein the aerosol generator is a passive aerosol generator, and includes an aerosol generating portion configured to receive the aerosol precursor; and an airflow passage, configured to direct air past the aerosol generator portion to pick up the aerosol precursor from the aerosol generator portion to form an aerosol.

Illustrative Embodiment 13. The aerosol delivery device of Illustrative Embodiment 12, wherein the aerosol generator portion includes a Venturi aperture and a porous member located within the Venturi aperture.

Illustrative Embodiment 14. The aerosol delivery device of any of Illustrative Embodiments 9-13, wherein the aerosol delivery device is a consumable in a smoking substitute device.

Illustrative Embodiment 15. A method of charging an aerosol generator of an aerosol delivery device using the refill cap of any of Illustrative Embodiments 1-8, the method comprising: using the adaptor to secure the refill cap to an external portion of the aerosol delivery device.

Illustrative Embodiment 16. A refill device for an aerosol delivery device, the refill device comprising: a refill reservoir containing aerosol precursor; and a valve connected to the refill reservoir, openable by contact with a liquid transfer element of an aerosol generator of the aerosol delivery device, to allow the aerosol precursor contained within the refill reservoir to flow into the aerosol generator.

Illustrative Embodiment 17. The refill device of Illustrative Embodiment 16, wherein the valve is biased into a closed position, such that the valve closes when the liquid transfer element is withdrawn.

Illustrative Embodiment 18. The refill device of either of Illustrative Embodiments 16 or 17, further comprising a locking mechanism which seals the valve.

Illustrative Embodiment 19. The refill device of any of Illustrative Embodiment 16-18, wherein the refill reservoir comprises a first volume adjacent to the valve and a second volume sealable from the first volume by a dividing mechanism.

Illustrative Embodiment 20. The refill device of Illustrative Embodiment 19, wherein the dividing mechanism comprises a first and second conduit, located in respective portions of a flow path, and wherein the first conduit is movable relative to the second between an open position in which aerosol precursor can flow through the flow path and a closed position in which aerosol precursor cannot flow through the flow path.

Illustrative Embodiment 21. The refill device of Illustrative Embodiment 20, wherein the first conduit is rotatable relative to the second conduit, such that the closed position is one in which the first and second conduits are entirely misaligned.

Illustrative Embodiment 22. The refill device of any of Illustrative Embodiment 16-21, wherein the valve is a duckbill valve.

Illustrative Embodiment 23. The refill device of any of Illustrative Embodiment 16-22, further comprising a pump which, when operated when the valve is open, pumps aerosol precursor into the liquid transfer element of the aerosol delivery device.

Illustrative Embodiment 24. The refill device of any of Illustrative Embodiment 16-23, further comprising an engagement mechanism located at an end of the refill device proximal to the valve such that the refill device can be engaged to a corresponding mechanism on the aerosol delivery device.

Illustrative Embodiment 25. A method of refilling an aerosol delivery device using the refill device of any of Illustrative Embodiment 16-24, comprising a step of: introducing the liquid transfer element of the aerosol delivery device through the valve of the refill device, so as to cause aerosol precursor to flow from the refill reservoir into the aerosol delivery device.

Illustrative Embodiment 26. The method of Illustrative Embodiment 25, including an initial priming step, the initial priming step including the sub-steps of: holding the refill device such that the first volume is below the second volume, when the dividing mechanism is not dividing the two volumes, such that the first volume fills with aerosol precursor; and operating the dividing mechanism so as to seal the first volume from the second volume; wherein after the initial priming step has been performed, the liquid transfer element is introduced through the valve.

Illustrative Embodiment 27. An aerosol delivery device, comprising: an aerosol generator, having a liquid transfer element at one end thereof; a mouthpiece, in which the aerosol generator is disposed; and a refill mechanism, which is usable to move the liquid transfer element of the aerosol generator relative to the mouthpiece.

Illustrative Embodiment 28. The aerosol delivery device of Illustrative Embodiment 27, wherein the refill mechanism is a mechanical slider, located on an external surface of the aerosol delivery device.

Illustrative Embodiment 29. The aerosol delivery device of either Illustrative Embodiment 27 or 28, wherein the aerosol generator further comprises: an aerosol generator portion, configured to receive the aerosol precursor; and an airflow passage, configured to direct air past the aerosol generator to pick up the aerosol precursor from the aerosol generator portion to form an aerosol.

Illustrative Embodiment 30. A system comprising: an aerosol delivery device, including: an aerosol generator, having a liquid transfer element at one end thereof; and a mouthpiece, in which the aerosol generator is disposed; the system also comprising: a refill device for the aerosol delivery device, the refill device including: a refill reservoir containing aerosol precursor; and a valve, connected to the refill reservoir and openable by contact with the liquid transfer element of the aerosol generator of the aerosol delivery device, to allow the aerosol precursor contained within the refill reservoir to flow into the aerosol generator.

What is claimed is:

1. An aerosol delivery device comprising:

a storage for storing an aerosol precursor;

a passive aerosol generator comprising an aerosol generator portion configured to receive the aerosol precursor from the storage;

an air flow passage configured to direct air past the aerosol generator portion to pick up the aerosol precursor from the passive aerosol generator portion to form an aerosol; and a barrier arrangement for inhibiting evaporation of aerosol precursor when the barrier arrangement is closed, the barrier arrangement being openable to permit generation of aerosol.

2. The aerosol delivery device of claim 1, wherein the barrier arrangement is configured to open in response to a user inhaling on the aerosol delivery device.

3. The aerosol delivery device of claim 1, wherein the barrier arrangement is selectively openable by a user.

4. The aerosol delivery device of claim 3 further comprising a mouthpiece and a body, wherein the barrier arrangement is configured to open in response to sliding of the mouthpiece relative to the body.

5. The aerosol delivery device of claim 1 and further comprising an additional aerosol generator, the additional aerosol generator configured to produce an additional aerosol from an additional aerosol precursor.

6. An aerosol delivery device comprising:

a passive aerosol generator, located within a first airflow path, and configured to aerosolize an aerosol precursor;

a second airflow path;

wherein the second airflow path at least partially bypasses the aerosol generator; and wherein the first airflow path is configured to direct around or through the passive aerosol generator to form an aerosol, the aerosol being provided to the first airflow path.

7. The aerosol delivery device of claim 6, wherein the first airflow path and the second airflow path converge at a point downstream of the aerosol generator.

8. The aerosol delivery device of claim 7, wherein the first airflow path and the second airflow path converge in a mouthpiece of the aerosol delivery device.

9. The aerosol delivery device of claim 8, wherein a portion of the aerosol generator is provided within the mouthpiece.

10. The aerosol delivery device of claim 8, wherein the mouthpiece includes one or more air outlet holes, which form a portion of the second airflow path.

11. The aerosol delivery device of claim 8, wherein the mouthpiece includes a central aperture, within which a portion of the aerosol generator is disposed.

12. The aerosol delivery device of claim 6, wherein the passive aerosol generator includes a Venturi aperture and a porous member is located within the Venturi aperture and fluidly connected to a reservoir of aerosol precursor.

13. The aerosol delivery device of claim 6, wherein the aerosol generator is located within a cylindrical tube, a porous member of the aerosol generator extends coaxially through a first end of the tube into a mouthpiece of the aerosol delivery device, said first end having a first radius greater than a radius of the porous member, and the porous member extending through a second end of the tube into a reservoir of aerosol precursor, said second end being dimensioned such that the aerosol generator is retained therein through an interference fit.

14. The aerosol delivery device of claim 6, further including a vapor generator, configured to vaporize a vapor precursor and provide the vapor to the second airflow path.

15. The aerosol delivery device of claim 6, wherein the second airflow path completely bypasses the aerosol generator.

16. A refill device for an aerosol delivery device comprising:

a porous liquid transfer element containing aerosol precursor; and an engagement unit, located at one end of the refill device and including at least a portion of the porous liquid transfer element, the engagement unit being suitable for engaging with a corresponding engagement unit of the aerosol delivery device, so as to allow aerosol precursor to flow from the porous liquid transfer element into the aerosol delivery device, characterized in that the engagement unit is a cavity, into which a mouthpiece of the aerosol delivery device can be introduced;

wherein a portion of the porous liquid transfer element extends into the cavity so as to contact a protruding portion of an aerosol generator within the mouthpiece of the aerosol delivery device.

17. The refill device of claim 16, further comprising a liquid reservoir, fluidly connected to the porous liquid transfer element and containing aerosol precursor.

18. The refill device of claim 17, further comprising a pump which, when operated, pressurizes the liquid reservoir to a pressure above an ambient pressure.

19. The refill device of claim 16, wherein the porous liquid transfer element is partially contained within a housing and wherein the housing is deformable so as to exert a pressure on aerosol precursor stored within the liquid reservoir when a force is applied to the housing.

20. An aerosol delivery system comprising:

a reservoir-less aerosol delivery device comprising:

an aerosol generator, configured to generate an aerosol from an aerosol precursor; and a mouthpiece, in which a portion of the aerosol generator is provided;

wherein the aerosol generator is not provided with a reservoir of aerosol precursor, and the refill device of claim 16, and wherein the aerosol generator is charged with aerosol precursor solely through use with the refill device.

* * * * *